US007488277B1

(12) United States Patent
Knapp

(10) Patent No.: US 7,488,277 B1
(45) Date of Patent: Feb. 10, 2009

(54) COMPACT WEIGHTLIFTING FRAME SYSTEM

(76) Inventor: Jeffrey M. Knapp, 7000 SE. Altman Rd., Gresham, OR (US) 97080

( * ) Notice: Subject to any disclaimer, the term of this patent is extended or adjusted under 35 U.S.C. 154(b) by 518 days.

(21) Appl. No.: 10/745,417

(22) Filed: Dec. 22, 2003

Related U.S. Application Data

(63) Continuation-in-part of application No. 09/715,242, filed on Nov. 17, 2000, now Pat. No. 6,685,601.

(51) Int. Cl.
*A63B 21/072* (2006.01)
*A63B 21/078* (2006.01)

(52) U.S. Cl. ..... 482/104; 482/106; 482/135

(58) Field of Classification Search ..... 482/92–94, 482/98, 104, 106–108, 135, 138; D21/662, D21/673, 675, 676, 679, 686, 691
See application file for complete search history.

(56) References Cited

U.S. PATENT DOCUMENTS 3,235,225 A 2/1966 Leflar
3,850,428 A * 11/1974 Zuber ..... 482/36
3,874,657 A 4/1975 Neibojewski
3,918,710 A 11/1975 Neibojewski
4,249,726 A 2/1981 Faust
4,257,590 A 3/1981 Sullivan et al.
4,262,901 A 4/1981 Faust
4,286,782 A 9/1981 Fuhrhop
4,306,715 A 12/1981 Sutherland
4,358,109 A 11/1982 Schrems
4,368,884 A 1/1983 Colvin
4,369,966 A 1/1983 Silberman et al.
4,396,191 A 8/1983 Metler
4,527,797 A * 7/1985 Slade et al. ..... 482/101
4,603,855 A 8/1986 Sebelle
4,615,524 A 10/1986 Sutherland
4,621,809 A 11/1986 Pearl
4,635,934 A 1/1987 Roethke
4,637,608 A 1/1987 Owens et al.
4,645,196 A 2/1987 Christie
4,650,186 A 3/1987 McCreery et al.

(Continued)

FOREIGN PATENT DOCUMENTS

CA 1288790 C * 9/1991

(Continued)

OTHER PUBLICATIONS

Body-Solid, The Pro-Smith Machine #SM-44, Bodybuilder's Discount Outlet catalog, pp. 1-2, Summer Issue 1995.*

(Continued)

*Primary Examiner*—Loan H Thanh
*Assistant Examiner*—Victor K Hwang
(74) *Attorney, Agent, or Firm*—Klarquist Sparkman, LLP

(57) ABSTRACT

A weight lifting frame system with a rear frame member, first and second side frame members coupled to opposite ends of the rear frame member and a barbell holding and guiding assembly capable of releasably securing a barbell for selectively guided movement of the barbell relative to the side frame members. The assembly is configured to receive and releasably retain the barbell therein, and includes first and second guide members coupleable to the side frame members, and first and second movable holders coupleable to the guide members.

2 Claims, 62 Drawing Sheets

U.S. PATENT DOCUMENTS

| | | | | | |
|---|---|---|---|---|---|
| 4,729,561 | A | | 3/1988 | Desjardins | |
| 4,757,998 | A | | 7/1988 | Landin | |
| 4,765,616 | A | | 8/1988 | Wolff | |
| 4,773,642 | A | | 9/1988 | Cruz | |
| 4,781,374 | A | | 11/1988 | Lederman | |
| 4,804,179 | A | | 2/1989 | Murphy et al. | |
| 4,826,153 | A | | 5/1989 | Schalip | |
| 4,842,270 | A | | 6/1989 | Lange | |
| 4,861,024 | A | | 8/1989 | Lee | |
| 4,861,025 | A | | 8/1989 | Rockwell | |
| 4,898,381 | A | | 2/1990 | Gordon | |
| 4,907,798 | A | | 3/1990 | Burchatz | |
| 4,915,377 | A | | 4/1990 | Malnke et al. | |
| 4,919,419 | A | | 4/1990 | Houston | |
| 4,927,135 | A | | 5/1990 | Nieppola | |
| 4,928,961 | A | | 5/1990 | Madden | |
| 4,934,693 | A | | 6/1990 | Santoro | |
| 4,936,572 | A | | 6/1990 | Desiderio | |
| 4,955,604 | A | | 9/1990 | Pogue | |
| 4,960,277 | A | | 10/1990 | LaRossa et al. | |
| 4,974,835 | A | * | 12/1990 | Klink | 482/97 |
| 4,974,837 | A | | 12/1990 | Someya et al. | |
| 4,976,428 | A | | 12/1990 | Ghazi | |
| 5,082,259 | A | | 1/1992 | Gonzalez | |
| 5,082,260 | A | | 1/1992 | Dinelli | |
| 5,098,361 | A | | 3/1992 | Danylieko | |
| 5,141,480 | A | | 8/1992 | Lennox et al. | |
| 5,151,072 | A | | 9/1992 | Cone et al. | |
| 5,184,992 | A | | 2/1993 | Banks | |
| 5,215,510 | A | | 6/1993 | Baran | |
| 5,242,345 | A | | 9/1993 | Mitchell | |
| 5,273,506 | A | * | 12/1993 | Dawson, Jr. | 482/104 |
| 5,281,193 | A | | 1/1994 | Colbo, Jr. | |
| 5,306,220 | A | | 4/1994 | Kearney | |
| 5,318,493 | A | * | 6/1994 | Brady | 482/114 |
| 5,328,428 | A | | 7/1994 | Huang | |
| 5,346,448 | A | | 9/1994 | Sollo | |
| 5,350,346 | A | | 9/1994 | Martinez | |
| 5,456,644 | A | | 10/1995 | Hecox et al. | |
| 5,466,204 | A | | 11/1995 | Nearing | |
| 5,509,876 | A | | 4/1996 | Reyes | |
| 5,551,936 | A | | 9/1996 | Parisi et al. | |
| 5,669,859 | A | | 9/1997 | Liggett et al. | |
| 5,688,216 | A | | 11/1997 | Mauriello | |
| D390,287 | S | | 2/1998 | Hsieh et al. | |
| 5,755,823 | A | | 5/1998 | Cleary | |
| 5,779,601 | A | | 7/1998 | Ish | |
| 5,813,951 | A | | 9/1998 | Einsig | |
| 5,882,283 | A | | 3/1999 | Stevens | |
| 5,921,897 | A | | 7/1999 | Stevens | |
| 5,971,897 | A | | 10/1999 | Olson et al. | |
| 6,027,433 | A | | 2/2000 | Flynn | |
| 6,248,048 | B1 | | 6/2001 | Zuckerman et al. | |
| 6,261,205 | B1 | * | 7/2001 | Elefson | 482/6 |
| 6,283,898 | B1 | * | 9/2001 | Polidi | 482/104 |
| 6,299,568 | B1 | | 10/2001 | Prok | |
| 6,379,287 | B1 | * | 4/2002 | Slawinski et al. | 482/104 |
| 6,443,877 | B1 | | 9/2002 | Hoecht et al. | |
| 6,450,927 | B1 | * | 9/2002 | Ellis | 482/94 |
| 6,482,135 | B1 | * | 11/2002 | Ish et al. | 482/97 |
| 6,579,213 | B1 | | 6/2003 | Webber et al. | |
| 6,592,498 | B1 | * | 7/2003 | Trainor | 482/97 |
| 6,811,521 | B1 | * | 11/2004 | Musso | 482/104 |
| 6,994,660 | B2 | * | 2/2006 | Ish et al. | 482/98 |
| 7,101,322 | B2 | * | 9/2006 | Carle | 482/97 |
| 7,226,400 | B1 | * | 6/2007 | Gedeon-Janvier | 482/104 |
| 7,374,516 | B2 | * | 5/2008 | Lundquist | 482/104 |
| 7,393,309 | B2 | * | 7/2008 | Webber | 482/104 |
| 2002/0091043 | A1 | * | 7/2002 | Rexach | 482/98 |
| 2007/0179030 | A1 | * | 8/2007 | Slawinski | 482/98 |

FOREIGN PATENT DOCUMENTS

| | | | | |
|---|---|---|---|---|
| DE | 4307632 | A1 | | 9/1993 |
| EP | 194220 | A1 | * | 9/1986 |
| FR | 2613237 | A1 | * | 10/1998 |
| GB | 2076299 | A | | 12/1981 |
| WO | WO 8901805 | A1 | * | 3/1989 |

OTHER PUBLICATIONS

Weider Smith Machine Includes 206 lbs of Weight, http://www.costco.com/Browse/Products.aspx?Prodid=11247784&whse=BC&Ne=4000000&eCat=BC|111|2268|4603&N=4000186&Mo−16&No=3&Nr=P_CatalogName:BC&cat=4603&Ns=P_Price|1||P_SignDescl&lang=en-US&Sp=C&hierPath=111*2268*4603*&topnav, 3 pages (printed Feb. 19, 2008).

* cited by examiner

COMPACT WEIGHTLIFTING FRAME SYSTEM

RELATED APPLICATION

This application is a continuation-in-part of application Ser. No. 09/715,242, filed Nov. 17, 2000, now U.S. Pat. No. 6,685,601. The prior application is incorporated herein by this reference.

BACKGROUND

This invention relates to weight lifting, and in particular, to a weightlifting system with safety cage that can be configured into a compact size when not in use, e.g., for storage.

Weight lifting continues to increase in popularity. Today, weight lifting attracts participants having varying ages, abilities and goals. Participants seek both the general health benefits and the sports-specific performance gains that can be achieved through a disciplined weight training program. Many participants belong to health clubs that typically have a wide array of weight lifting equipment. Others prefer to exercise in their homes, e.g., because of convenience, cost or schedule.

Although high quality and effective weight lifting equipment is available, such equipment is usually too large and too expensive for most people to use in their home. A typical equipment line usually includes at least several pieces, with each piece being specifically designed for performing a single exercise. Thus, outfitting a home with an adequate array of this equipment is usually too expensive and requires too much space.

Some exercise systems have an integrated apparatus such that a variety of different exercises can be performed, but the apparatus takes up less space than individual pieces dedicated to a single exercise. Some of these systems, including, e.g., Bowflex, BodySmith, and Hoist are marketed for home users. In such systems, the resistance used for exercises is usually provided by tension elements or stacked weight plates. Some users, however, prefer the additional benefits of exercising with free weights (i.e., traditional barbells and plates) because doing so improves coordination and balance, as well as strength and endurance.

In a club environment, a participant performing a potentially dangerous lift with free weights (such as, e.g., a bench press or military press) can often locate someone to serve as a spotter. Some clubs also have "safety cages" designed to prevent a loaded barbell from crushing the user in the event of a failed lift. These safety cages allow users to perform the exercises safely without the assistance of a spotter. The safety cages found in clubs, however, are rigid structures, and they cannot be adapted for use in a full array of exercises nor conveniently reconfigured in a compact position.

It would be advantageous to provide a full-featured weight lifting system having an integrated safety cage suitable for using free weights in a wide range of exercises, yet able to be configured in a compact position, e.g., for storage in the home.

SUMMARY

These and other advantages are provided by the compact weight lifting system of the present invention, which is also sometimes referred to as a frame system.

According to embodiments of the invention, the compact weight lifting system has a safety cage that can be reconfigured between at least compact (i.e., storage) and use positions. The safety cage has sides that are movable relative to a back or rear frame member of the safety cage, unlike conventional rigid safety cages.

To make the system compact, the sides are positioned closer to the rear frame member. To configure the safety cage for use, the sides are positioned to extend outward from the rear frame member, the sides and the rear frame member thereby defining an exercise space. In some embodiments, the sides can be spread outward (i.e., at an angle of more than 90 degrees relative to the rear frame member) or positioned at an angle of less than 90 degrees relative to the rear frame member.

The safety cage has elements, referred to below as "safety bars," that can be positioned to prevent a weight load from crushing the user in the event that the user fails to complete a planned lift. The safety cage also supports weighted barbells and extra weight plates when not in use.

In some embodiments, the sides are pivotably attached to opposite ends of the rear frame member such that they can be folded against each other when the system is configured in a compact position. In other embodiments, the sides telescope relative to the rear frame member. In still other embodiments, the sides fold and telescope.

Some embodiments of the system include integrated barbell guiding elements (i.e., Smith machine functionality) to assist a user in keeping a loaded barbell level.

The safety cage serves as an overall framework through which cables for supporting weight are routed and to which various accessories can be coupled. Such accessories include, but are not limited to, a cable operated carriage coupled to the safety cage, a weight lifting bench, a leg exercise attachment, barbell holders, a chin-up/pull-up bar, dip handles, foot holders (for sit-up exercises), etc.

In addition, the system can be fitted with various peripheral equipment to enhance the user's exercise experience, including, e.g., an audio system, an exercise computer and/or a beverage holder.

The system can be configured to use constrained plate-type weights instead of or in addition to free weights.

DETAILED DESCRIPTION

Figure 1:
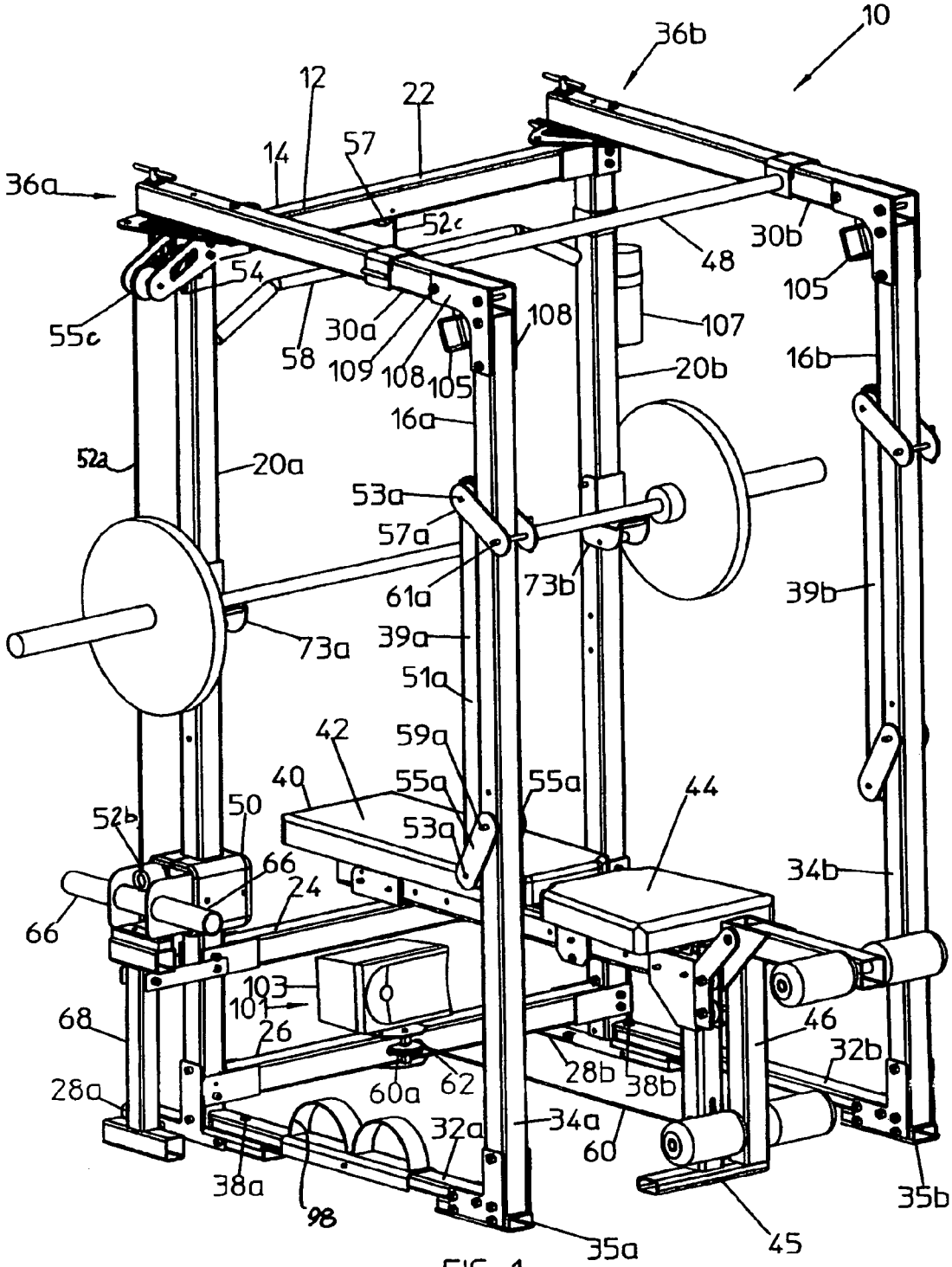
FIG. 1 is a perspective view of a compact weightlifting system with a safety cage having folding sides, showing a loaded barbell supported on a rear frame member, a bench in a horizontal position for use, e.g., in a bench press exercise, and various peripheral equipment.

The invention is a compact modular weight lifting system with which a user can safely perform a complete range of lifting exercises to provide a total body workout. In embodiments described below, the system includes a support structure or safety cage that can be easily reconfigured between at least a compact position and a use position.

The safety cage has elements, e.g., safety bars, that can be positioned to prevent a weight load from crushing the user in the event that the user tires during the exercise. The safety cage also supports weighted barbells and extra weight plates when not in use. The safety cage serves as an overall framework through which cables for supporting weight are routed and to which various accessories can be coupled.

The system can include a bench coupled to the safety cage or a bench configurable for use independent of the safety cage (i.e., a free standing bench) or a bench that is both coupleable and configurable for independent use. When not required, the bench can be stored or moved out of the way. The bench is segmented such that it can be configured in a range of positions, including a flat position (e.g., for bench press exercises), inclined positions (e.g., for inclined press exercises), and an erect position (i.e., like a chair back, for shoulder press or other upper body exercises).

To permit the safety cage to be configured in a compact position, the sides are (1) folding (i.e., pivotable coupled to the back), (2) in telescoping relation to the back, (3) folding and telescoping, or (4) readily removable (i.e., without the use of tools) from the back. Safety cages with each of these types of sides are described below.

According to one embodiment, the system has a folding safety cage in which the sides of the cage fold flat against each other for compact storage of the system.

According to another embodiment, the system has a safety cage with barbell guiding elements (i.e., similar to a Smith machine) for assisting the user in positioning and guiding a barbell during an exercise (e.g., overhead press, squat or lunge exercises), and supporting the barbell when the user tires or the barbell is not in use. With a Smith machine arrangement, opposite ends of a barbell are held by holders that are coupled together such that they translate along a guiding member and can be locked in place at desired positions. In the second embodiment, the horizontal members of the safety cage telescope for compact storage of the system. In this embodiment, the rear frame member can have a single upright member.

According to yet another embodiment, the system has a safety cage with a single rear upright member similar to the second embodiment, but the sides of the safety cage fold flat against each other for compact storage, similar to the first embodiment.

According to a further embodiment, the system has a safety cage with sides that pivot and telescope relative to the rear frame member.

According to a still further embodiment, the system has a safety cage with side frame members that are readily removable from the rear frame member, and the rear frame member has brackets for holding and locking the side frame members, e.g., when the safety cage is configured in a compact position for storage.

As illustrated, the various embodiments are shown with free weights (i.e., combinations of individual plates of standard weights), but constrained stacked-plate weights could be substituted.

Folding Safety Cage

As shown in FIGS. 1-7D, a compact weight lifting system 10 has a folding safety cage 12 with a rear frame member 14 and left and right side frame members 16*a*, 16*b*, respectively. The rear frame member 14 has a pair of rear uprights 20*a*, 20*b* that are connected to each other by upper, intermediate and lower lateral members 22, 24, 26, respectively. Each of the uprights 20*a*, 20*b* is supported by a respective foot 28*a*, 28*b*.

Pivoting Safety Cage Side Frame Members

The left and right side frame members 16*a*, 16*b* each have an upper lateral member 30*a*, 30*b*, a lower lateral member 32*a*, 32*b*, and a front upright 34*a*, 34*b* extending therebetween. Each lower lateral member 32*a*, 32*b* has an attached foot 35*a*, 35*b*, respectively, that is sized approximately the same height as the feet 28*a*, 28*b*.

The left and right side frame members 16*a*, 16*b* are each pivotably connected to the rear frame member 14. Specifically, the left side frame member 16*a* is pivotably connected to the rear frame member 14 at the upper lateral member 30*a* by an upper pivot 36*a*, and at the lower lateral member 32*a* by a lower pivot 38*a*. Similarly, the right side frame member 16*b* is pivotably connected to the rear side 14 at the upper lateral member 30*b* by an upper pivot 36*b*, and at the lower lateral member 32*b* by a lower pivot 38*b*.

Figure 4:
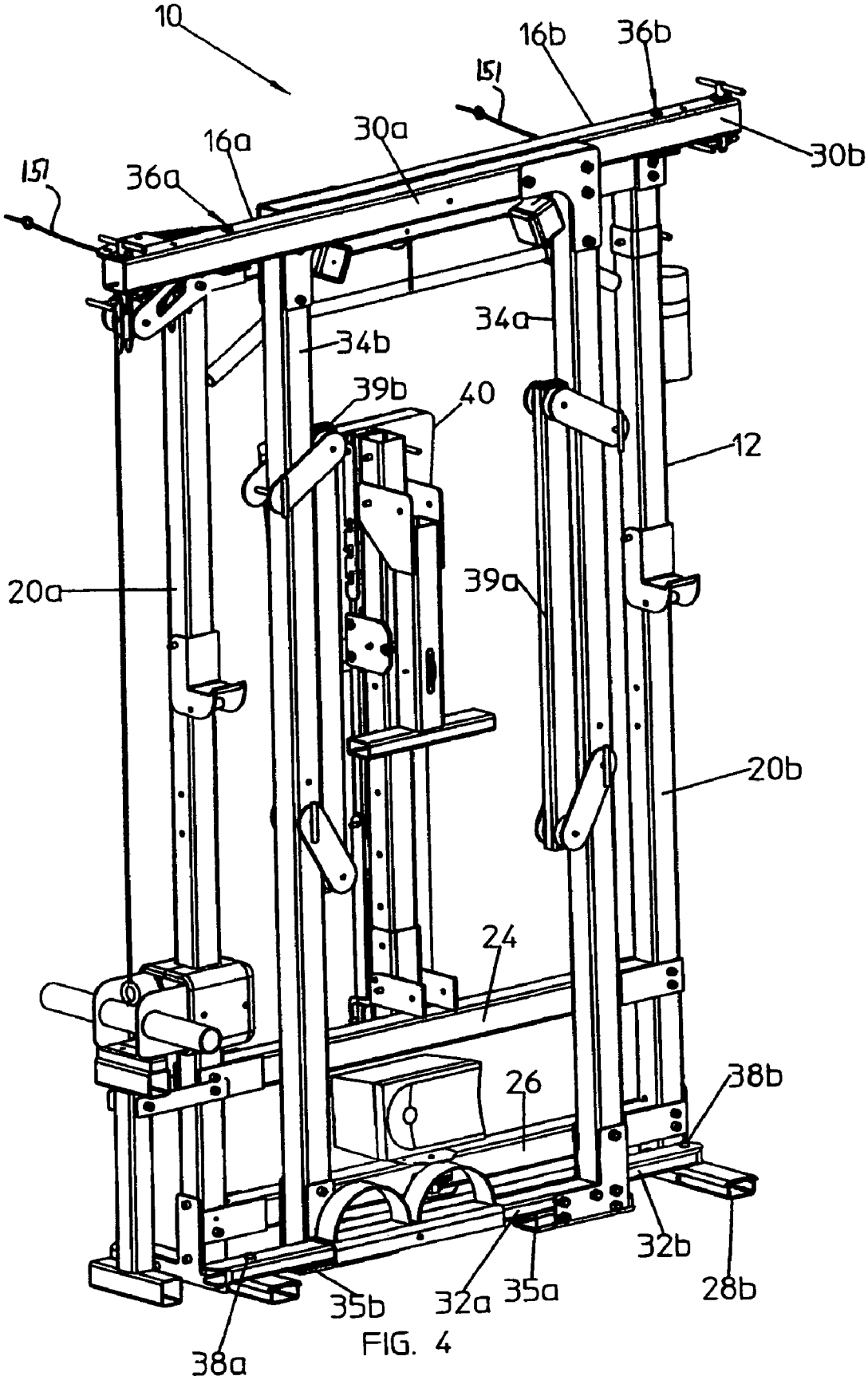
FIG. 4 is a perspective view showing the compact weight lifting system of FIG. 1 in a compact position suitable for storage with a right side frame member folded against the rear frame member and a left side frame member folded against the right side frame member.

As shown in FIG. 4, the pivots 36*a*, 36*b* and 38*a*, 38*b* allow the right side frame member 16*b* to be pivoted into contact with (i.e., "folded flat against") the rear frame member side 14, and the left side frame member 16*a* to be folded flat against the right side 16*b*. Thus, the left side pivots 36*a* and 38*a* are spaced farther from the rear upright 20*a* than the right side pivots 36*b* and 38*b* are spaced from the upright 20*b*. This is referred to below as the "offset pivot arrangement."

Figure 2:
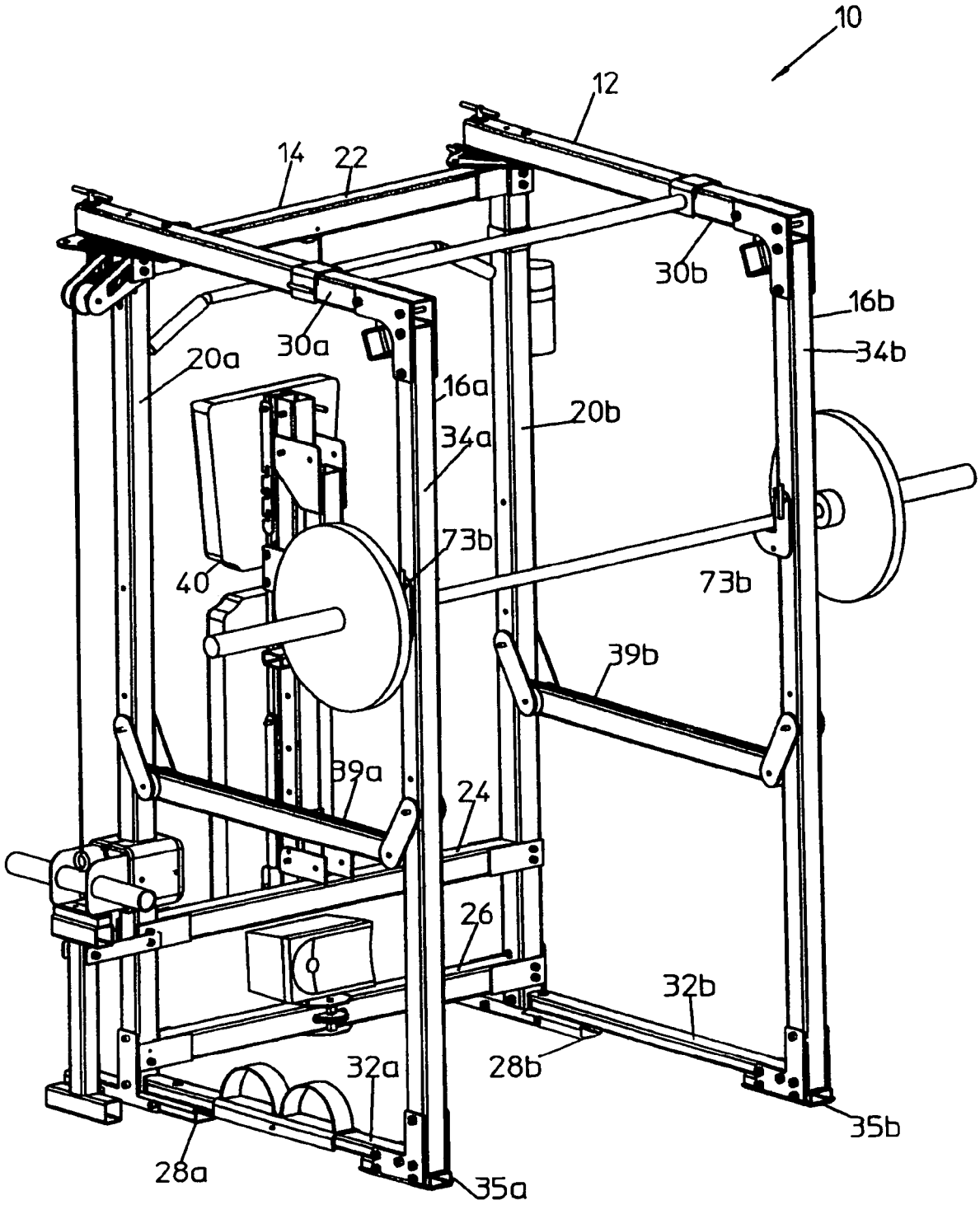
FIG. 2 is a perspective view similar to FIG. 1, except the bench is positioned in an upright position and the barbell is supported on front upright members of respective sides or side frame members of the safety cage.
Figure 3:
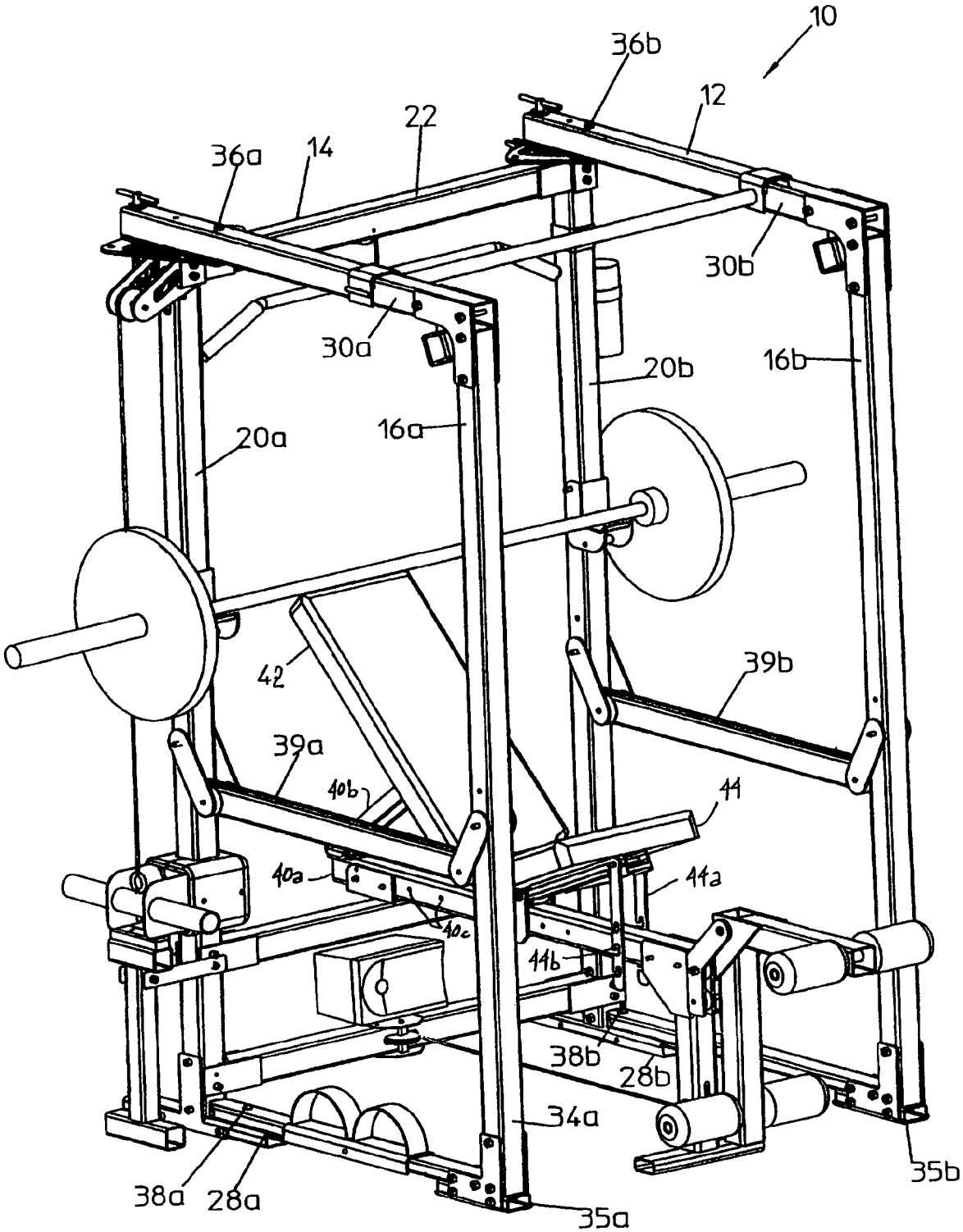
FIG. 3 is a perspective view similar to FIG. 1, except the safety bars coupled to each of the side frame members are shown in a horizontal position, e.g., to protect a user from the weight of the barbell in a failed bench press attempt, and the bench rear and front portions are inclined.
Figure 5A:
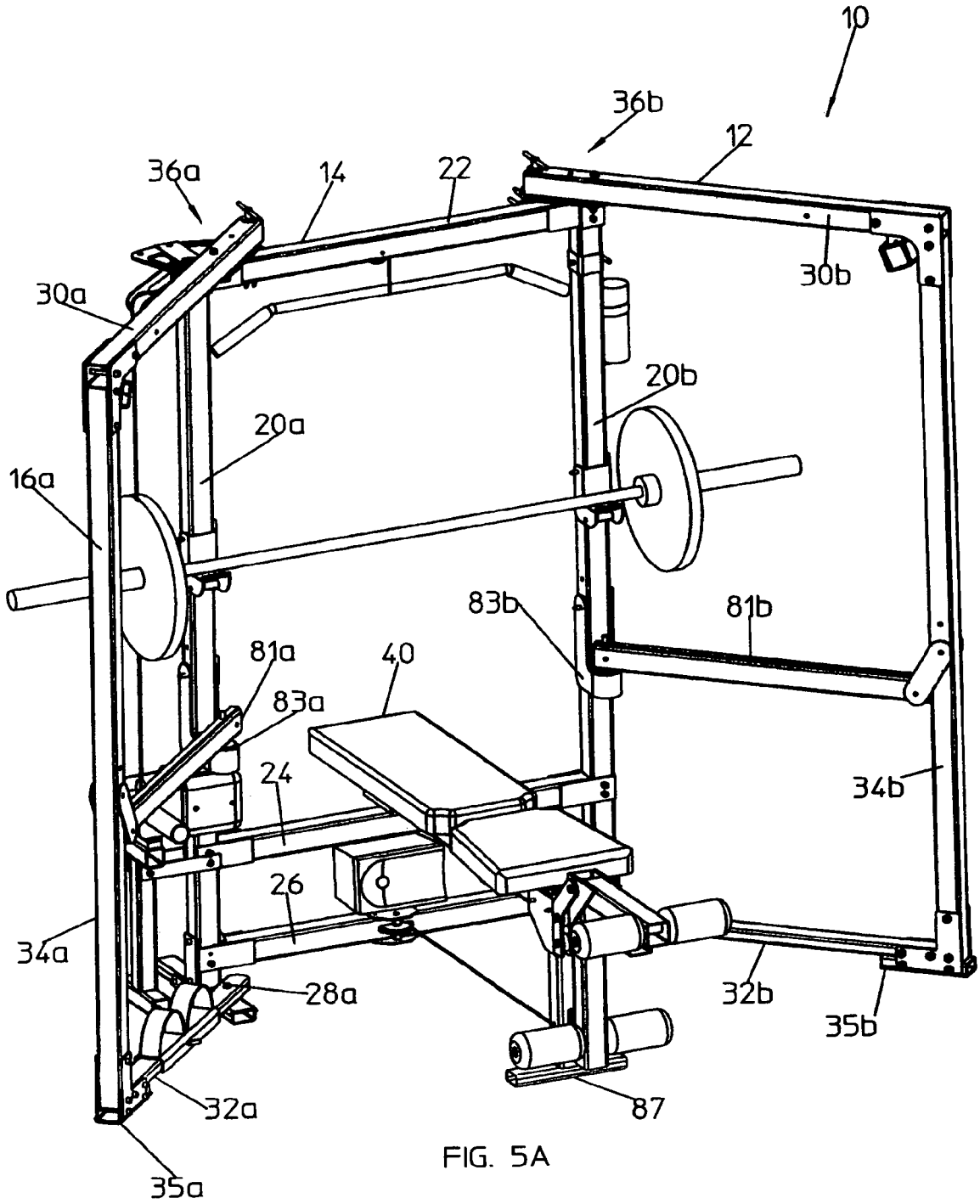
FIG. 5A is a perspective view similar to FIG. 1, except that a modified safety bar is shown in the horizontal position and the right and left side frame members are shown without a chin-up bar and in a spread apart configuration, e.g., to provide increased space for performing exercises such as sit-ups within the safety cage.
Figure 5B:
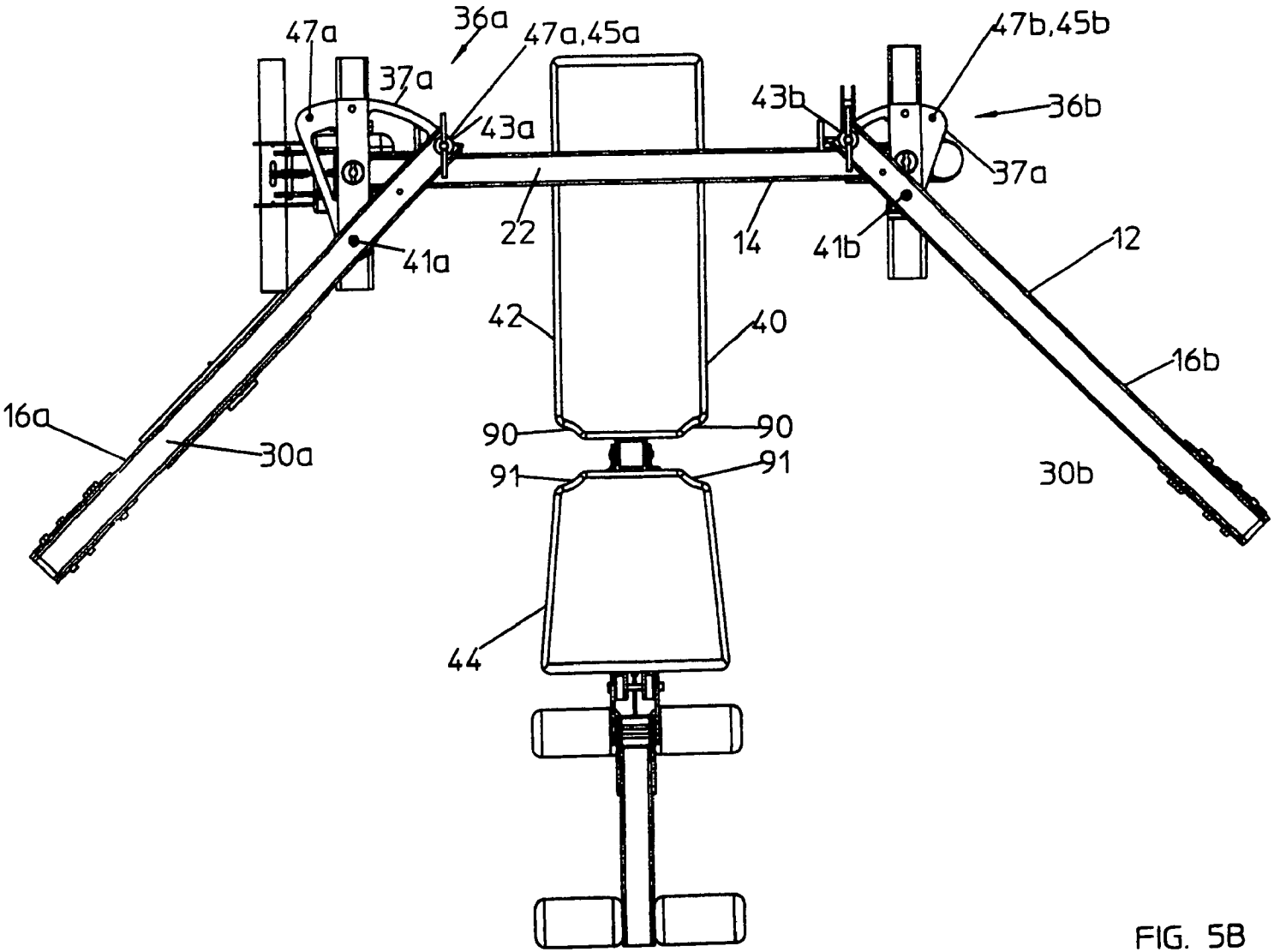
FIG. 5B is a plan view of the compact weight lifting system of FIG. 5A.
Figure 6A:
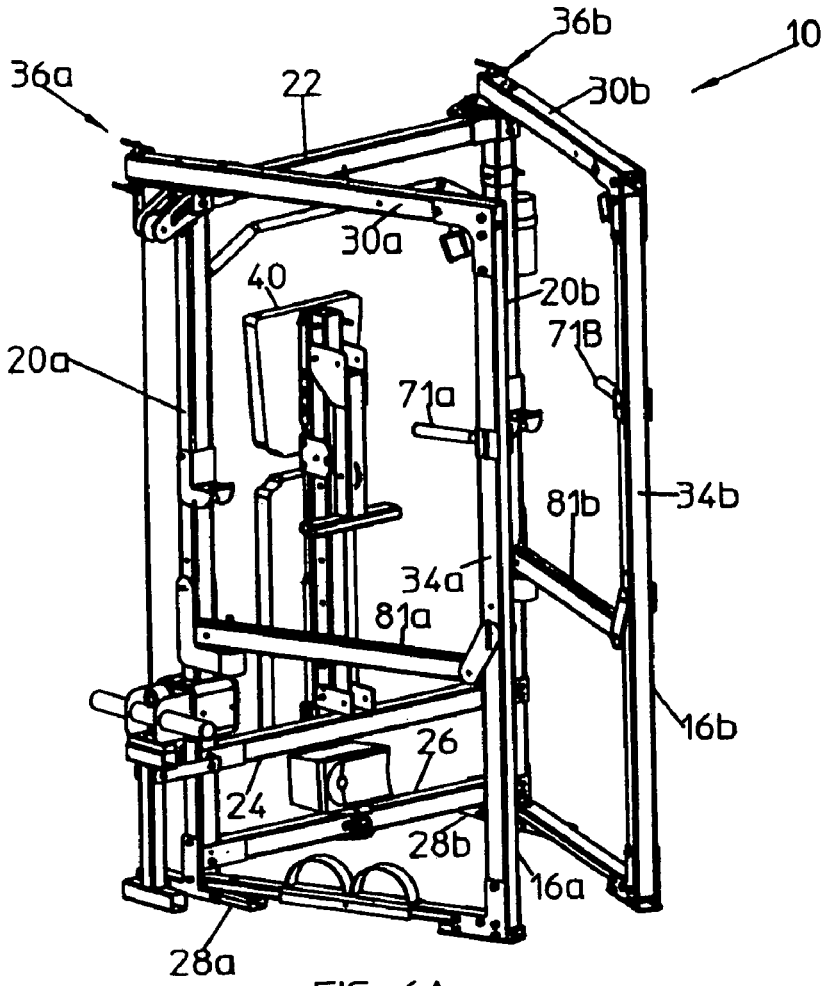
FIG. 6A is a simplified perspective view similar to FIG. 1, except showing the side frame members angled inwardly and with dip exercise hand grips attached to the front upright members.

The left and right side frame members 16*a* and 16*b* can be pivoted through a range of positions with respect to the rear frame member 14. As shown in FIGS. 1-3, the side frame members 16*a* and 16*b* can be pivoted to a normal position approximately perpendicular to the rear frame member 14. As shown in FIGS. 5A and 5B, the side frame members 16*a* and 16*b* can be pivoted to a "spread outward" position, e.g., to provide more room within the safety cage 12. As shown in FIGS. 6A and B, the side frame members 16*a* and 16*b* can be pivoted inwardly to a "wedged" position, as may be desired for certain exercises.

Figure 7B:
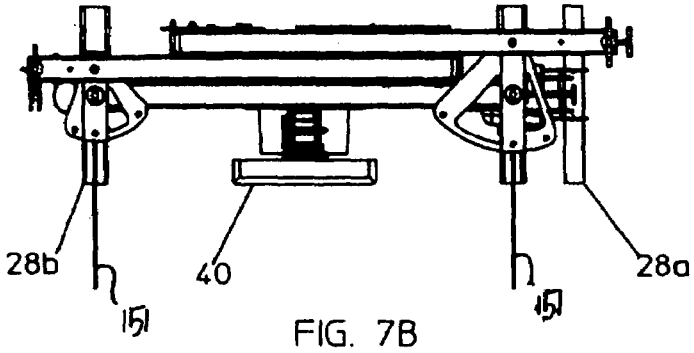
FIGS. 7A, 7B and 7C are rear side, plan and right side views, respectively, of the compact weight lifting system in a compact position, similar to FIG. 4.
Figure 7A:
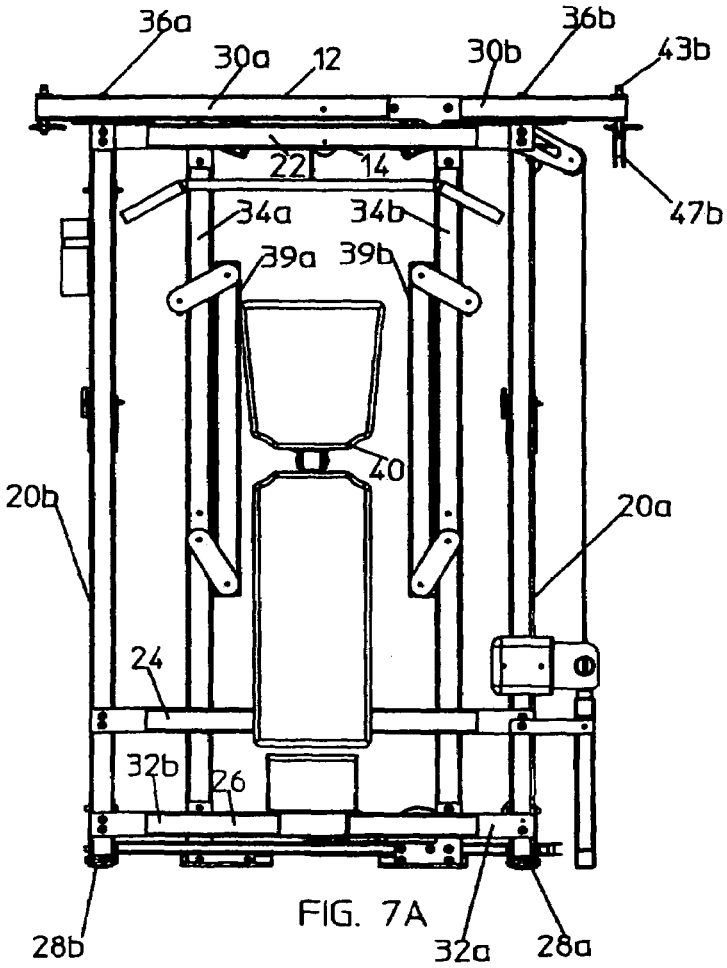
Figure 7C:
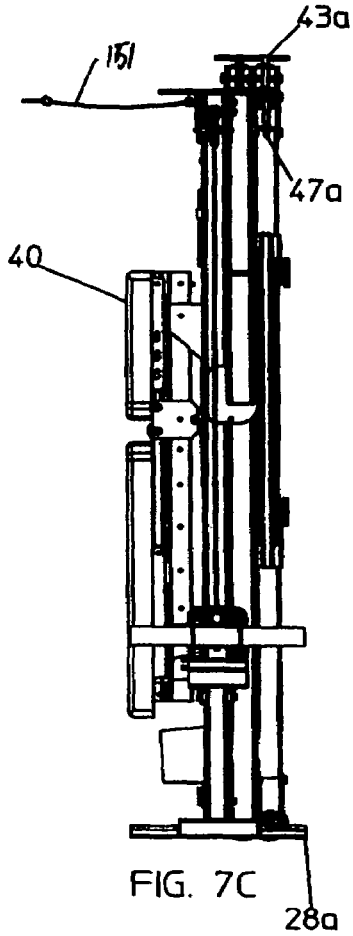

FIGS. 7A, 7B and 7C are respective rear side, plan and right side views showing the system 10 in a compact position. In one particular implementation, the footprint of the system in the compact position is about 18 inches by about 45 inches (and about 18 inches by about 55 inches with the vertical slider of FIG. 1). For safety and/or convenience, the side frame members can be pinned or cabled to a fixed surface such as a wall or otherwise locked in place when the system 10 is in a compact position (using, e.g., the pivot pins, other pins or any other suitable device).

A specific implementation of the upper left side pivot 36*a* with a locking feature is described with reference to FIG. 5B. The upper left side pivot 36*a* includes a pivot plate 37*a* with a series of pivot plate holes 47*a*, a pivot pin 41*a* and a locking pin 43*a*. The pivot plate 37*a* is fixed to the rear frame member 14 at the junction of the rear upright 20*a* and the upper lateral member 22. The locking pin 43*a* is sized to extend through an anchor hole 45*a* near the end of the upper lateral member 30*a* and an aligned one of the pivot plate holes 47*a* in the pivot plate 37*a* that corresponds to a desired angle (e.g., about 135 degrees as shown in FIG. 5A) of the left side frame member 16*a*. A camming fastener 49*a* (see FIGS. 5C and 5D) is positioned over a lower end of the locking pin 43*a* and urged to a closed position to secure the upper lateral member 30*a* and the pivot plate 37*a* together, thereby holding the left side frame member 16*a* in the desired position.

The upper right side pivot 36*b* is similar to the upper left side pivot 36*a*, except the pivot plate 37*b* is smaller because the pivot pin 41*b* is spaced closer to the anchor hole 45*b* to produce the offset pivot arrangement described above. It is also possible to configure the safety cage system 10 to pivot freely, thus avoiding the need to include the locking pivots 36*a*, 36*b*.

The lower pivots 38*a*, 38*b* each have a pivot pin that is aligned in the vertical direction with the respective one of the upper pivot pins 41*a*, 41*b*.

Pivoting Safety Bars

The left and right side frame members 16*a*, 16*b* of the safety cage 12 also include respective safety bars 39*a*, 39*b*. The safety bars 39*a*, 39*b* are removably connected to the front uprights 34*a*, 34*b* and the rear uprights 20*a*, 20*b*, respectively, such that they are suspended horizontally at various positions, e.g., as shown in FIGS. 2 and 3. The safety bars 39*a*, 39*b* prevent a loaded barbell 99 from crushing a user, e.g., during a squat exercise (FIG. 2) or a bench press exercise (FIG. 3). Although not illustrated, it may be desirable in some applications to arrange the safety bars such that one or both of them are angled (either the same angle or different angles).

The safety bars 39*a*, 39*b* can be pivoted from a horizontal position and secured in an upright position, as shown in FIG. 1. Referring to the left safety bar 39*a* according to the illustrated implementation, a lateral member 51*a* is pivotably attached by pins 53*a* to first flanges 55*a* and second flanges 57*a*. The first flanges 55*a* are positioned to straddle opposite sides of the upright 34*a*, and are pivotably secured by a pin 59*a* extending through holes in the first flanges 55*a* and the upright 34*a*. The second flanges are positioned to straddle the upright 34*a* at a higher position, and such that the shaft of a pin 61*a* passes through holes in the second flanges and contacts a side of the upright 43*a* as shown. The user can remove the pins and adjust the positions of the safety bars while he is within the safety cage 12.

One common type of conventional safety bars is rods that are inserted through aligned holes in the front and rear upright for each side. The position of such a rod cannot be changed from within the safety cage, e.g., during an exercise. Rather, the user must leave the safety cage and face the front upright to withdraw the rod and reinsert it in a different set of holes.

As shown in FIG. 5A, a safety bar 81*a*, 81*b* is particularly suited for use in applications where the side frame members 16*a*, 16*b* are pivoted at angles of other than 90 degrees with respect to the rear frame member 14. The end of the safety bar 81*b* that connects with the front upright 34*b* is the same as described above for the safety bar 39*b*. The other end of the safety bar 81*b*, however, is pivotably connected to a safety bar receiver 83*b*. Essentially, the safety bar 81*b* has a hole that can be positioned over a post on the receiver 83*b*. The safety bar 81*b* can then pivot with respect to the receiver 83*b* as the side 16*b* is pivoted inwardly or outwardly from the perpendicular position. (By comparison, the safety bar 39*b* can pivot with the side 16*b* through only a limited angular range.) The receiver 83*b* can be positioned at different vertical positions on the rear upright 20*b*.

Bench Pivotably Attached to Safety Cage

As indicated above, the safety cage 12 also serves as a framework to which other components are coupled. For example, a bench 40 can be pivotably connected to the intermediate lateral member 24 of the rear side 14. The bench 40 is hinged such that the rear back portion 42 can pivot upwardly relative to horizontal. A front seat portion of the bench 40 is supported by a pivoting bench foot 87. As shown in FIG. 1, a leg lift attachment 46 can be connected to the bench, if desired.

As shown, e.g., in FIG. 2, the bench 40 can be pivoted upward and secured within the space between the uprights 20*a*, 20*b*, with the bench foot 87 pivoting flat against a rear surface of the bench, for performing exercises within the safety cage 12 that do not require a bench or for storage. Further details of the bench construction are described below.

Specifically, with reference to FIG. 3, the bench 40 includes a main frame member 40*a* that supports the back portion 42 and the seat portion 44, as well as a support member 40*b* pivotably coupled to the back portion 42 and to the main frame member 40*a* (partially obscured by the safety bar 39*a*). As best shown in FIG. 3, the seat portion 44 is slidingly translatable relative to the main frame member 40*a* to a desired position (note the series of spaced apertures 40*c* shown along the length of the main frame member 40*a*). As can be seen by comparison between, e.g., FIG. 1 and FIG. 3, sliding the seat portion 44 relative to the main frame member 40*a* changes an inclination of the back portion 42 relative to the seat portion 42. In the illustrated implementation, the seat portion 44 can also be inclined relative to the main frame member 40*a*, in this case by repositioning a seat support member 44*a* relative to a support pin 44*b*.

Carriage Configured to Travel Along Safety Cage Upright

The system 10 also includes a cable supported rolling weight arrangement. Referring to FIG. 1, a carriage 50 is mounted to slidingly move in a vertical direction along the rear upright 20*a*. Thus, the carriage 50 travels along one of the structural members of the safety cage 12.

Figure 7D:
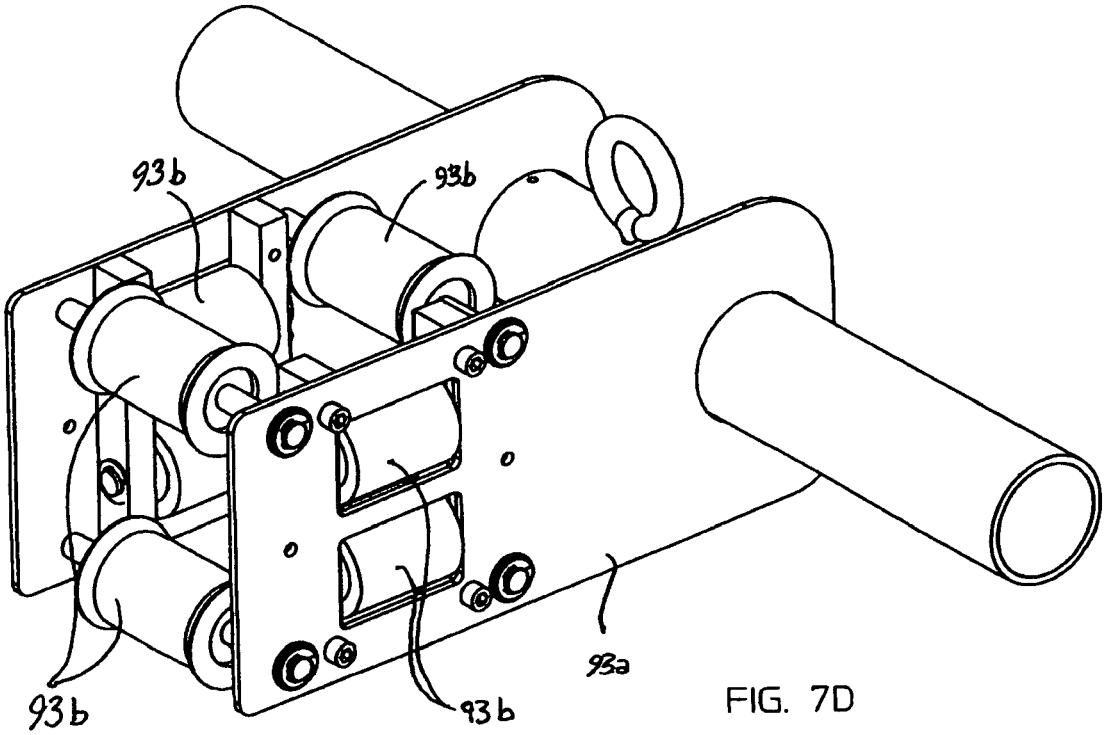
FIG. 7D is an enlarged perspective view of a carriage shown in FIG. 1, with the exterior shrouds removed for clarity.

As shown in FIG. 7D, the carriage 50 has a frame 93*a* defining an approximately square opening sized slightly larger than the rear upright 20*a*. The frame 93*a* is fitted with wheels 93*b* on each of its four sides that contact the upright 20*a* so that the carriage rolls smoothly along the upright 20*a* as it translates.

The carriage 50 is attached to a first end 52*b* of a cable 52*a*, with the second end 52*c* being routed over a first pulley 55*c*, through an opening 54 near the upper end of the upright 20*a*, through the upper lateral member 22, over a second pulley 57, and out through an opening in the lower surface of the lateral member 22 approximately midway between the uprights 20*a*, 20*b*. The second end 52*c* can be connected to an accessory, e.g., a lat bar 58. The pulley 57 may be mounted at least partially inside the upright 20*a*.

In operation, the user grasps each end of the lat bar 58 and sits on the bench 40. The user then pulls the lat bar 58 toward himself, thus moving the carriage 50 upward along the upright 20*a* against the weight carried by the carriage 50 and any resistance exerted by the cable and pulleys.

Another cable 60 extends from an opening 62 in the lower lateral member approximately midway between the uprights 20*a* and 20*b* and around a pulley 60*a*. A portion of the cable 60 (concealed in the drawing) extends from the pulley through the lower lateral member 26, over one or more additional pulleys (including one near the opening 54 that is partially visible in FIG. 1), and through the upright 20*a*. The cable 60 is of sufficient length to allow its end to be drawn out of the upright 20*a* and attached to the carriage 50. When the cable 60 is not in use, this first end is stored on a projection (not shown) within the upper lateral member 22 near the opening 54. In use, with the first end of the cable 60 attached to the carriage 50, the other end is attached to an accessory, such as the leg lift attachment 46 as shown in FIG. 1.

The carriage 50 has a plate receiving bar 66 on which one or more weight plates can be added according to the particular exercise being performed. When the carriage 50 is not in use, it rests on a carriage rest 68.

Figure 30:
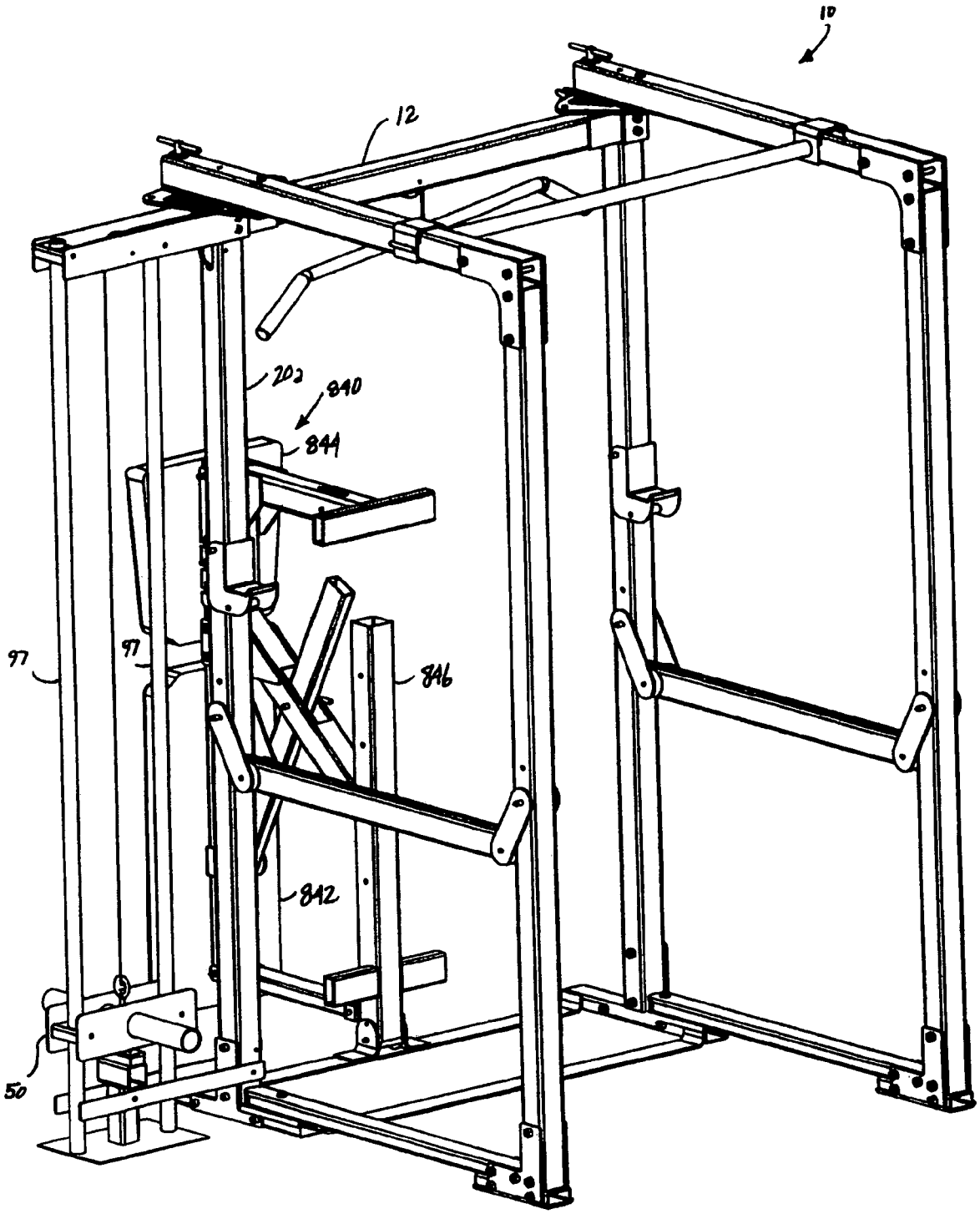
FIG. 30 is a perspective view similar to FIG. 1, except that the modified bench is shown in a rotated position and an offset vertical carriage is shown secured in place to the safety cage.

In an alternative arrangement as shown in FIG. 30, the carriage 50 travels along separate upright rods 97 that are secured to the safety cage 12, rather than the upright 20*a*.

A multi-position carriage system 748 is described below in connection with FIGS. 28A-30.

Alternative Smith Machine Safety Cage with Folding Sides

Figure 12A:
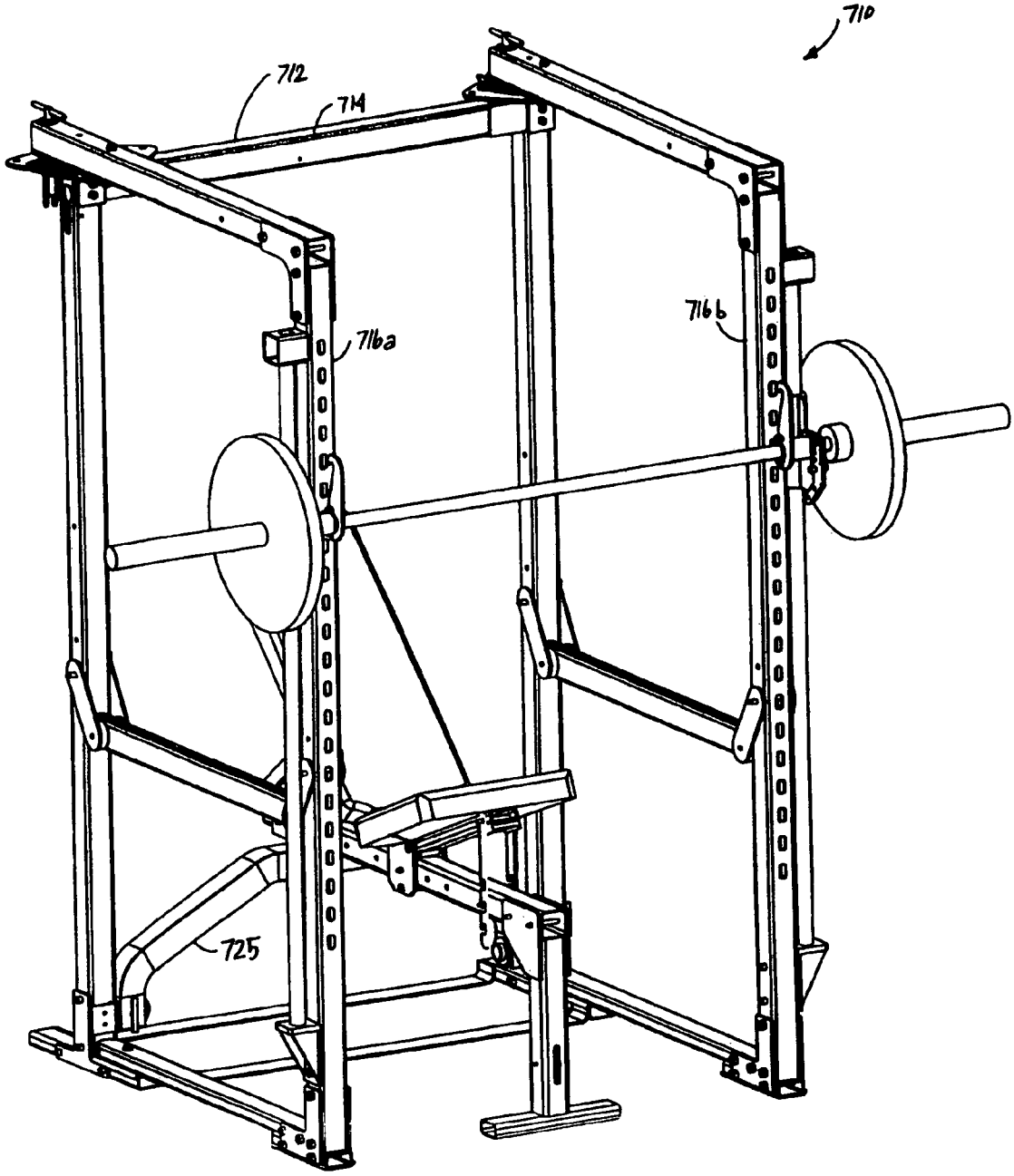
FIGS. 12A and 12B are perspective views of another safety cage system having Smith machine functionality in which the side frame members can be folded.
Figure 12B:
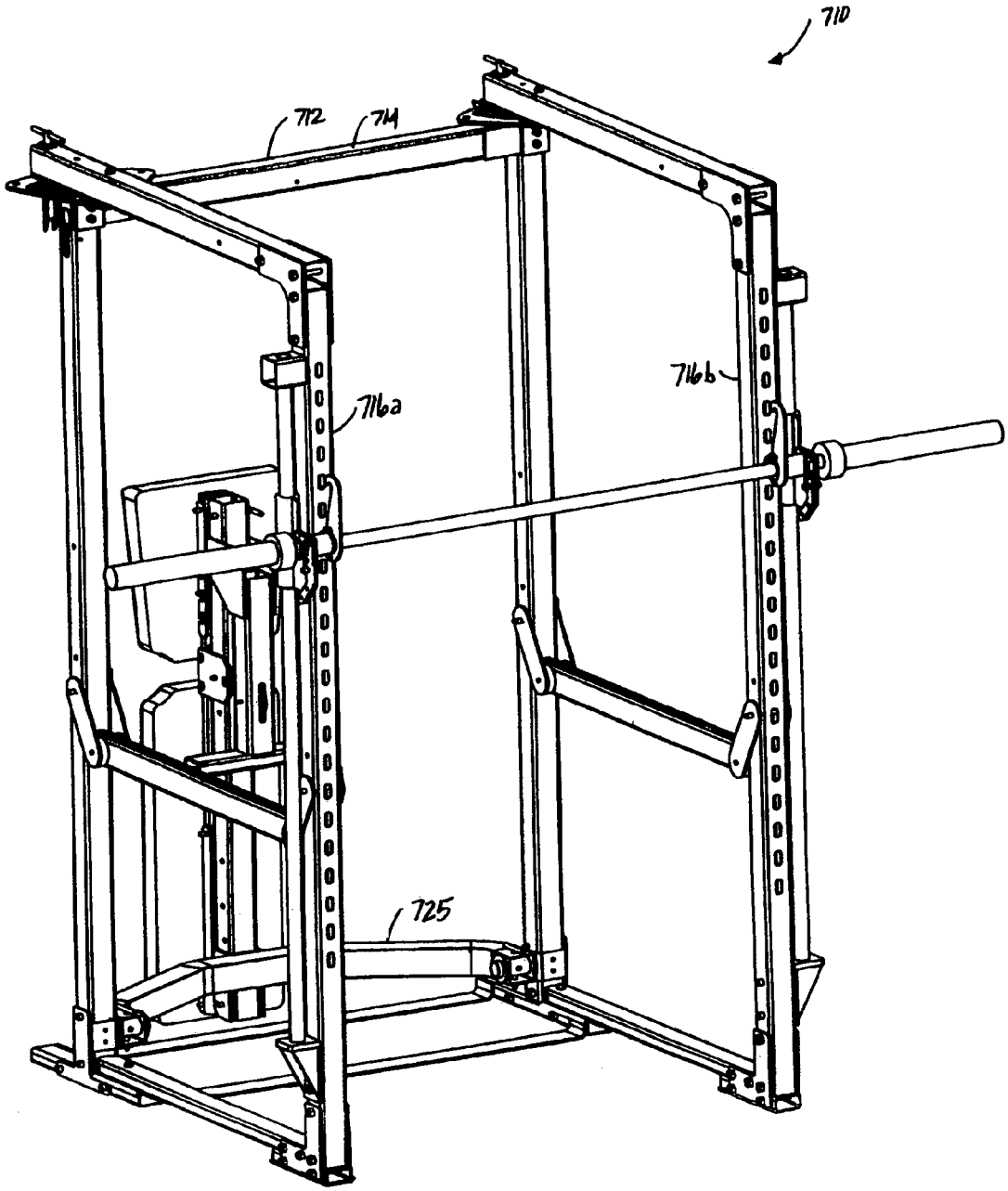
Figure 12C:
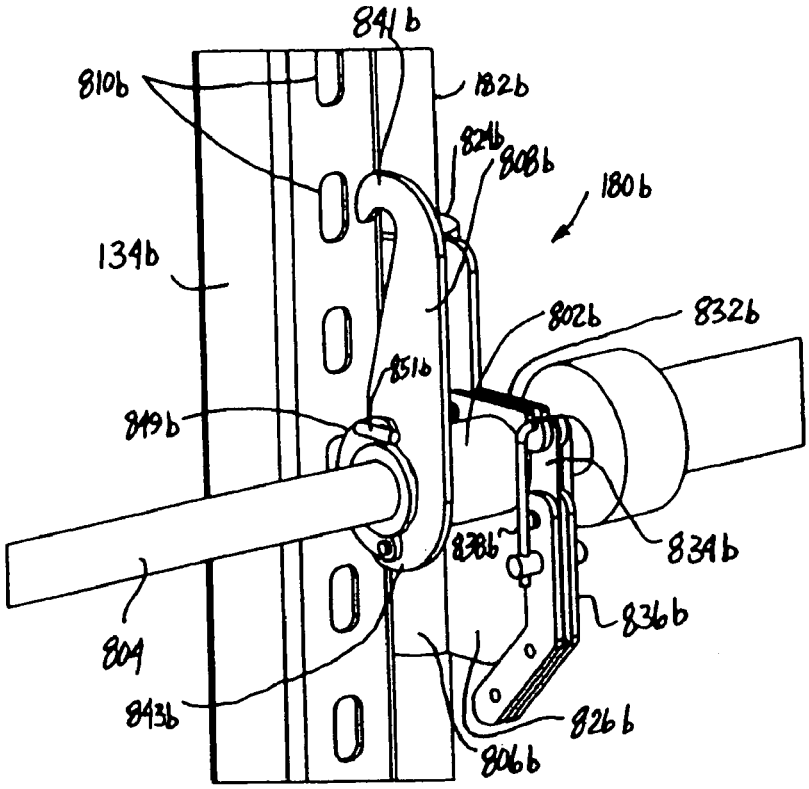
FIGS. 12C-12G are perspective detail views showing barbell holders suitable for systems with Smith machine functionality.
Figure 12D:
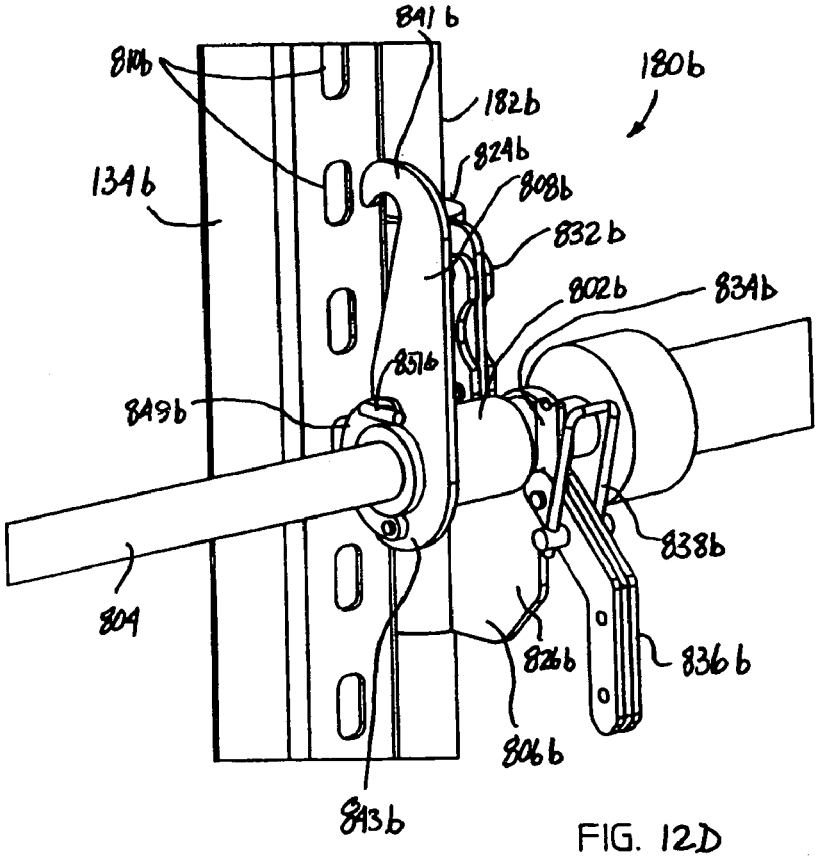

As shown in FIGS. 12A and 12B, a safety cage system 710 has front uprights fitted with a Smith machine mechanism and folding safety side frame members, similar to the system 210 of FIGS. 10, 11A, 11B and 13.

Because the barbell is releasably secured, it can be easily removed to allow use of the system 710 for other exercises or to pivot the side frame members for storage. Except for the added Smith machine functionality, the system 710 is similar in construction and operation to the system 10 having the offset pivot arrangement described above.

The system 710 as shown in FIGS. 12A and 12B is also fitted with a wishbone-shaped rear lateral member 725 that replaces the intermediate and lower lateral members 24, 26. With the bench 740 rotated to an upright position as shown in FIG. 12B and the lateral member 725 pivoted to an approximately horizontal position (approximately parallel to the floor), more space is available within the safety cage 712 than with the embodiments with the lateral members 24, 26. Also, the attached bench can be set in alternative positions by pivoting the lateral member 725 into a horizontal position. The lateral member 725 can, of course, be used with other embodiments.

Smith Machine Safety Cage with Telescoping Horizontal Members

A system 110 has a safety cage 112 that telescopes (as opposed to folding) to provide a compact footprint for easy storage, and the front uprights of the safety cage 112 are fitted with a Smith machine mechanism.

Figure 8:
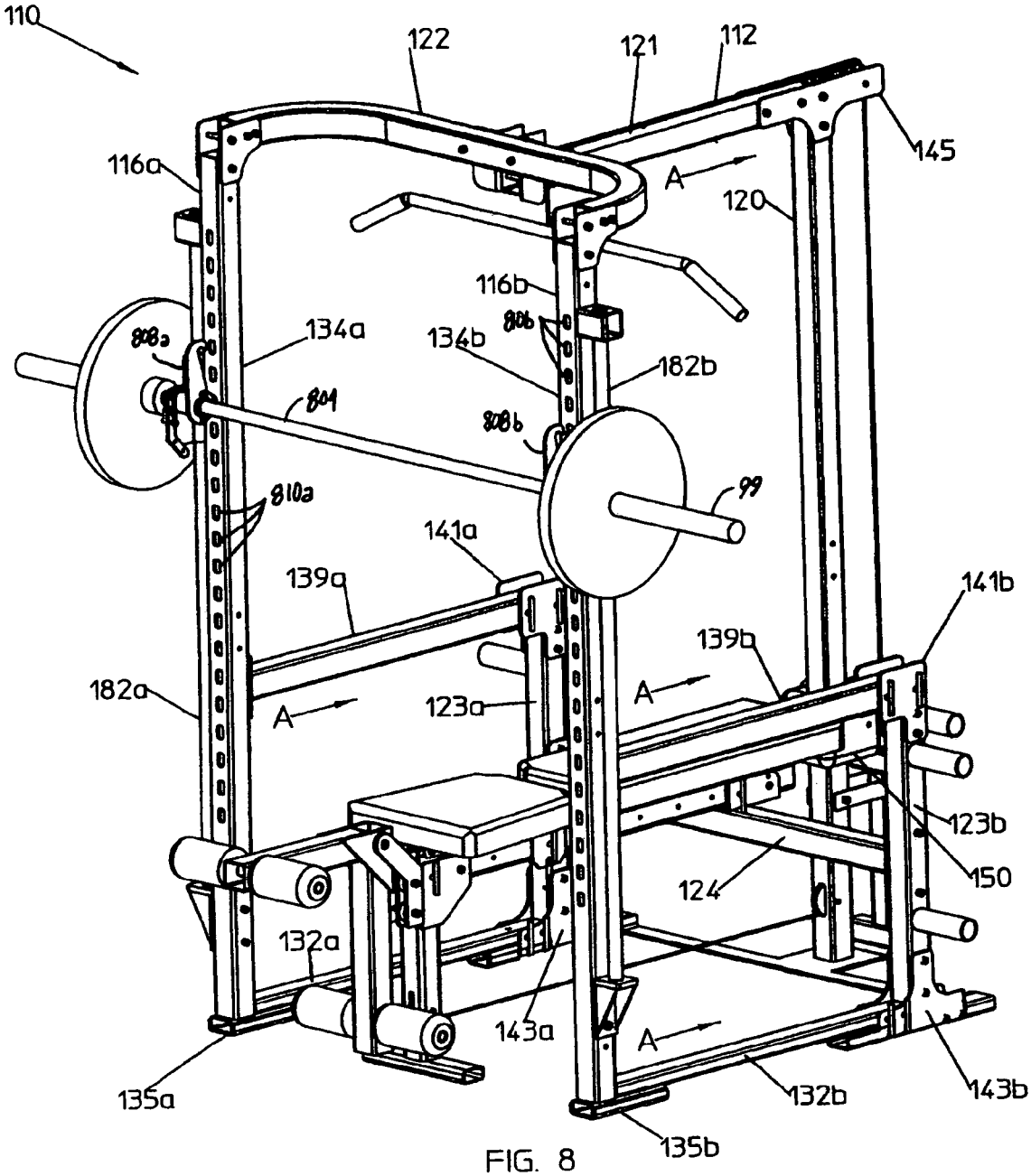
FIG. 8 is a perspective view of another system with Smith machine functionality and a safety cage that has a single rear upright frame member and telescopes into a compact position for storage.
Figure 9:
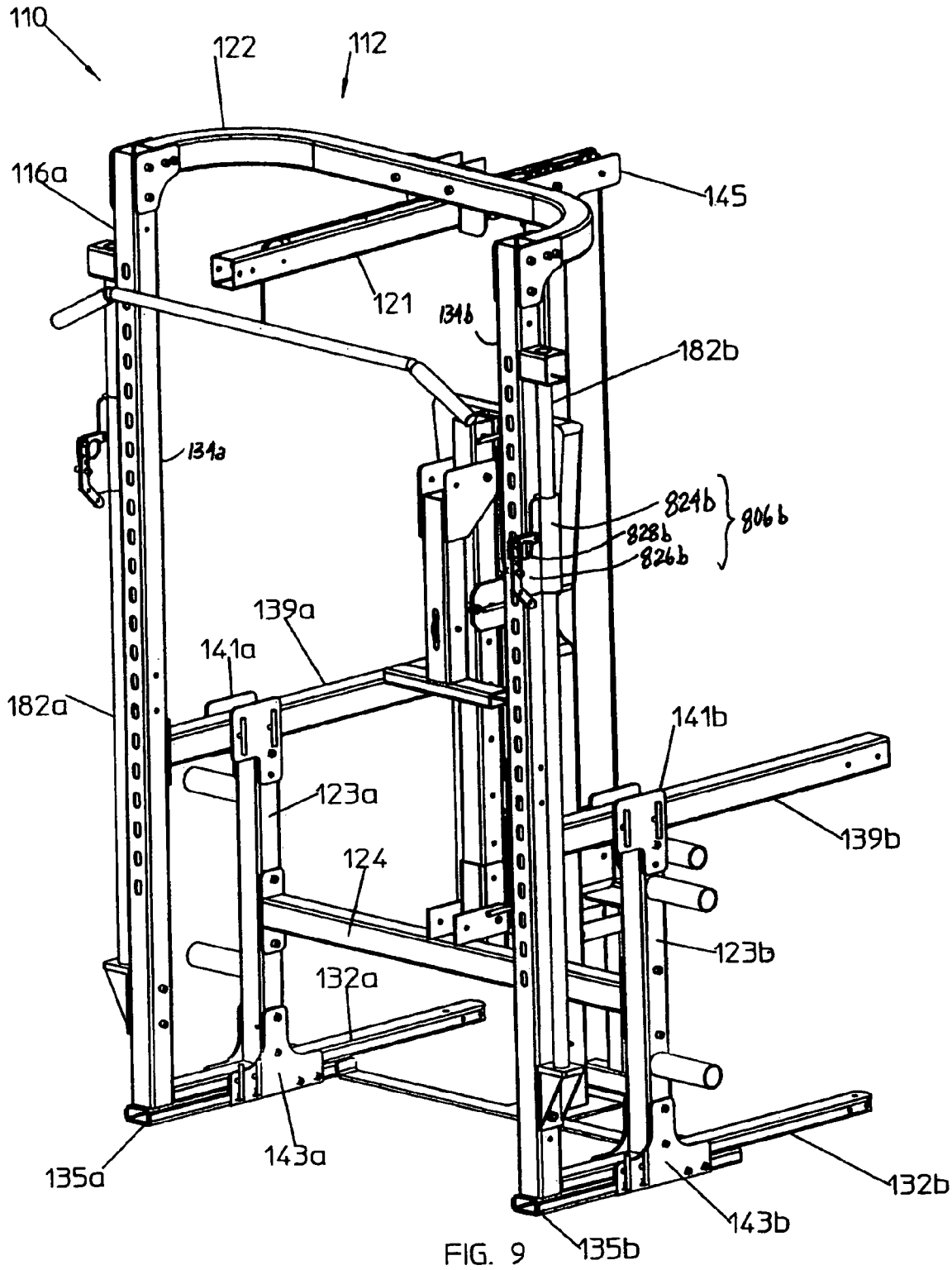
FIG. 9 is a perspective similar to FIG. 8, except showing the safety cage in a compact position with the front upright members positioned closer to the rear upright members.

As shown in FIGS. 8 and 9, the safety cage 112 has a single rear upright 120 joined to a upper lateral member 121, which is joined to a curved upper lateral member 122. The sides 116*a* and 116*b* are fixed to a rear portion of the safety cage 112 and thus do not pivot in the horizontal plane. As in the case of the first embodiment, the system 110 includes a carriage 150 slidingly coupled to a frame member, i.e., the rear upright 120.

Horizontal Members of Safety Cage Telescope for Storage

The front uprights 134*a* and 134*b* join the ends of the curved upper lateral member 122. At the bottom, the uprights 134*a*, 134*b* are joined to telescoping lower lateral members 132*a*, 132*b*. Uprights 123*a*, 123*b* extend from positions rearward of the front uprights 134*a*, 134*b*, and are joined together by a rear lateral member 124. The front uprights 134*a*, 134*b* are joined to the uprights 123*a*, 123*b* by respective telescoping safety bars 139*a*, 139*b*. For storage, the safety cage 112 is slid horizontally by pushing the front uprights 134*a*, 134*b* in the direction A from the position shown in FIG. 8, with the members 139*a*, 139*b*, 132*a*, 132*b* telescoping through respective joints 141*a*, 141*b*, 143*a*, and 143*b*. In the same motion, the curved upper lateral member 122 also slides over the upper lateral member 121. As a result, the safety cage becomes configured for storage as shown in FIG. 9.

Barbell is Releasably Held in Smith Machine-Type Barbell Holders

According to the Smith machine functionality of the system 110, barbell holders 180*a*, 180*b* are slidably movable along respective rods 182*a*, 182*b* attached to the uprights 116*a*, 116*b*, respectively. The barbell holders 180*a*, 180*b* (1) support the weight of the barbell 99, (2) keep the barbell 99 level during movement, and (3) can be selectively locked in place at a desired height along the rods 182*a*, 182*b*. In contrast to conventional Smith machine arrangements, the barbell holders 180*a*, 182*b* releasably hold the barbell 99, such that the barbell 99 can be removed and used freely.

Figure 31:
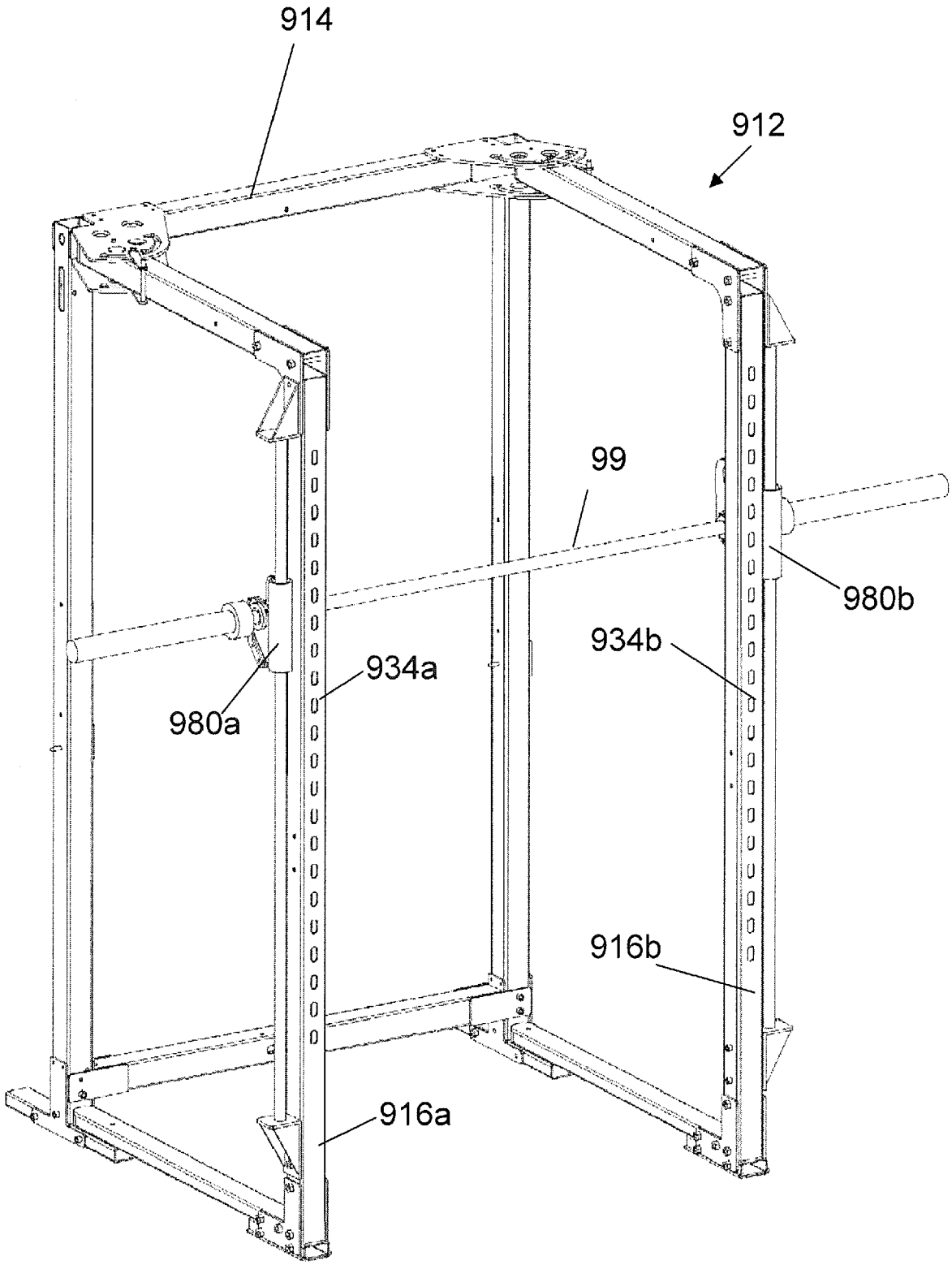
FIGS. 31-33 show a system with Smith machine functionality in which the barbell is positioned on an inner side of the side frame members.
Figure 32:
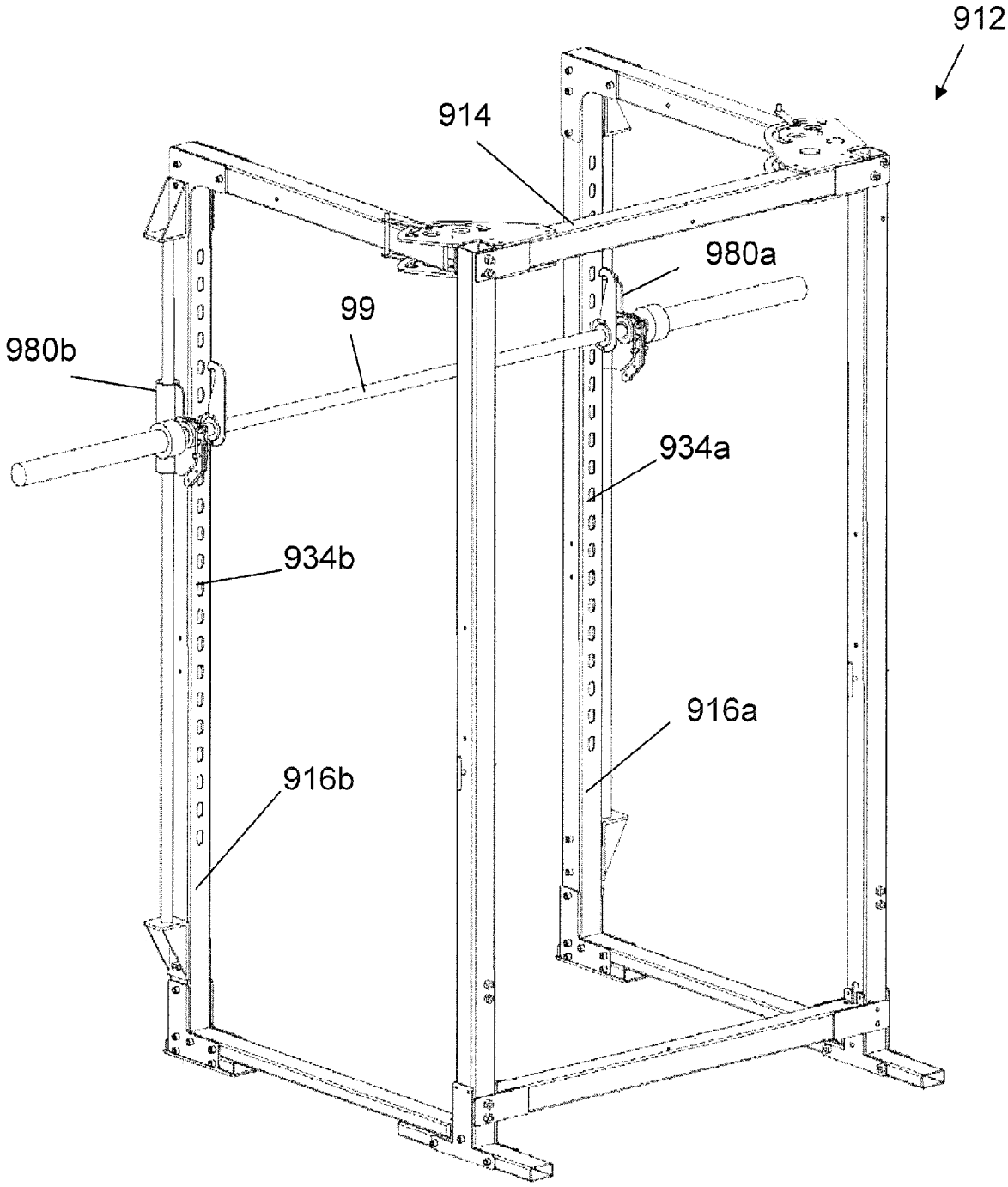
Figure 33:
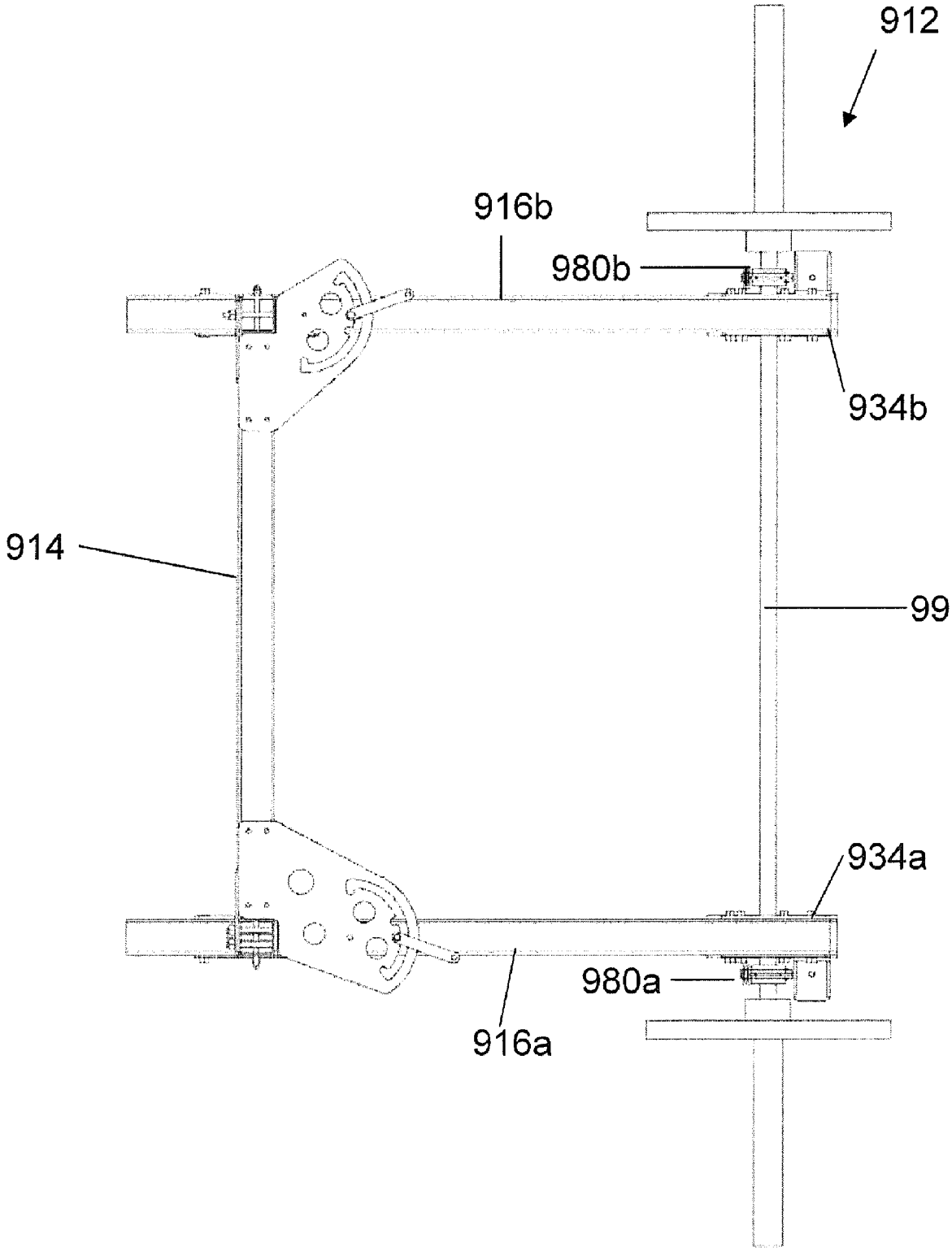

As another benefit, the releasable bar holders 180*a*, 180*b* can be repositioned to travel along and selectively engage an inner side of appropriately configured uprights 134*a*, 134*b* (i.e., directly opposite the side shown in FIG. 8), thus moving the position of the supported barbell within the safety cage 112. To provide this benefit, the uprights 134*a*, 134*b* can be provided with two sets of openings (i.e., in the outer side as shown and in the hidden inner side). FIGS. 31-33 show the holders 980*a*, 980*b* configured for travel along an inner side of the uprights 934*a*, 934*b*.

A specific implementation of the barbell holders 180*a*, 180*b* is described in connection with FIGS. 8 and 12C-12G. The left barbell holder 180*a* is similar to the right barbell holder 180*b*, which is described in detail.

The barbell holder 180*b* is an assembly of three main components: (1) a bearing 802*b* mounted on the left end of a shaft 804 of the barbell 99; (2) a holding member 806*b*, which is shaped to receive and secure the bearing 802*b*, that holds the loaded barbell 99 and is constrained to move in the direction of the rod 182*b*; and (3) a hook 808*b* attached to an inboard end of the bearing 802*b* that rotates with the shaft 804 into engagement with a selected one of the series of spaced holes 810*b* formed in the outer surface of the upright 134*b*.

In use, from a position as shown in FIG. 8, the user grabs the shaft 804 with both hands between the hooks 808*a*, 808*b*, lifts the barbell slightly to disengage the hooks 808*a*, 808*b* from the engaged holes 810*a*, 810*b*, and rotates the shaft 804 slightly, thus keeping the hooks 808*a*, 808*b* disengaged. With the shaft 804 in this position, the user performs repetitions of a lift by raising and lowering the barbell 99 while it is constrained to travel in the direction of the rods 182*a*, 182*b*.

When the user completes a desired number of repetitions or tires, the user can re-engage the hooks 808*a*, 808*b* with appropriate holes 810*a*, 810*b*, thereby transferring the weight of the loaded barbell 99 from the user to the safety cage 112.

Figure 12E:
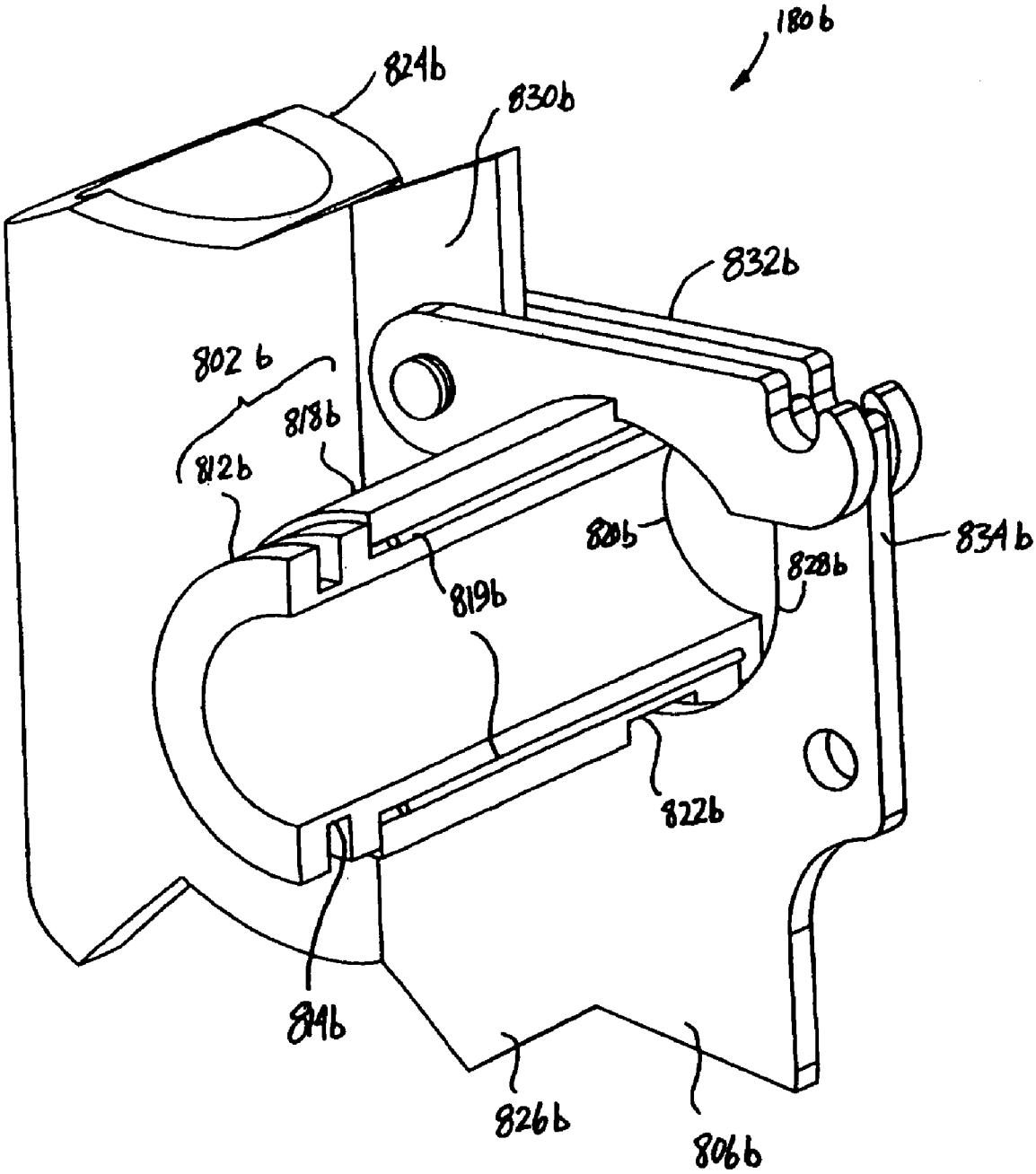
Figure 12F:
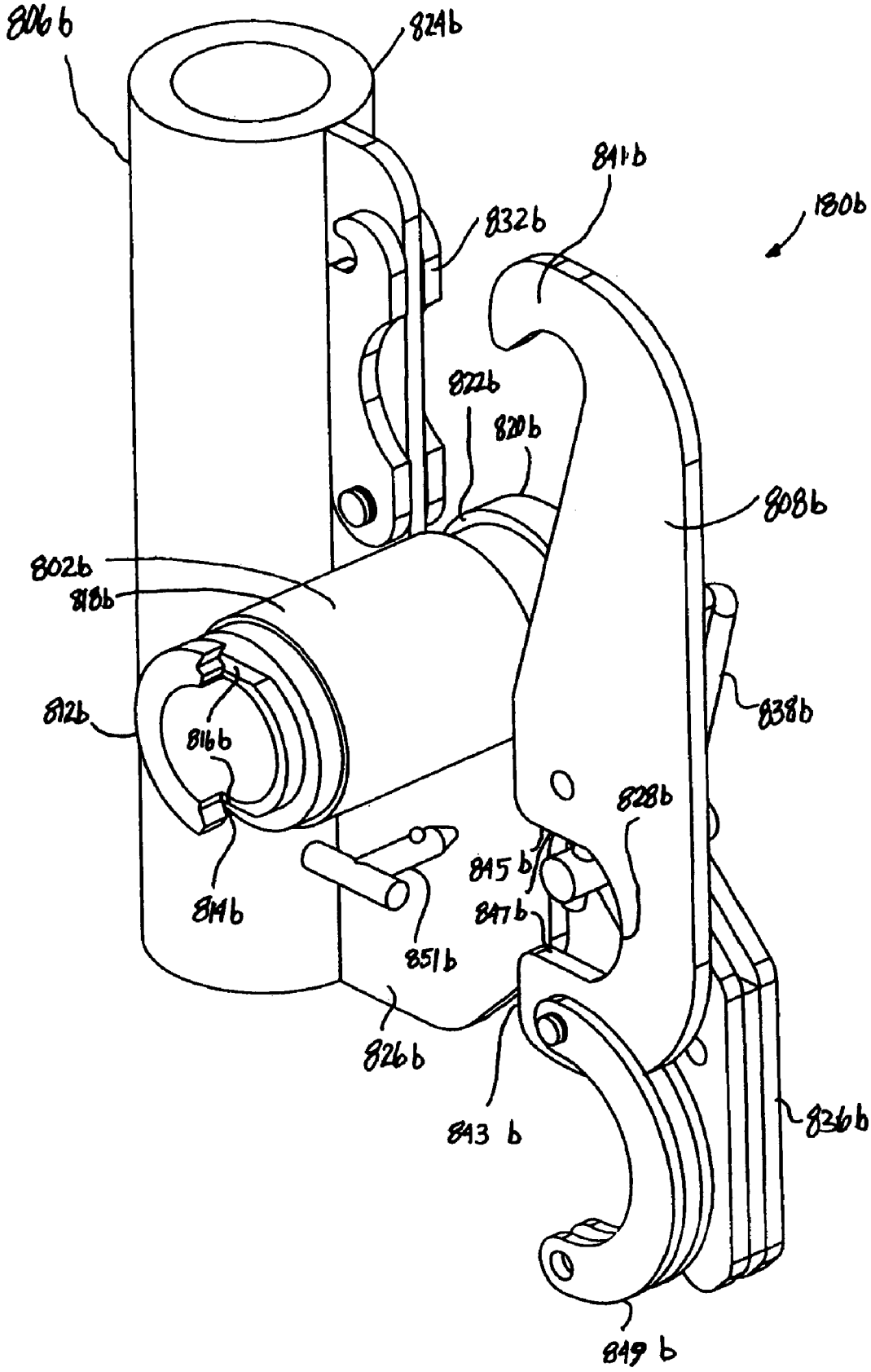
Figure 12G:
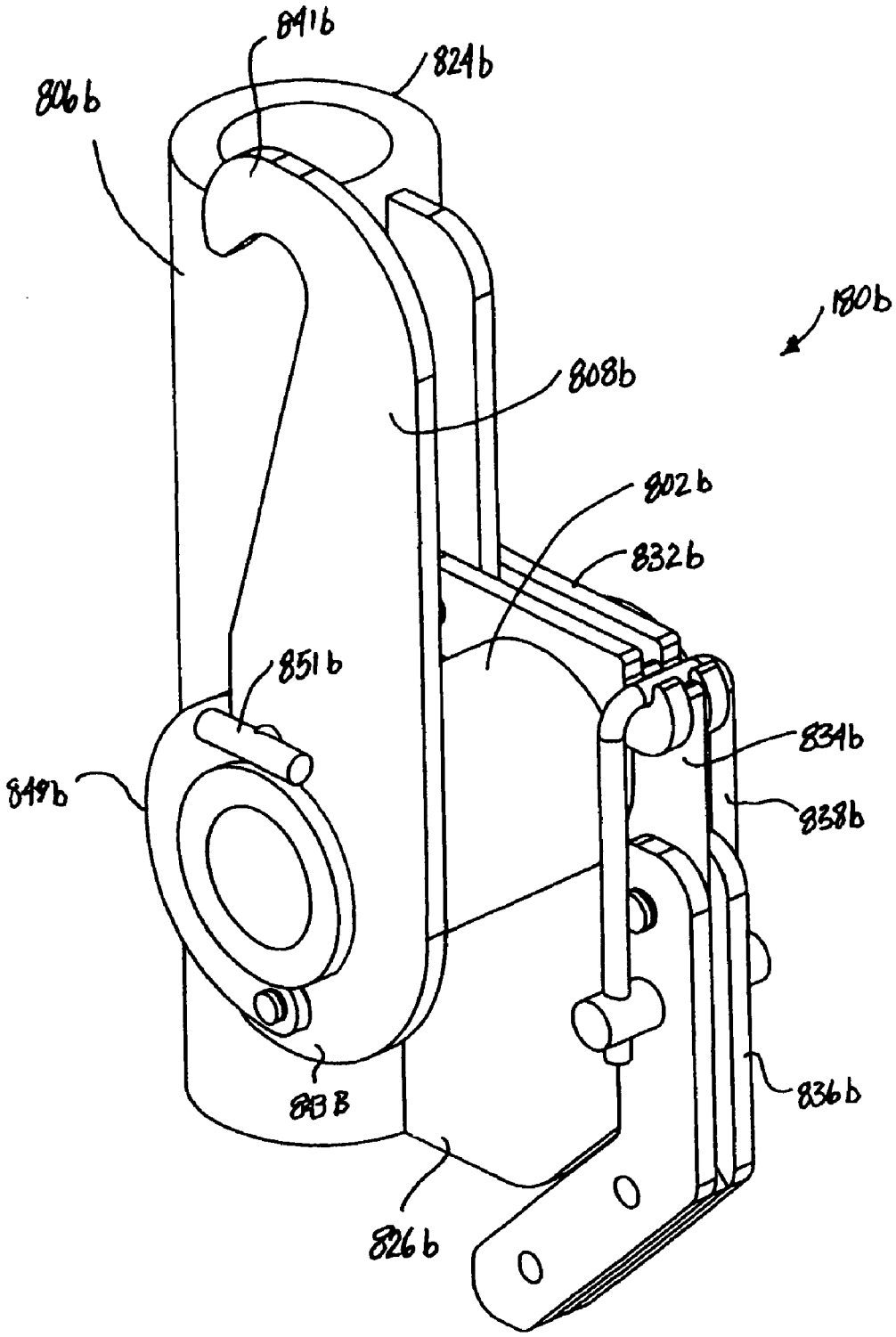

Referring to FIG. 12E, which shows that holder 180*b* with the shaft 804 removed and a section of the bearing 802*b*, the bearing 802*b* has an inner race 812*b* that is sized to be fixed (e.g., by a press-fit, friction fit or welding) to the shaft 804 such that the inner race 812*b* does not rotate relative to the shaft 804. An inboard end of the inner race 812*b* has a groove 814*b* with opposing flat surfaces 816*b* (FIG. 12F) that receive the hook 808*b*.

An outer race 818*b* surrounds and is rotatable relative to the inner race 812*b*. Needle bearings 819*b* are positioned between the inner race 812*b* and the outer race 818*b*. At an outboard end 820*b*, the outer race has a circumferential groove 822*b* sized to engage the holding member 806*b*.

The holding member 806*b* has a tubular guide portion 824*b* (see also FIG. 9) sized to slidingly engage the rod 182*b* and an attached flange 826*b* with a cut-out 828*b* (FIG. 12F) shaped to receive the groove 822*b* of the bearing 802*b*. Side walls of the groove 822*b* help minimize any possible lateral movement of the barbell 99. A first side 830*b* of the flange 826*b* has a catch 832*b* that can be pivoted over the cut-out 828*b* and into contact with an opposite second side 834*b* (FIG. 12E). A lever 836*b* is pivotably connected to the second side 834*b*. The lever 836*b* has a pivoting bail 838*b* sized to receive an end of the catch 832*b*.

When the barbell 99 is inserted in the cut-out 828*b*, the catch 832*b* is pivoted to the second side, the bail 838*b* is placed over the catch 832*c*, and the lever 836*b* is pivoted downwardly to secure the barbell 99 to the holding member 806*b*.

The hook 808*b* has an upper engaging tip 841*b* and a lower end 843*b* with an opening 845*b*. The opening 845*b* has parallel flat sides 847*b* (FIG. 12F) sized to engage the flat surfaces 816*b* of the inner race 812*b*. A collar 849*b* is attached to one end of the body of the hook at one side of the opening 845*b*, and can be pivoted to enclose to the opposite side of the opening 845*b* and secured in place with a pin 851*b* (see, e.g., FIG. 12G) to secure the hook 808*b* to the inner race 812*b*.

To reposition the holders 180*a*, 180*b*, the barbell 99 with the bearings 802*a*, 802*b* and hooks 808*a*, 808*b* is removed from the holding members 806*a*, 806*b*, the holding members are pivoted 180 degrees around the respective rods 182*a*, 182*b* (to face the interior of the safety cage), and the barbell 99 is replaced within the holding members.

As indicated above, the barbell 99 in most embodiments is releasably secured to allow use of the barbell on its own, i.e., separate from any Smith machine guiding structure, such as, e.g., in traditional free weight exercises. For such use, it may be possible, although not necessary, to remove some or all of the components, e.g., the hooks and/or the collars, from the barbell, or these components may remain fixed to the barbell 99.

In other embodiments, the ability to readily remove the barbell from the Smith machine guiding structure, e.g., quickly and without the use of tools, may be optional. For example, removal of the barbell may not be required to reposition the frame system in a compact position for storage in some implementations. If so, the barbell can be attached to the holders in other ways that do not necessarily provide for its ready release. In these embodiments, the hooks may be attached by welding. In still other embodiments, there may be no hooks.

Smith Machine Safety Cage System with Folding Sides

As shown in FIGS. 10, 11A, 11B and 13, a safety cage system 210 has front uprights fitted with a Smith machine mechanism (similar to the embodiment of FIGS. 8 and 9) and folding safety sides (similar to the embodiments of FIGS. 1-7D).

The construction and operation of the safety cage system 210 are the same as for respective similar features of the safety cage systems 10 and 110 described above.

Figure 13:
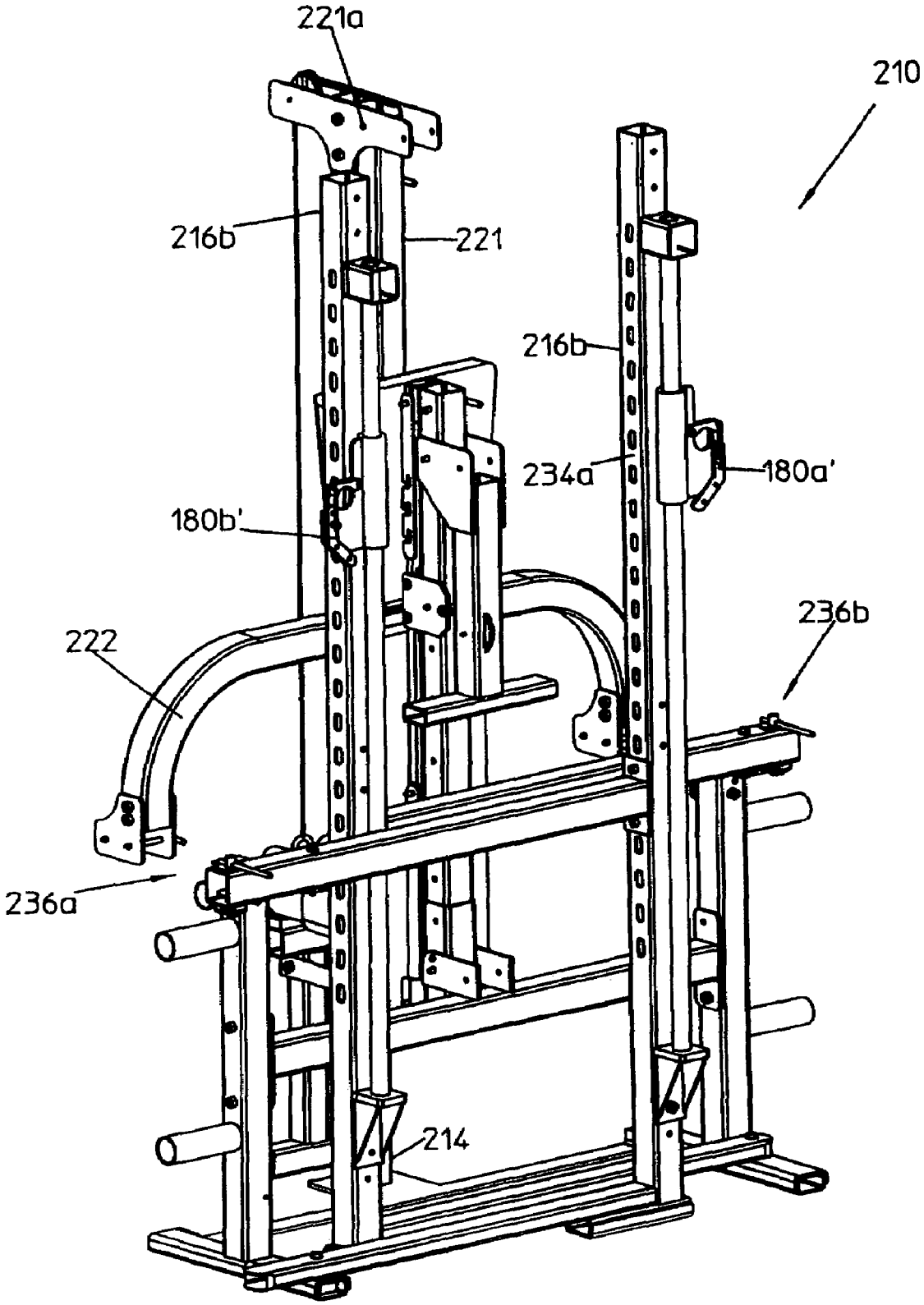
FIG. 13 is a perspective view of the system of FIG. 10 configured in a compact position and showing an optional bench configuration.

The safety cage 212 of the system 210 is configured from its open position (as shown, e.g., in FIG. 10) to its compact position (as shown in FIG. 13) by: (1) disconnecting the ends of the curved upper lateral member 222 from the front uprights 234*a*, 234*b*; (2) pivoting the curved upper lateral member 222/upper lateral member 221 downward about a pivot 221*a* against the rear frame member 214; (3) releasing the locking pivots 236*a*, 236*b*; (4) pivoting the right side frame member 216*b* against the pivoted members 222, 221; and (5) pivoting the left side frame member 216*a* against the pivoted right side frame member 216*b*.

Safety Cage System with Folding Sides and Aligned Pivots

Figure 15:
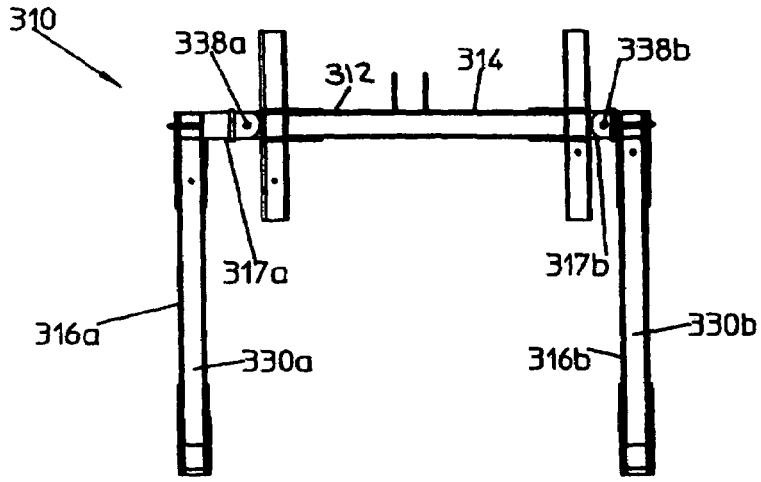
FIGS. 14 and 15 are perspective and plan views, respectively, of another system having a safety cage with side frame members having extensions of different lengths and pivots aligned along a common axis.
Figure 14:
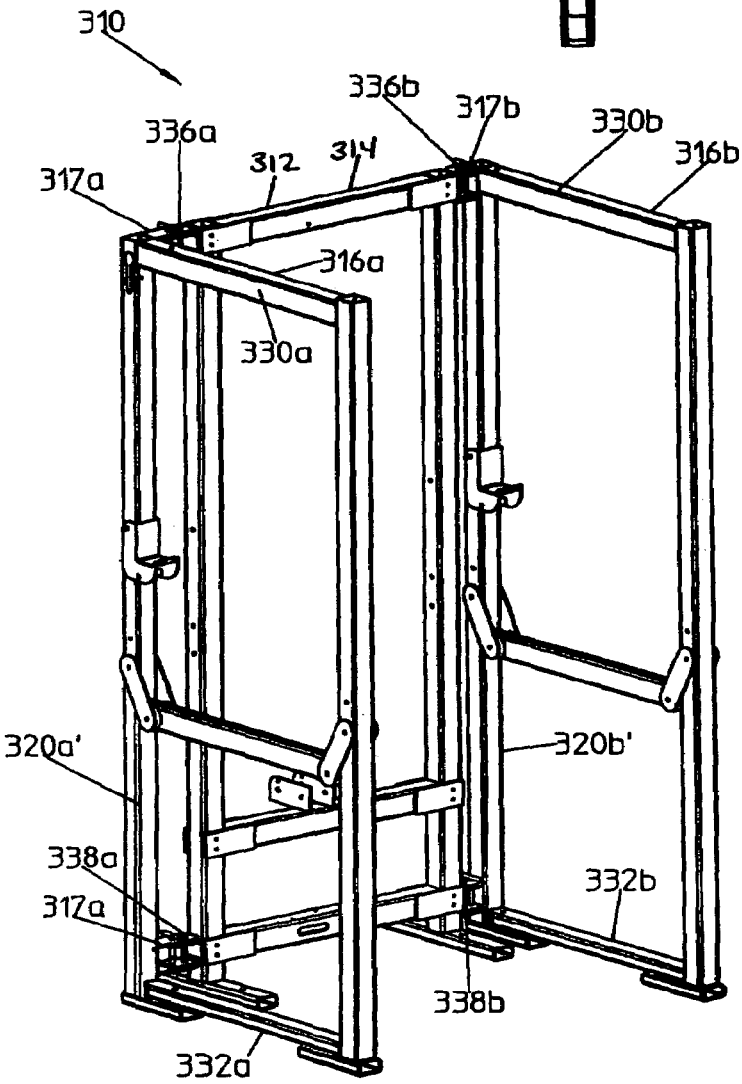
Figure 16C:
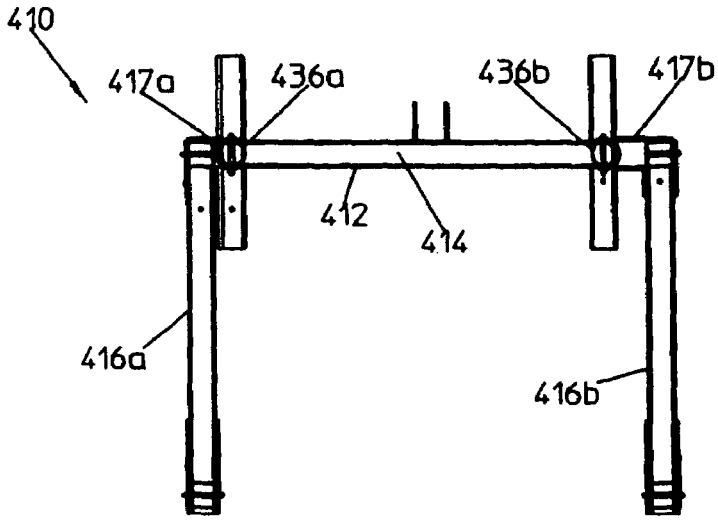
FIGS. 16A, 16B and 16C are perspective, front and plan views, respectively, of another system having a modified pivot design.
Figure 16A:
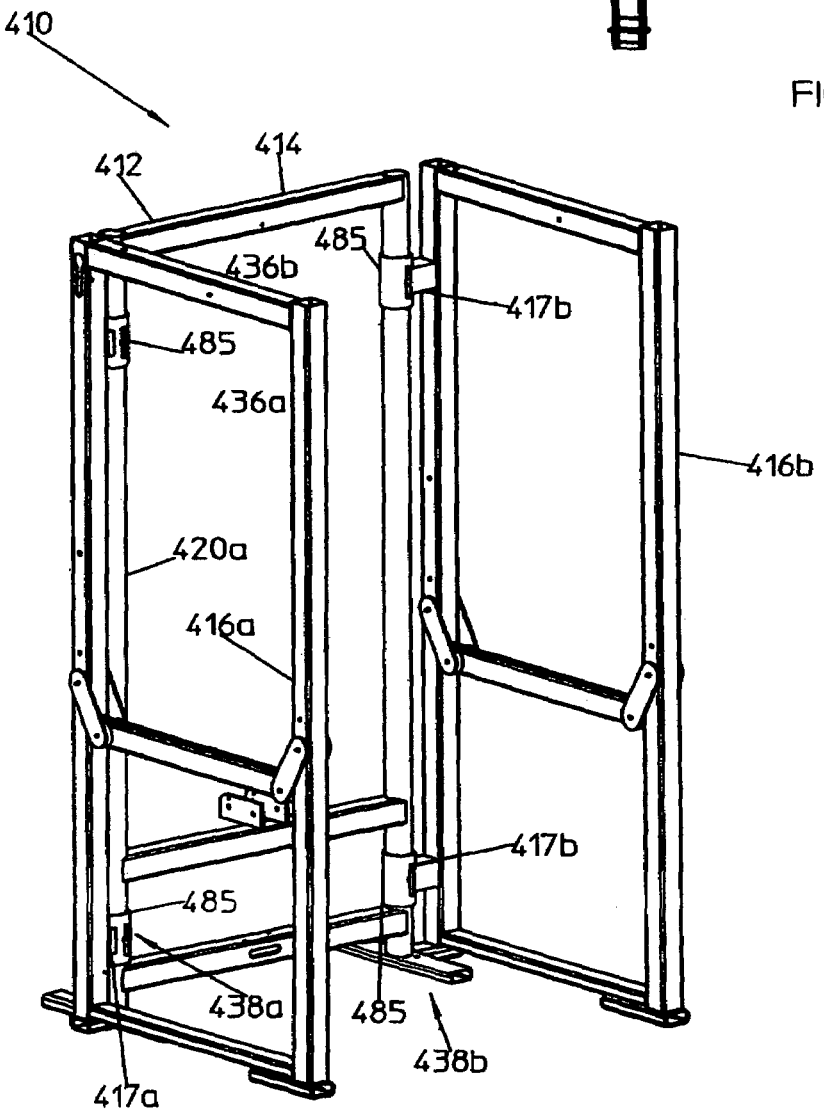
Figure 16B:
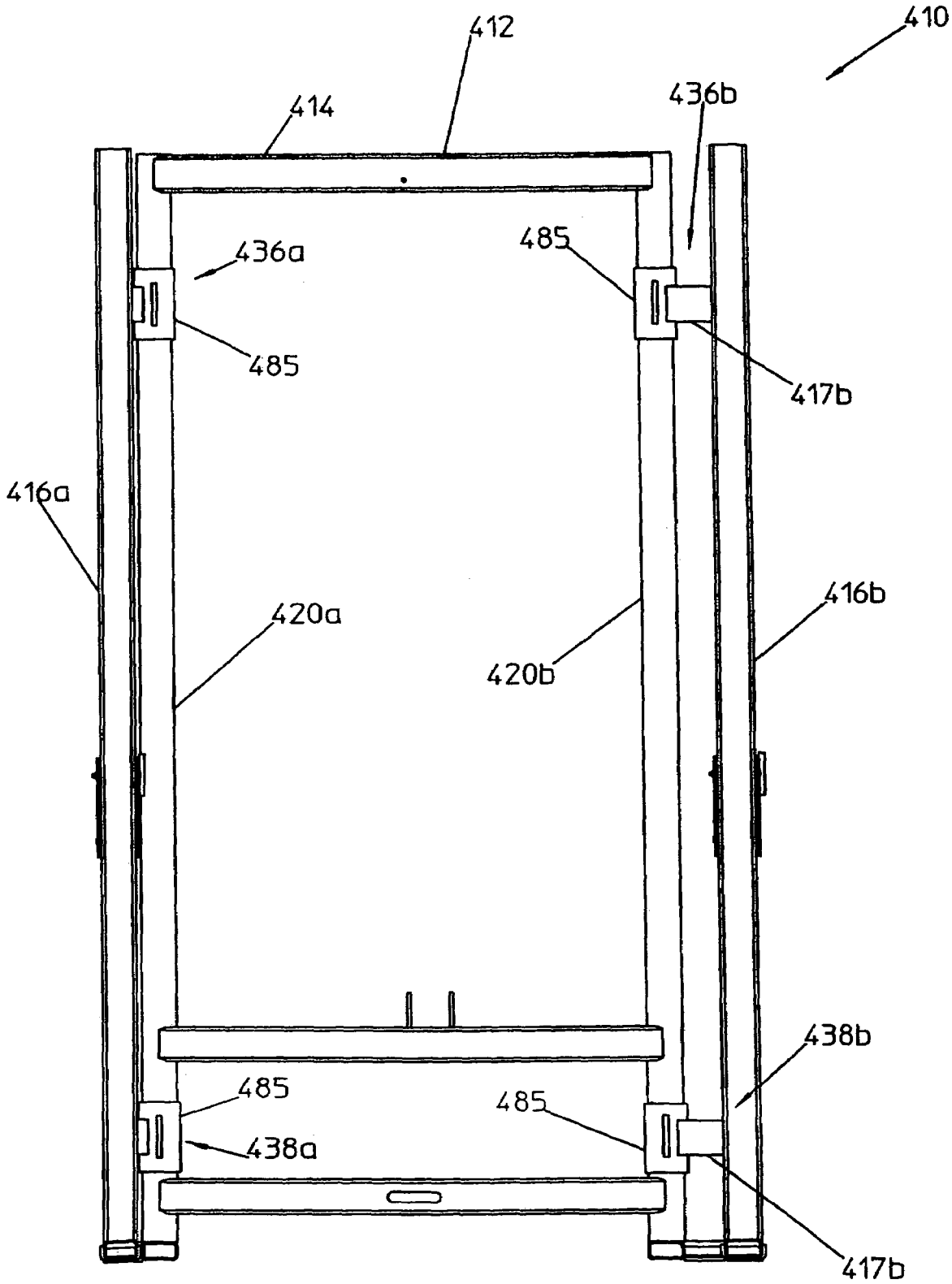
Figure 16D:
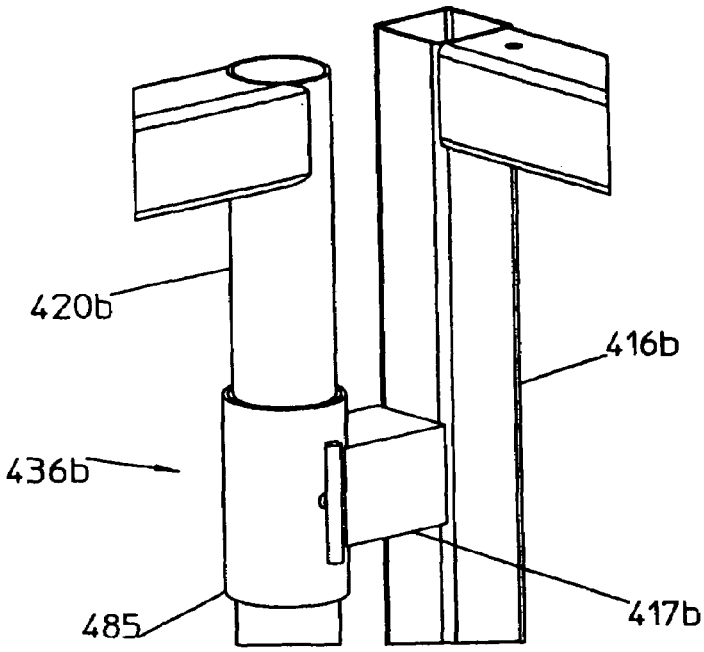
FIG. 16D is an enlarged perspective view of one of the pivots according to the modified design shown in FIGS. 16A, 16B and 16C.
Figure 16E:
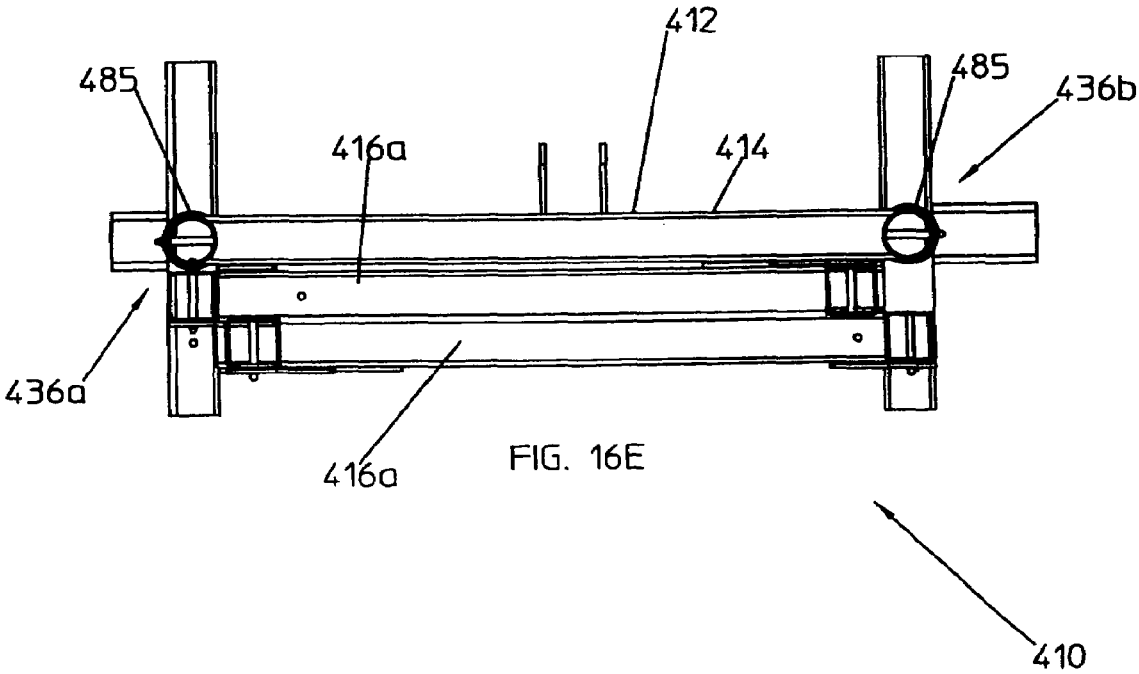
FIG. 16E is a plan view of the system of FIGS. 16A, 16B and 16C in a compact position.
Figure 18:
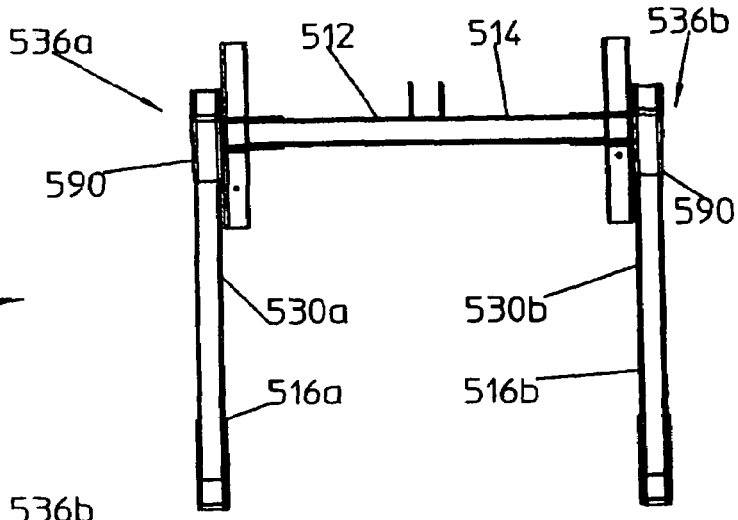
FIGS. 17 and 18 are perspective and plan views, respectively, of another system with a safety cage having side frame members that pivot and telescope relative to the rear frame member.
Figure 17:
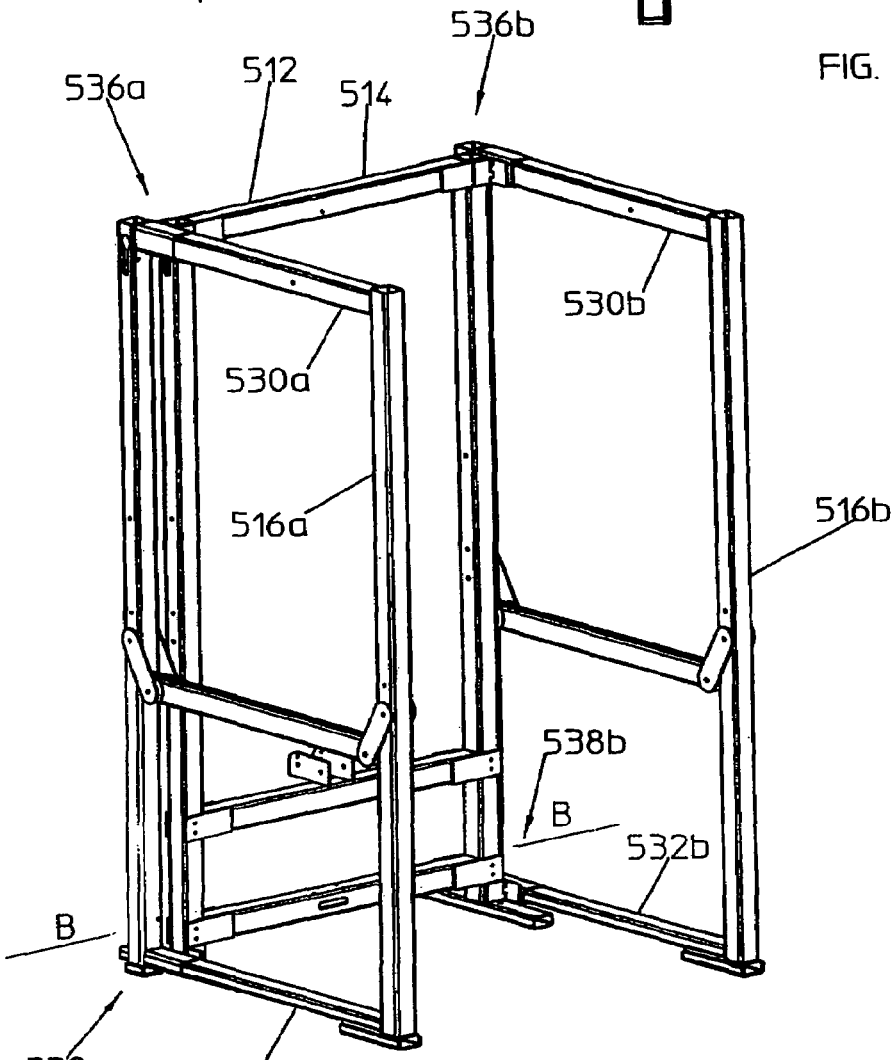
Figure 19:
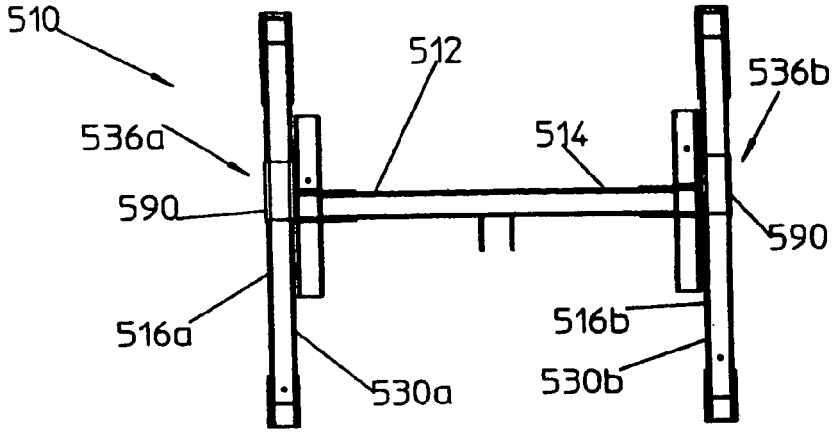
FIG. 19 is an additional plan view similar to FIG. 18, except showing the side frame members being telescoped relative to the rear frame member.
Figure 22:
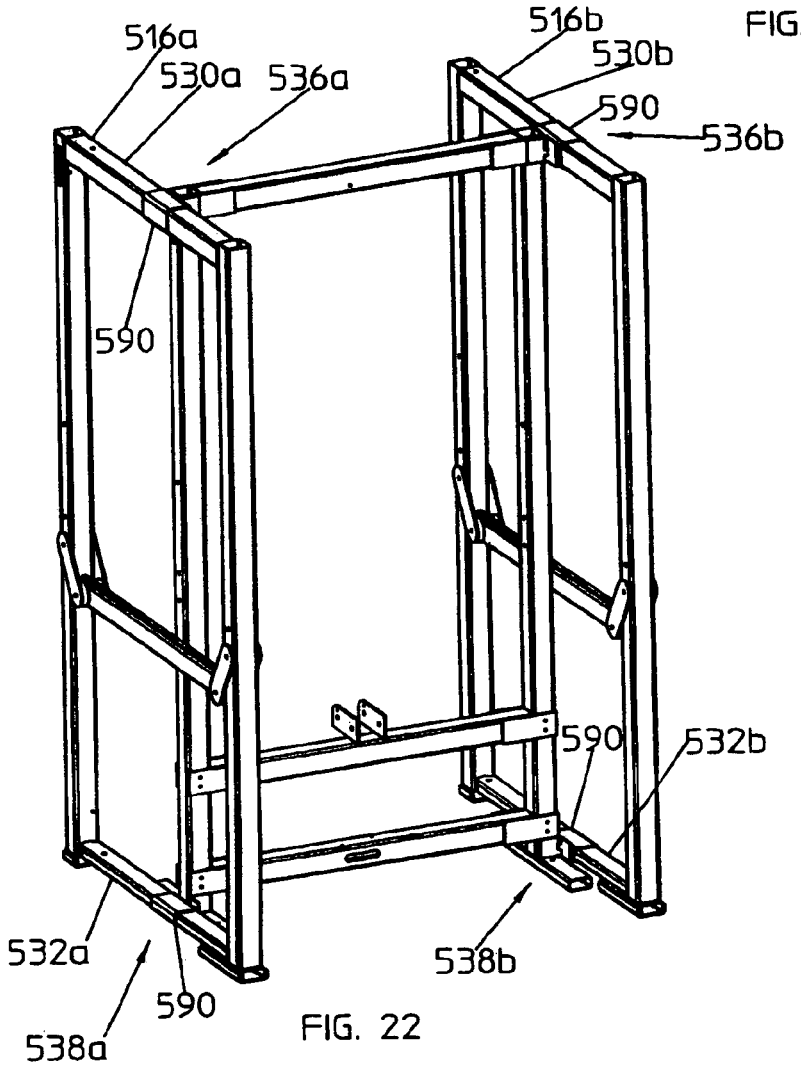
FIG. 22 is a perspective view of the safely cage in the position shown in FIG. 19.
Figure 21:
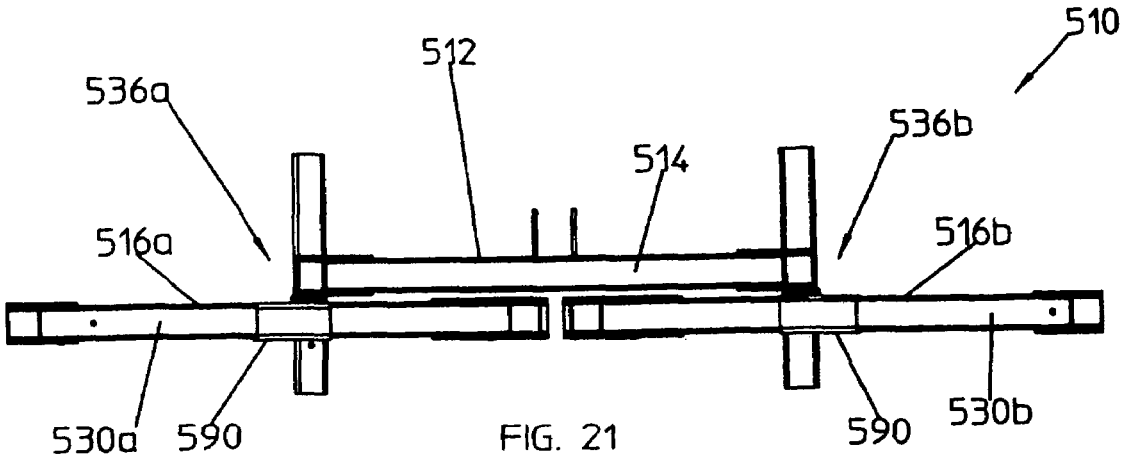
FIG. 21 is a plan view, respectively, of the safety cage of FIGS. 17 and 19 in a compact position.

As shown in FIGS. 14 and 15, a system 310 has a safety cage 312 with folding sides, but the pivots are aligned along a common axis B. The sides have extension portions of unequal length that allow the sides to be folded flat to configure the safety cage 312 in a compact position.

A left side frame member 316*a* has extension portions 317*a* extending approximately perpendicular from upper lateral member 330*a* and lower lateral member 332*a*. The upper and lower extension portions 317*a* are joined by an upright 320*a*'. The pivots 336*a*, 338*a* are positioned at the junctions between the respective extension portions 317*a* and the left side of the rear frame member 314.

A right side frame member 316*b* is similar, except the right side extension portions 317*b* are shorter than the left side extension portions 317*a*. The different lengths of the extension portions 317*a*, 317*b* allow the right side frame member 316*b* to be folded flat against the rear frame member 314, and the left side frame member 316*a* to be folded flat against the right side frame member 316*b*.

In another system 410, the pivots of a safety cage 412 with folding sides are also aligned along the axis B, as shown in FIGS. 16A-16E. In the system 410, however, the right side extension portions 417*b* are longer than the left side extension portions 417*a* (see FIG. 16C), such that the left side frame member 416*a* is folded flat against the rear frame member 414 and the right side frame member 416*b* is folded flat against the left side frame member 416*a*, to configure the safety cage 412 in a compact position (see FIG. 16E).

In the system 410, the uprights 420*a*, 420*b* are round (see FIG. 16D, which shows an enlarged view of the upper right pivot 436*b*), and the pivots 436*a*, 436*b*, 438*a*, 438*b* are sleeves 485 sized slightly larger than the uprights 420*a*, 420*b*, thus creating a bearing arrangement.

Safety Cage System with Folding and Telescoping Sides

As shown in FIGS. 17-22, a system 510 has a safety cage 512 with sides that pivot as well as telescope. The pivots in the system 510 are also aligned along the axis B. In the compact position, however, the sides do not overlap, but rather lie in the same vertical plane.

Figure 20:
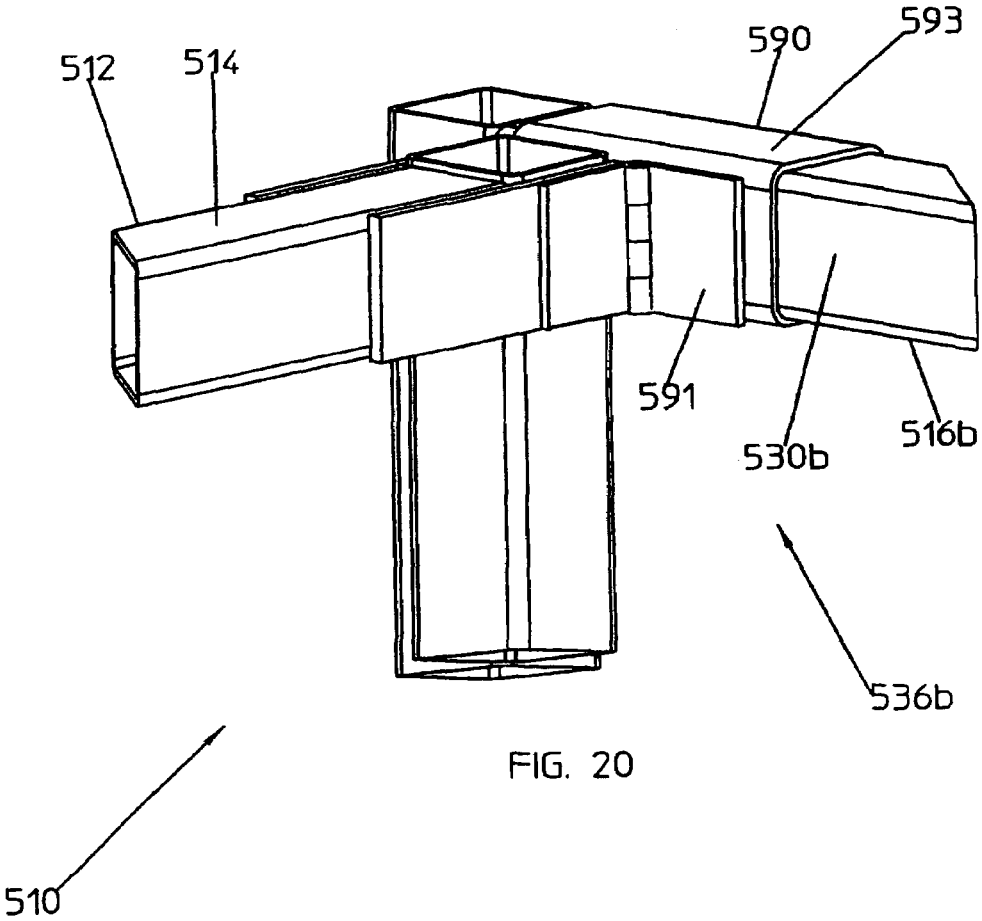
FIG. 20 is an enlarged perspective view of a joint at an upper junction of the right side frame member and the rear frame member in FIG. 17.

Referring to FIG. 20, each of the pivots 536*a*, 536*b*, 538*a*, 538*b* is a joint 590 having a hinge 591 with one portion attached (e.g., by welds or fasteners) to a sleeve 593. The other portion of the hinge 591 is attached to the rear frame member 514, thus allowing the joint 590 to pivot relative to the rear frame member 514.

The sleeves 593 are sized to slidingly receive the respective lateral members 530*a*, 530*b*, 532*a* and 532*b*, thus allowing these members to be telescoped relative to the joints 590.

To configure the safety cage 512 in a compact position: (1) the side frame members 516*a*, 516*b* are urged toward the rear frame member 514, thus causing the lateral members 530*a*, 530*b*, 532*a* and 532*b* to telescope or slide through the respective joints 590 (see FIG. 22); and (2) when the lateral members 530*a*, 530*b*, 532*a* and 532*b* have been slid approximately halfway through the joints 590 (see FIGS. 19 and 22), the side frame members 516*a*, 516*b* are pivoted towards the rear frame member 514 (see FIG. 21).

Safety Cage System with Removable Sides

As shown in FIGS. 23A-25, a system 610 has a safety cage 612 with sides that can be readily removed, and the rear frame member has elements that receive and hold the sides when the safety cage 612 is configured in its compact position.

Figure 23B:
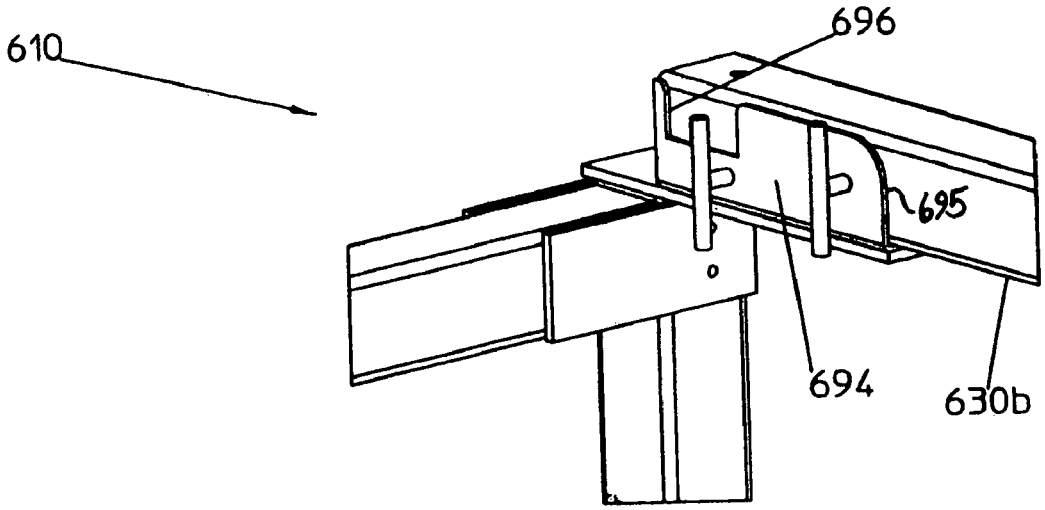
FIG. 23B is an enlarged perspective view of a saddle at an upper junction of the right side frame member and the rear frame member in FIGS. 23A and 24.
Figure 23A:
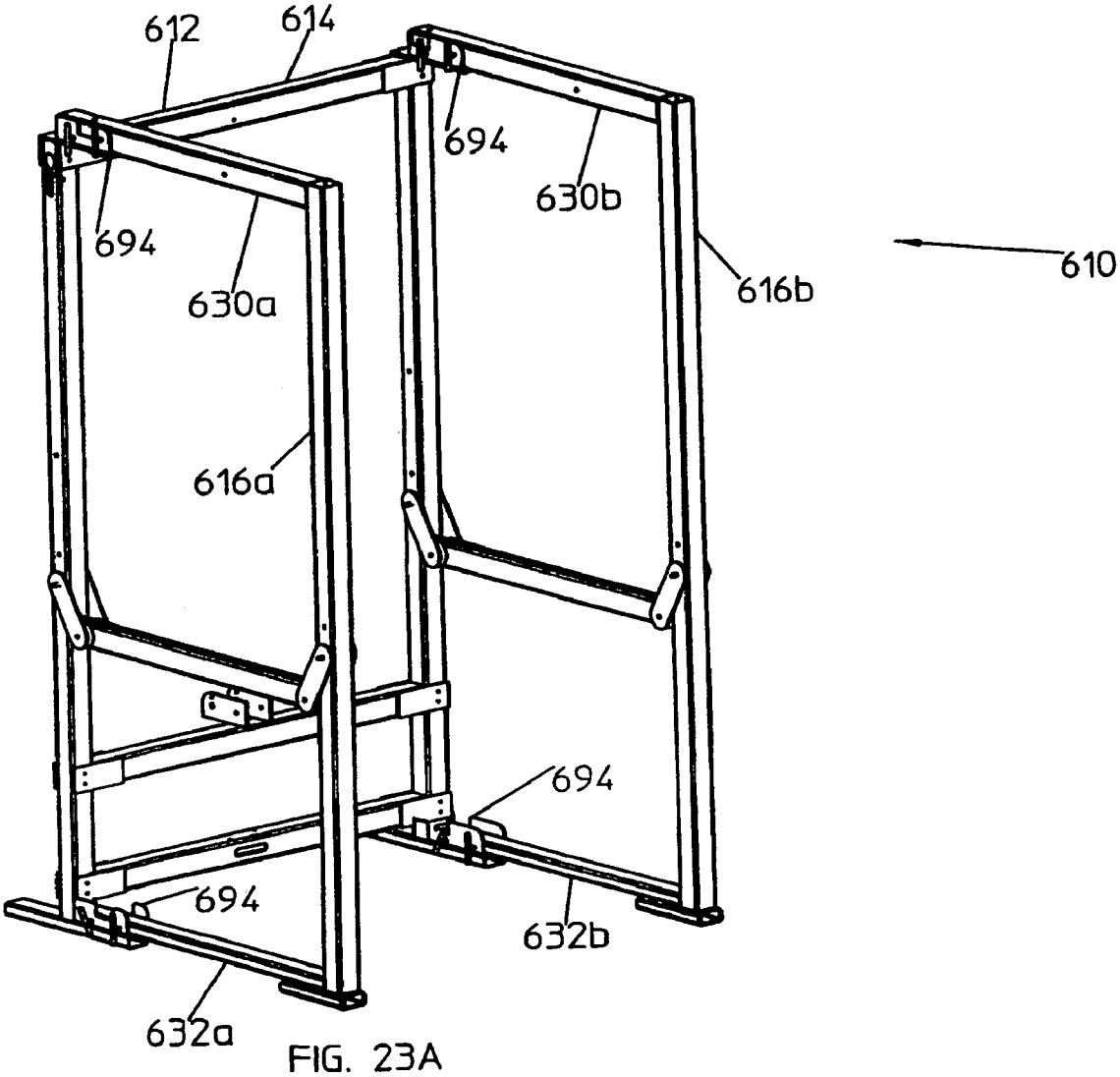
FIGS. 23A and 24 are perspective views of another system having a safety cage with detachable side frame members shown in an assembled state for use, and in a compact position, respectively.
Figure 25:
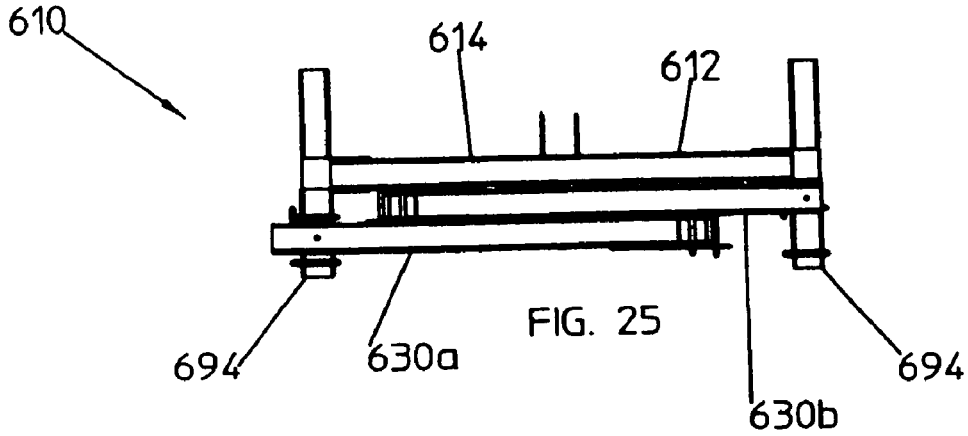
FIG. 25 is a plan view of the system shown in FIGS. 23A and 24, folded for compact storage.
Figure 24:
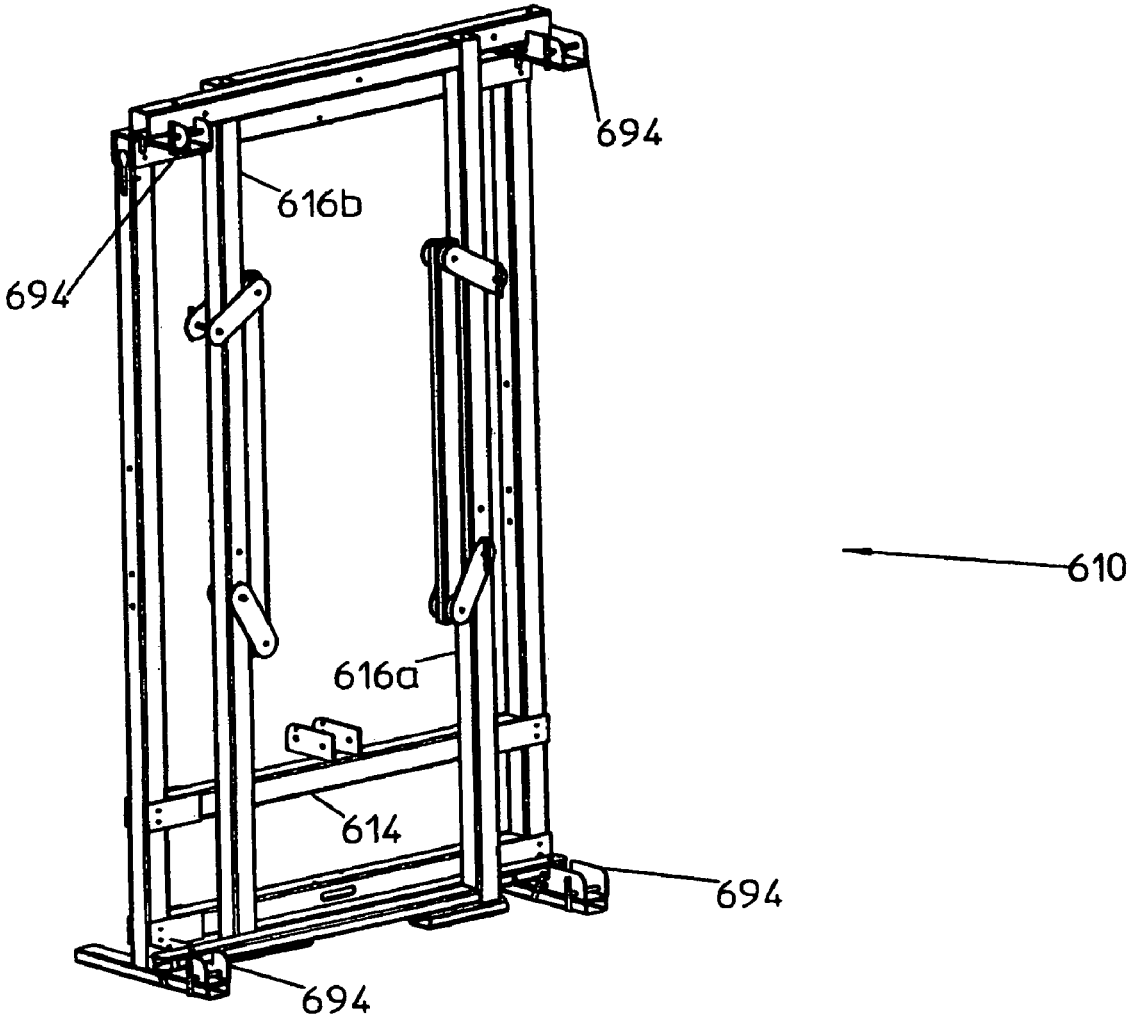

In the system 610, the rear frame member 614 has a saddle 694 attached at adjacent each upper and lower end of each upright 620*a*, 620*b*. Referring to FIG. 23B, each saddle 694 has a channel 695 dimensioned to receive the respective lateral members 630*a*, 630*b*, 632*a*, 632*b* when the safety cage is configured for use. Notches 696 in sides of each channel 695 define a space for receiving the lateral members. The notches 696 in the right side channels 695 are positioned closer to the rear frame member 614 than the notches 696 in the left side channels 695.

To configure the safety cage 612 in a compact position, (1) the right side frame member 616*b* is removed from the channels 695 of the respective saddles 694 and repositioned in the notches 696 of these channels to lie adjacent and approximately parallel to the rear frame member 614; (2) similarly, the left side frame member 616*a* is removed from the channels 695 in the other saddles 694, and positioned in the notches 696 to lie adjacent and approximately parallel to the right side frame member 616*b* (see FIGS. 24 and 25).

As shown in the figures, the side frame members 616*a*, 616*b* may be pinned, clamped or otherwise secured when the safety cage 612 is configured for use or in its compact position.

Additional Configurations

In FIGS. 12A and 12B, the frame system 710 with Smith machine functionality is shown with the barbell positioned on the outer side of the cage. As noted above and as shown in FIGS. 31-33, the holders for the barbell can be positioned so that the barbell is releasably secured on an inside of the frame system.

Figure 34:
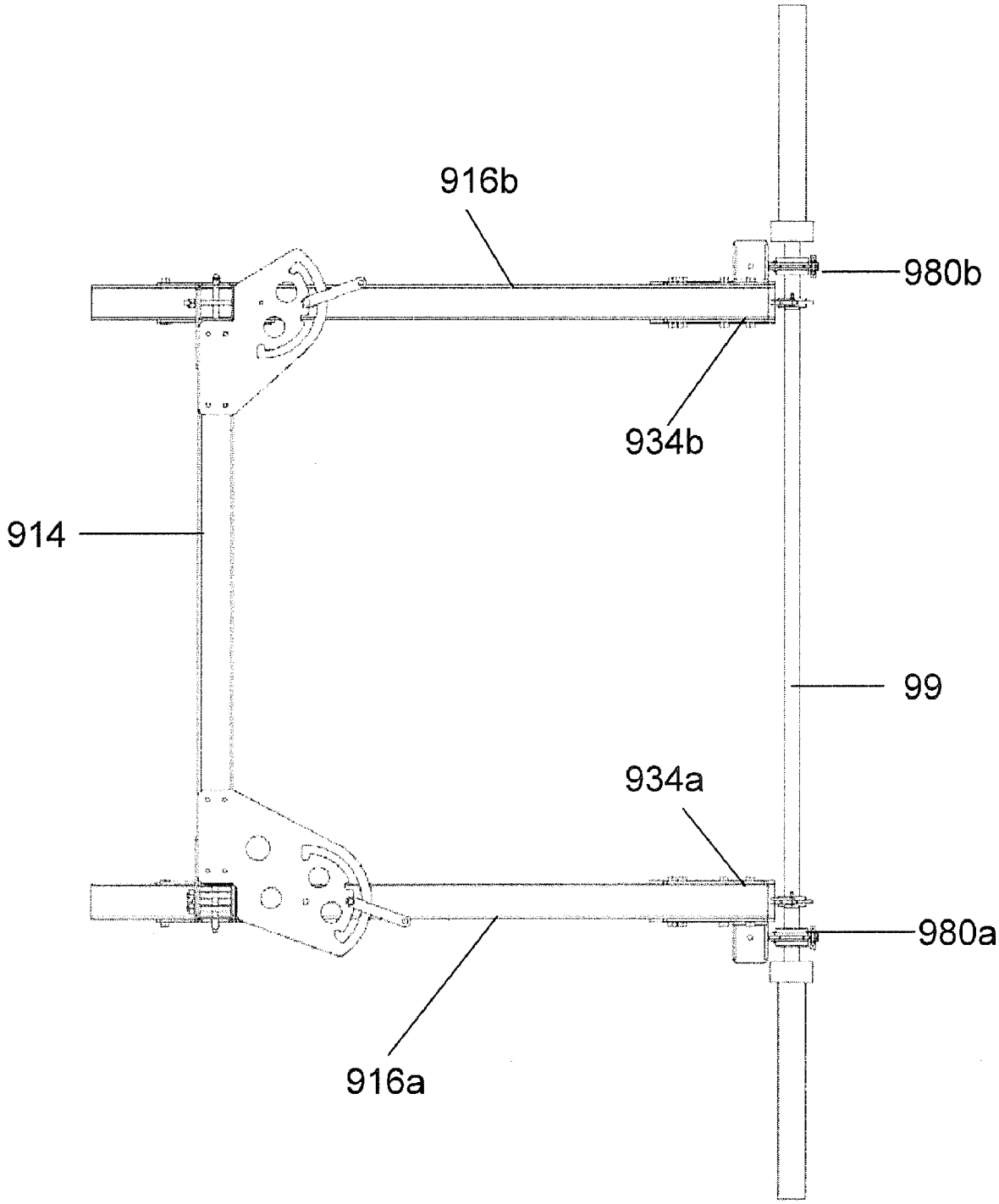
FIG. 34 is a plan view of a system similar to that shown in FIGS. 31-33, except showing the barbell positioned on an outer side of the side frame members.
Figure 35:
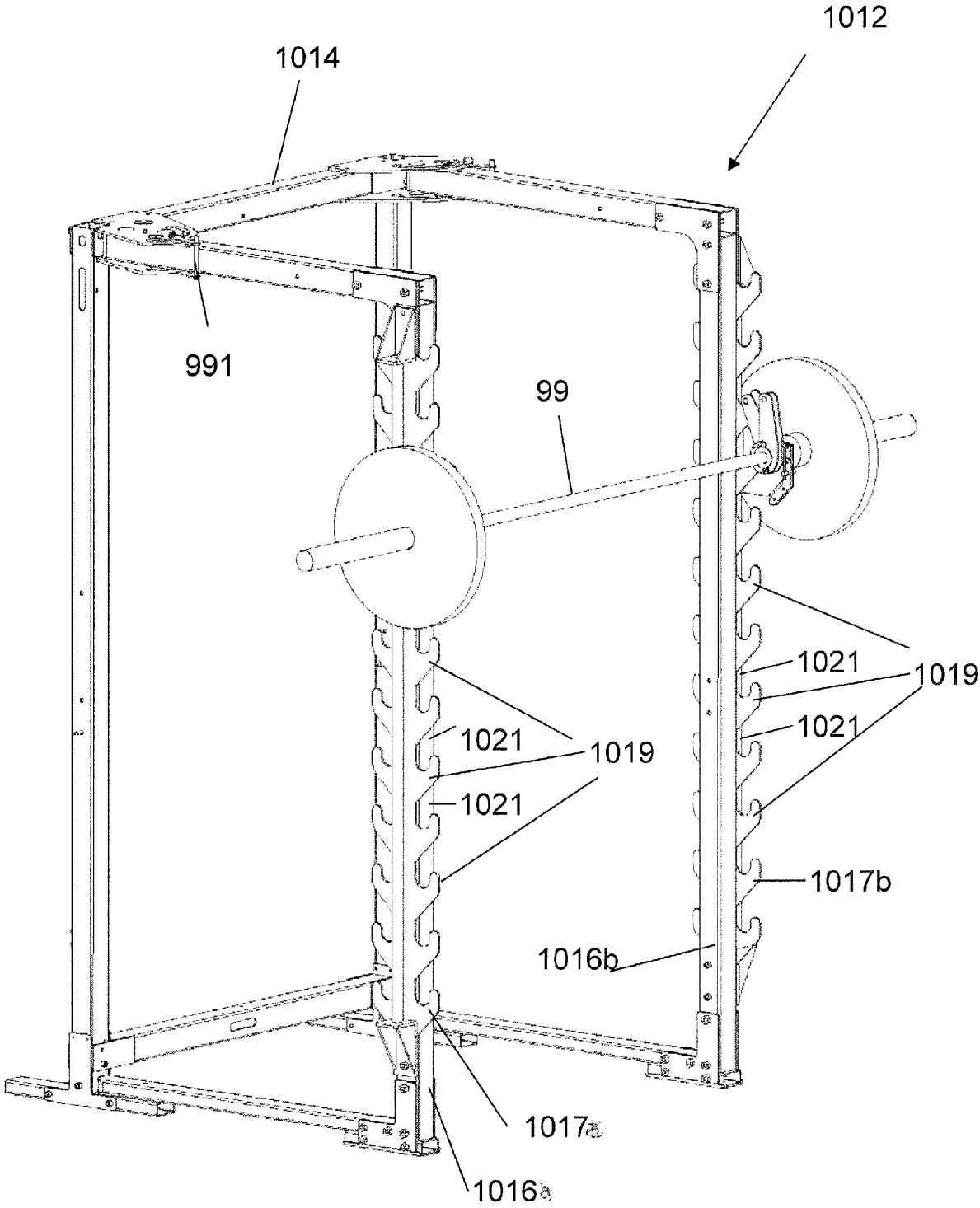
FIGS. 35-40 show a system with Smith machine functionality and having gun rack style portions that hold the barbell directly or receive hooking members attached to the barbell.

FIG. 31 is a front perspective view of a frame system 912 with a rear frame member 914 and folding side frame members 916*a*, 916*b* in which the barbell 99 is shown positioned on an inner side, the barbell 99 being shown without weights. FIG. 32 is a rear perspective view similar to FIG. 31. FIG. 33 is a plan view of the frame system 912 showing a view of the expanded frame position with the barbell (together with added plates) in its releasably secured position and as configured to be on an inner side of the uprights 934*a*, 934*b*. For comparison, FIG. 34 is a plan view similar to FIG. 33, except showing the barbell 99 as it would appear when configured for positioning on an outer side of the uprights 934*a*, 934*b*.

FIGS. 35-40 show another frame system 1012 in which the side frame members 1016*a*, 1016*b* have so-called "gun rack" portions 1017*a*, 1017*b*, each with a series of projecting fingers 1019 and alternating cut-outs 1021. The projecting fingers 1019 are shaped to receive hooks 1023 attached to the barbell. The gun rack portions 1017*a*, 1017*b* may be separate pieces attached to the side frame members, or the side frame members may be formed with the gun rack portions. With the gun rack portions, the upright members need not have openings. If desired, the hooks 1023 can be fitted with rollers at their ends to facilitate smooth engagement and disengagement from the fingers 1019. In a simplified construction (not shown), the barbell is placed directly within appropriately shaped cut-out portions, without the need for the hooks 1023.

Figure 36:
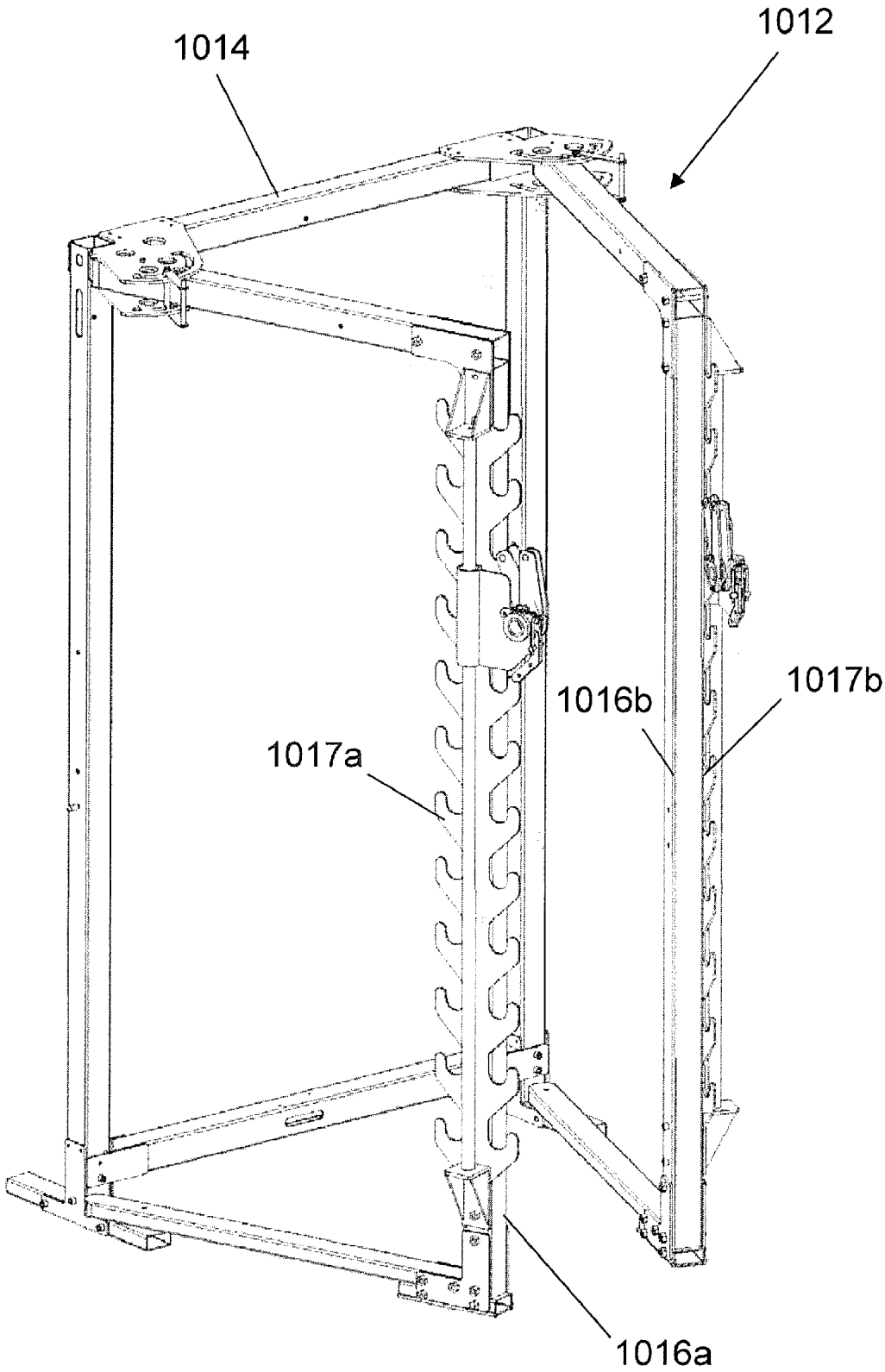
Figure 37:
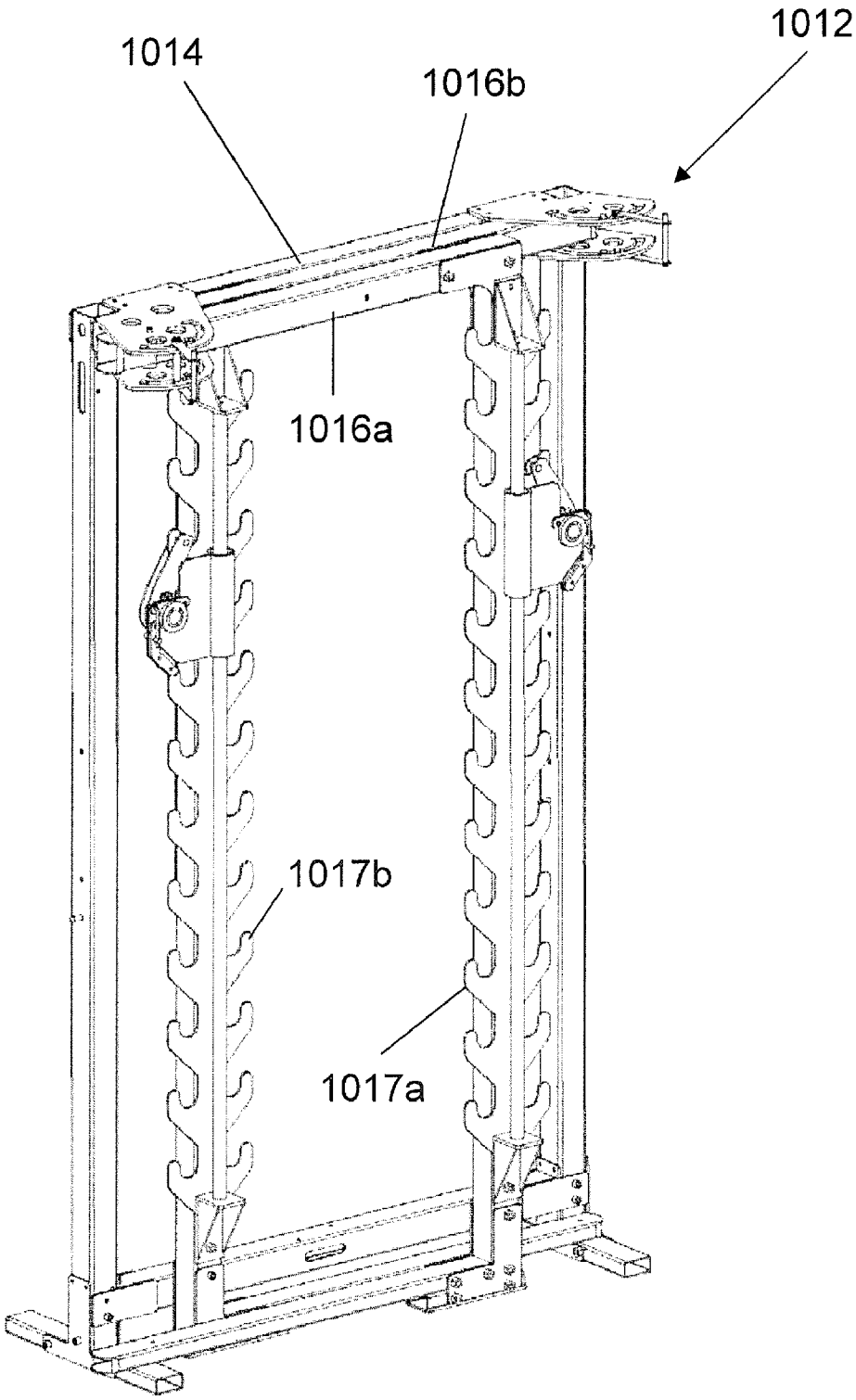
Figure 38:
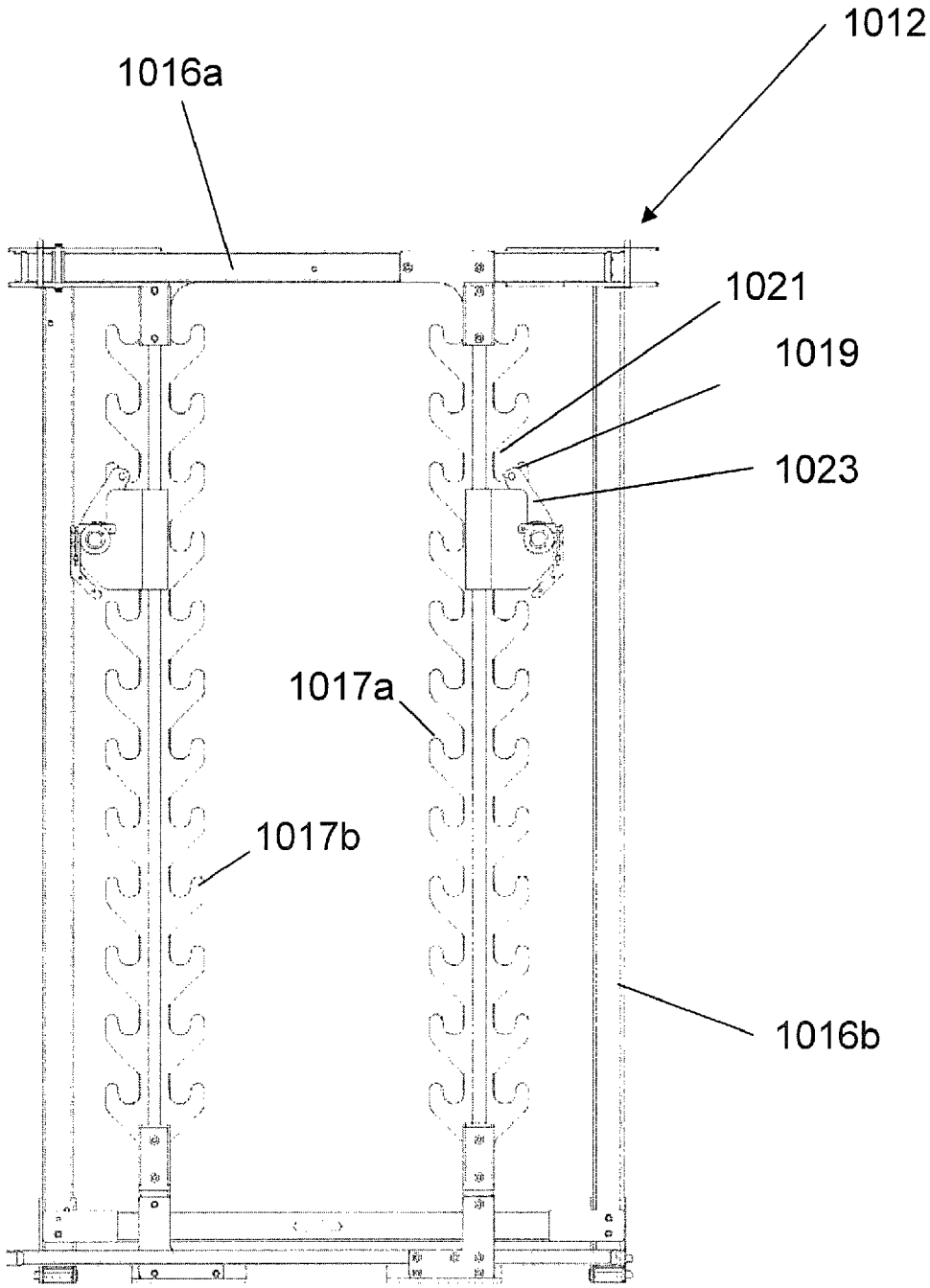
Figure 39:
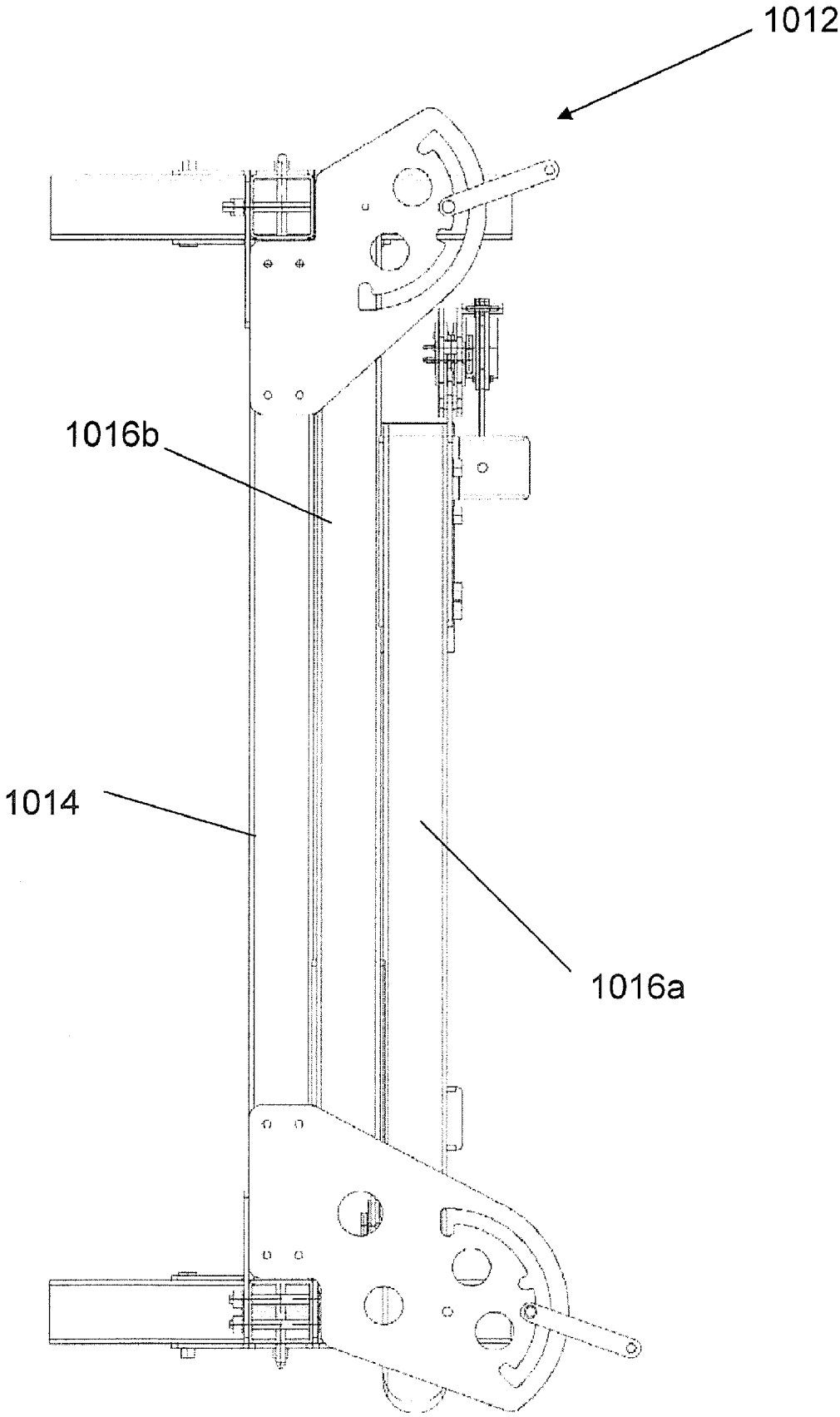
Figure 40:
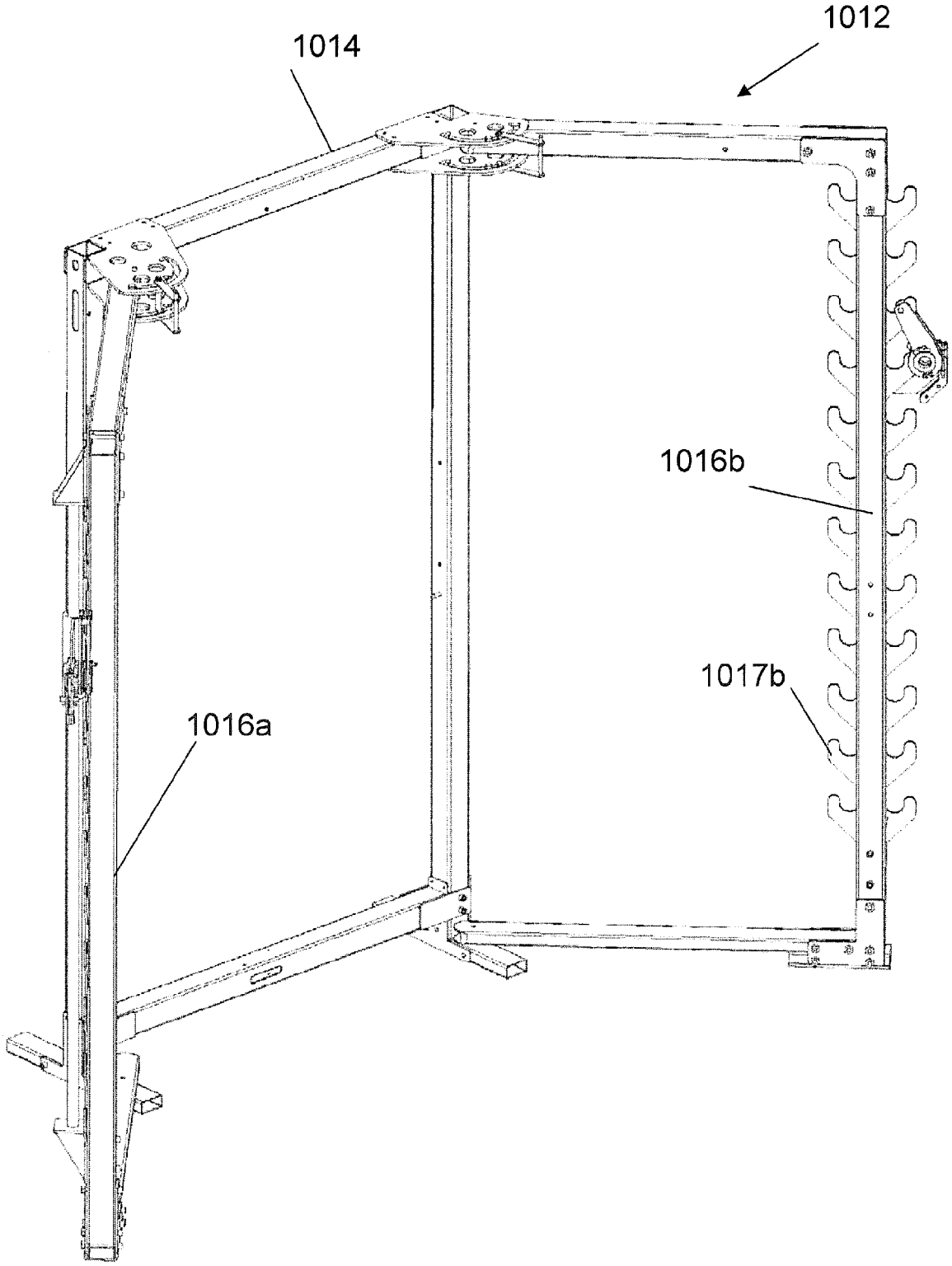

FIG. 36 shows the frame system 1012, having a rear frame member 1014, after the barbell has been released from its securing holders, and the side frame members 1016*a*, 1016*b* have been angled inwardly towards each other. FIGS. 37, 38 and 39 are perspective, front and top views, respectively, showing the frame system 1012 with the barbell removed and the side frame members positioned for storage. FIG. 40 is a perspective view showing the frame system 1012 with the barbell removed and the side frame members 1016*a*, 1016*b* angled away from each other.

Figure 42:
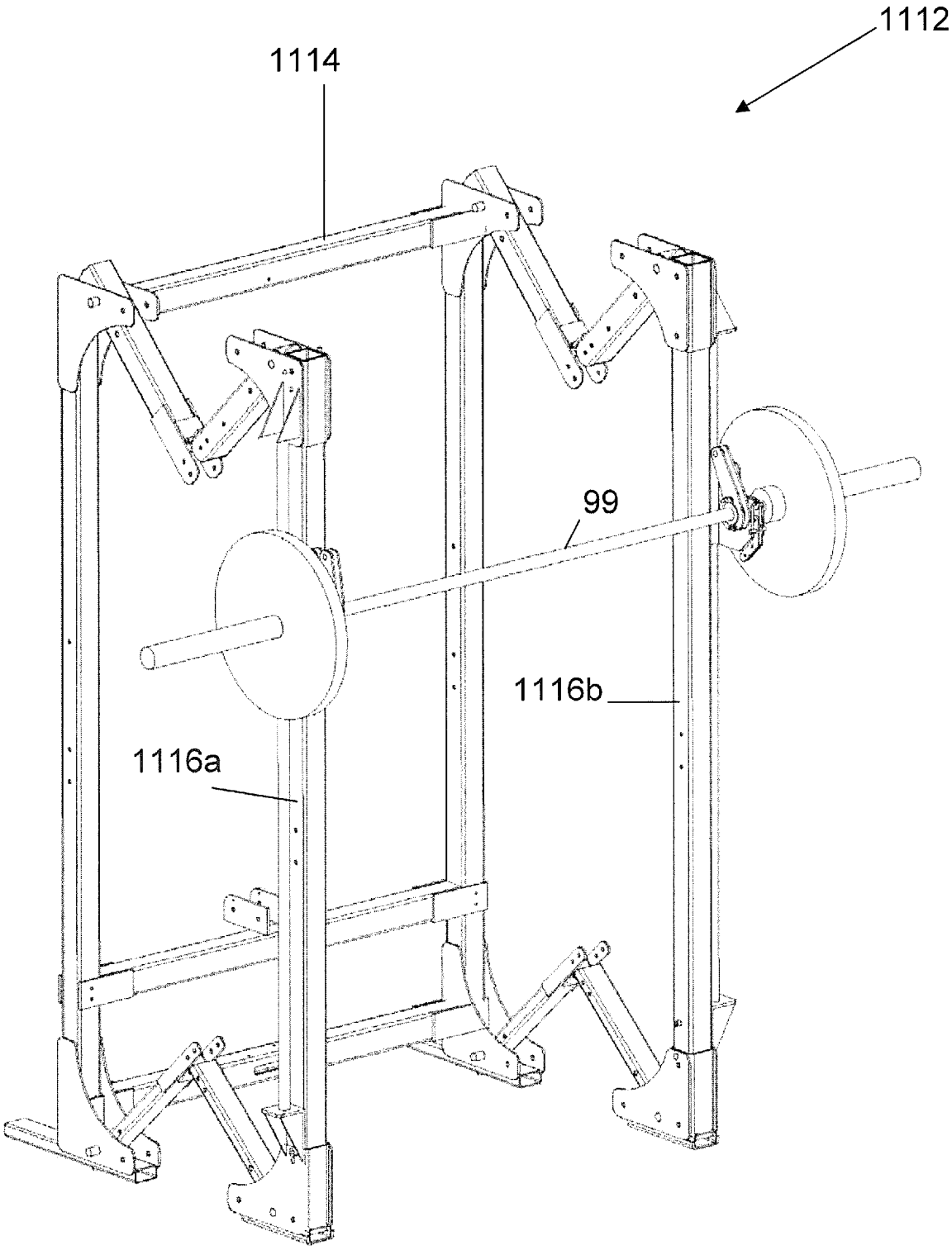
Figure 43:
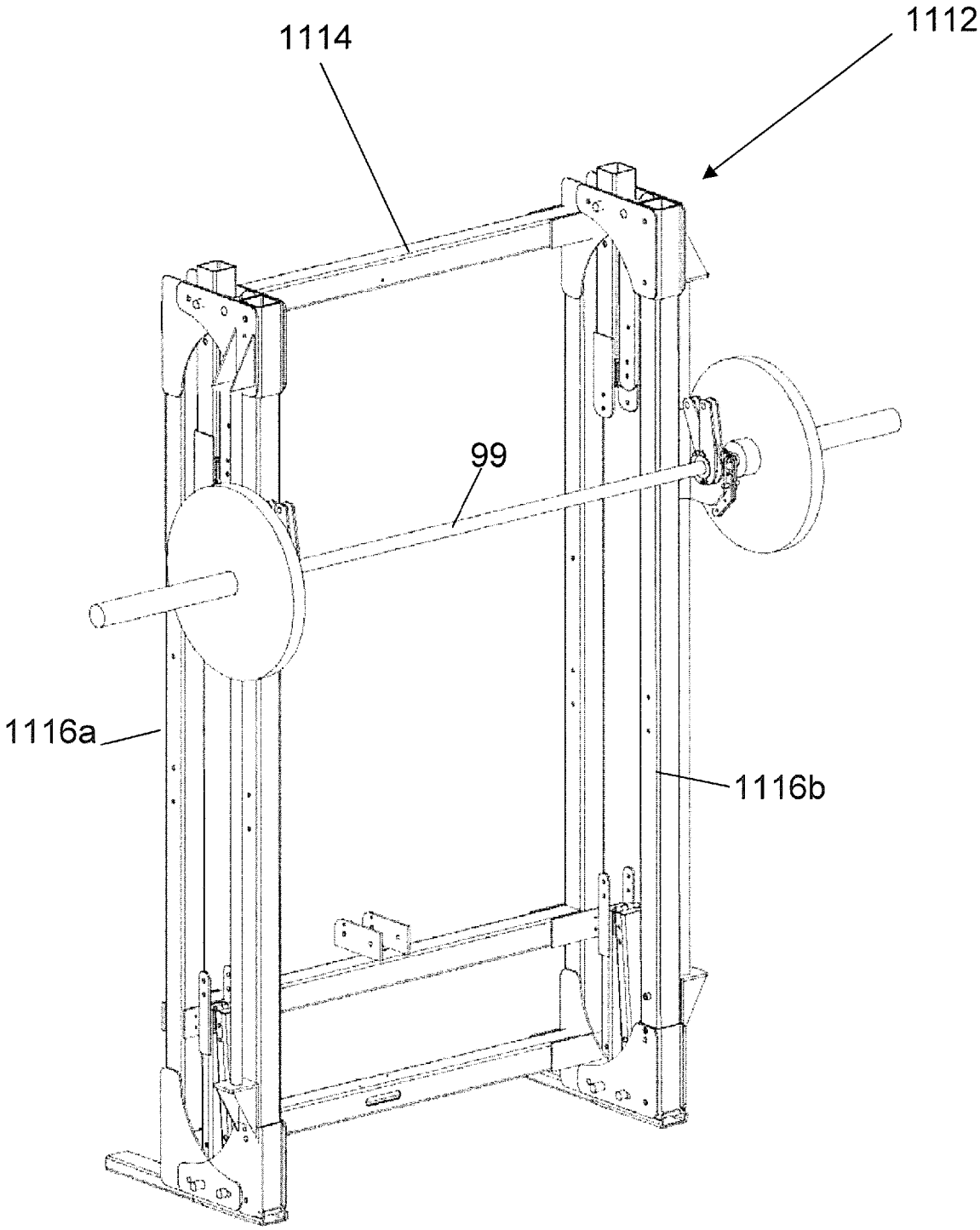

Smith machine functionality in a frame system reconfigurable to a compact format for storage can be achieved with folding side frame members that are pivotably attached to the rear frame member, such as is shown in FIGS. 10, 11A, 11B, 12A, 12B, 13 and 31-40, and with side frame members that telescope relative to the rear frame member, such as is shown, e.g., in FIGS. 8 and 9. Other frame system styles capable of a compact format can also be configured with Smith machine functionality, such as side frame members with hinged lateral members of the side frame members, e.g. as shown in FIGS. 41-43, and sliding lateral members of the rear and/or side frame members, e.g., as shown in FIGS. 44-47.

Figure 41:
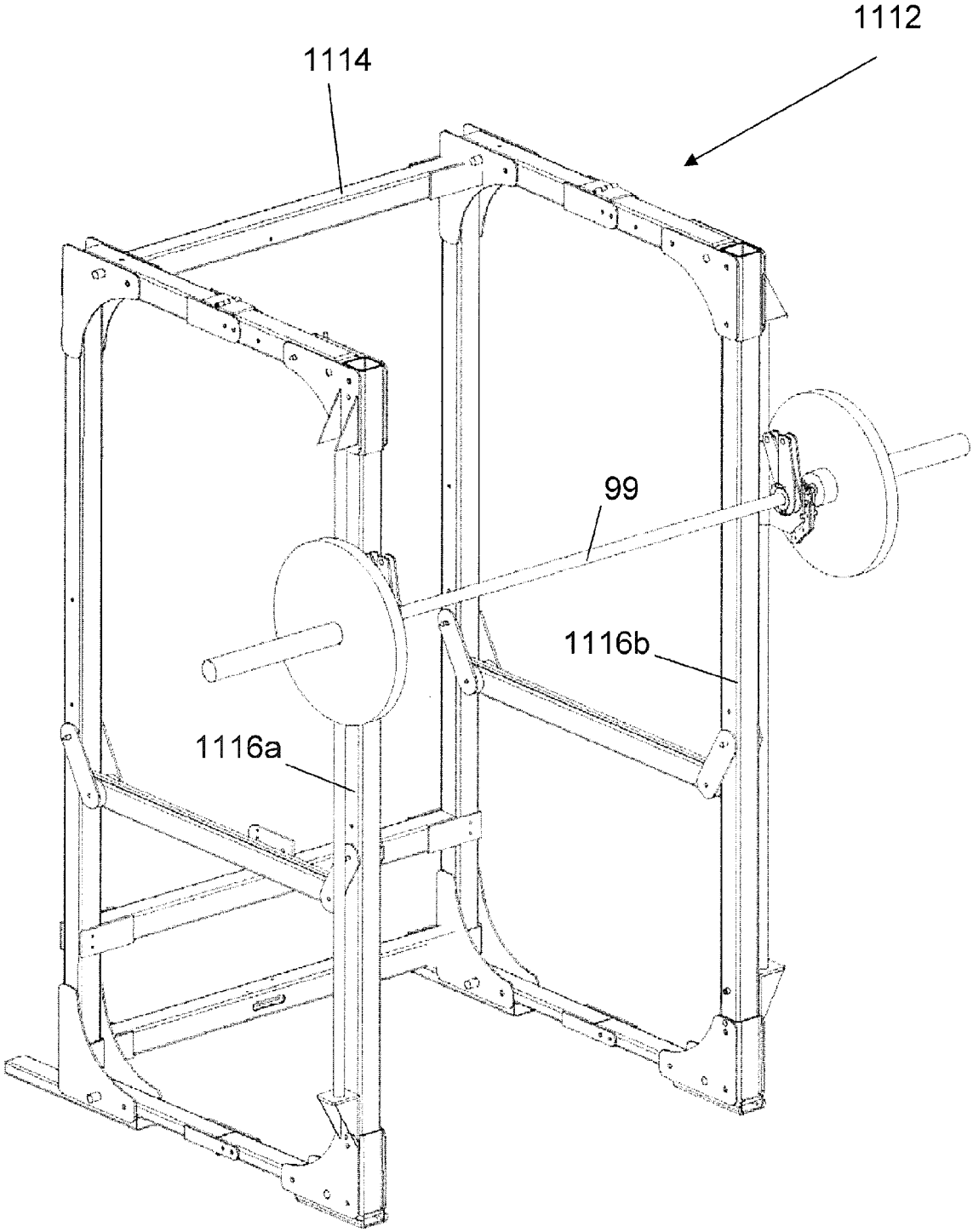
FIGS. 41-43 show a system in which the lateral members of the side frame members are hinged to allow for reconfiguring between compact and expanded positions.

FIG. 41 shows a frame system 1112 having a rear frame member 1114, with hinged lateral members of the side frame members 1116*a*, 1116*b* in its expanded position. FIG. 42 shows the frame system 1112 being repositioned from the expanded position to the compact position, which is shown in FIG. 43. As can be seen from the figures, the barbell 99 need not be removed to position the frame system 1112 in its compact position. If desired, the barbell 99 can be fixed to the holders to prevent easy removal of the barbell, i.e., without the use of tools, which may be advantageous in some situations, e.g., for safety and/or for security.

Figure 44:
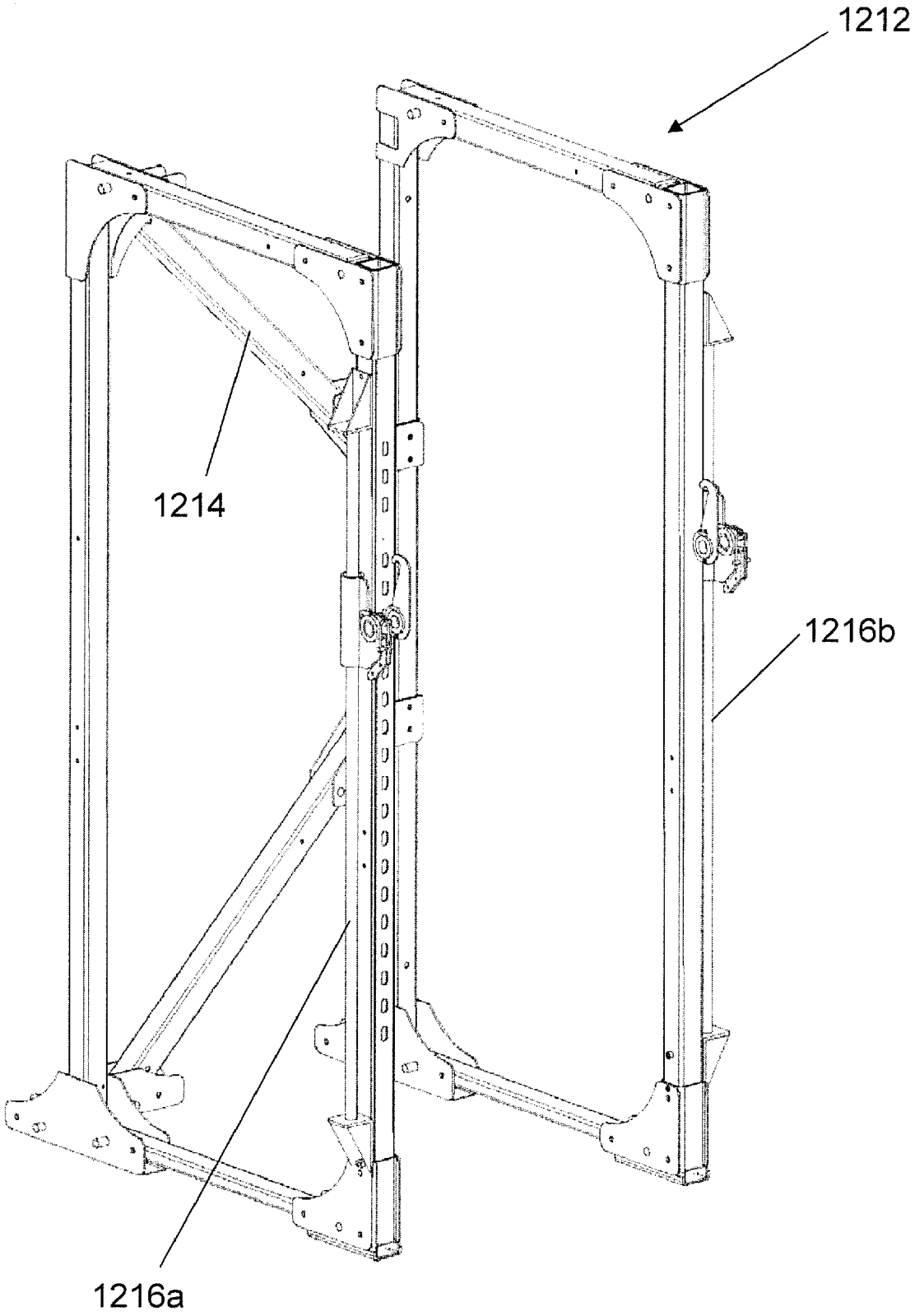
FIGS. 44 and 45 show a system in which the lateral members of the rear frame member are configured to translate for reconfiguring the system between compact and expanded positions.
Figure 45:
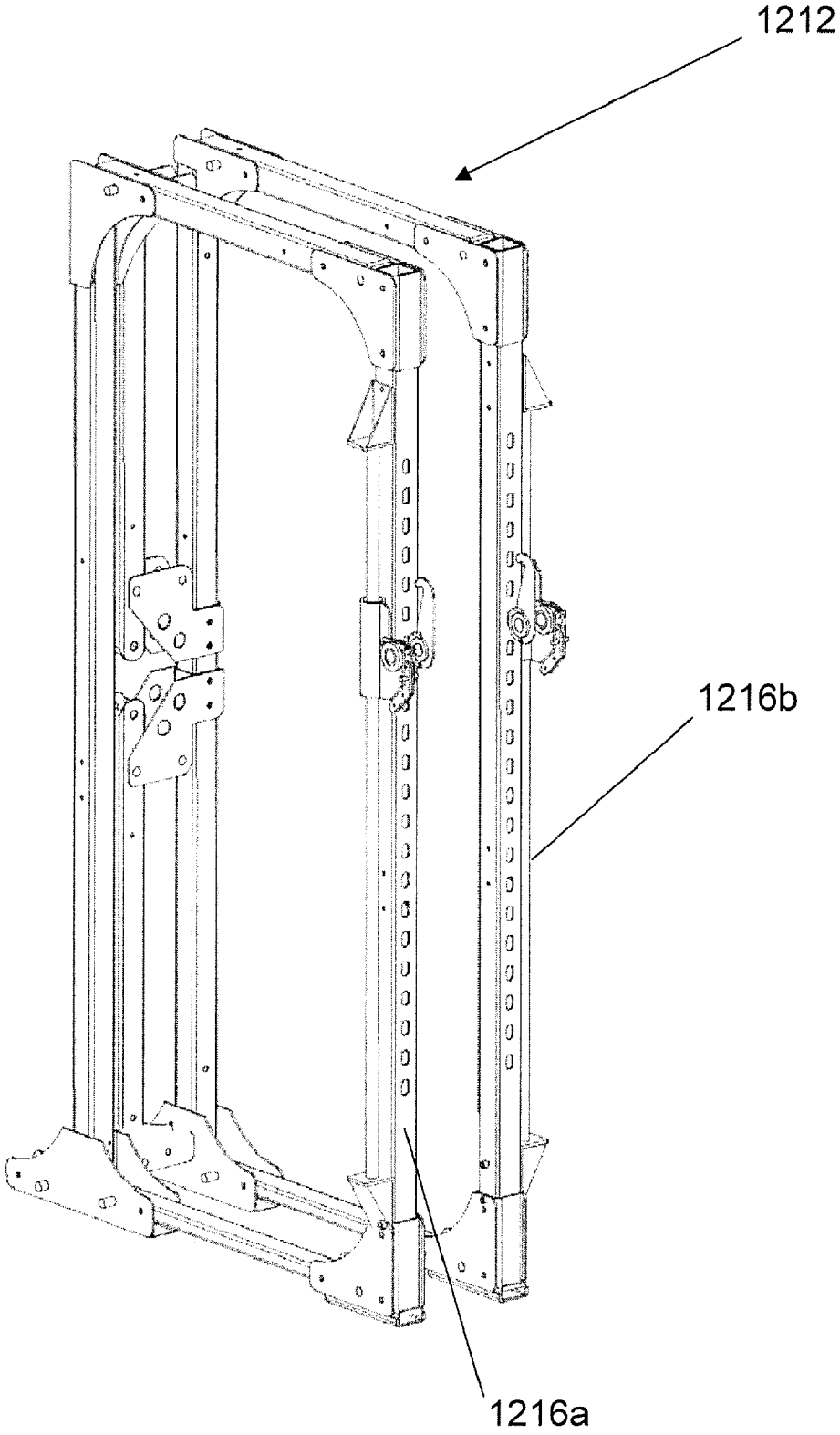
Figure 46:
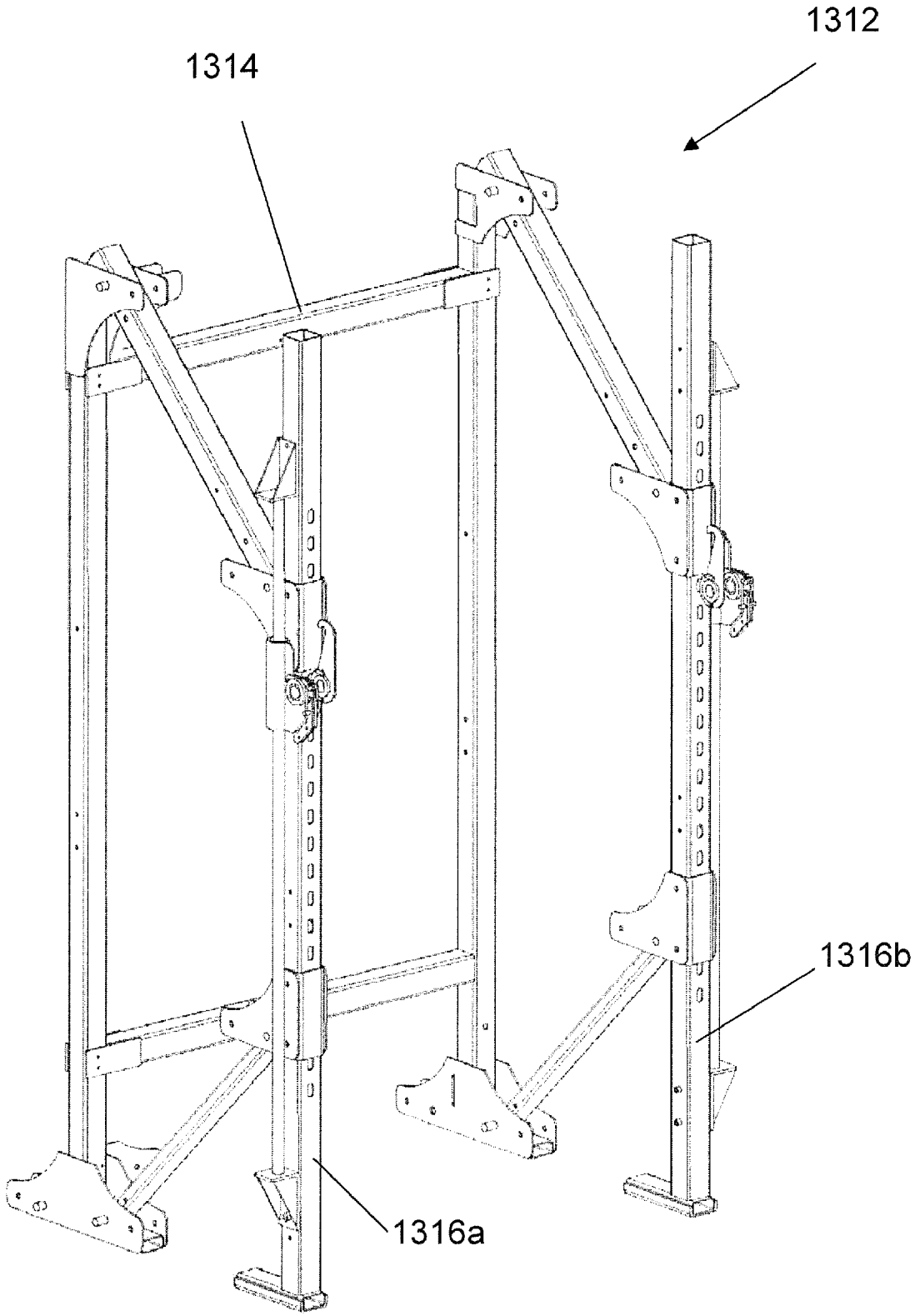
FIG. 46 shows a system in which the lateral members of the side frame members are configured to translate for reconfiguring the system between compact and expanded positions.
Figure 47:
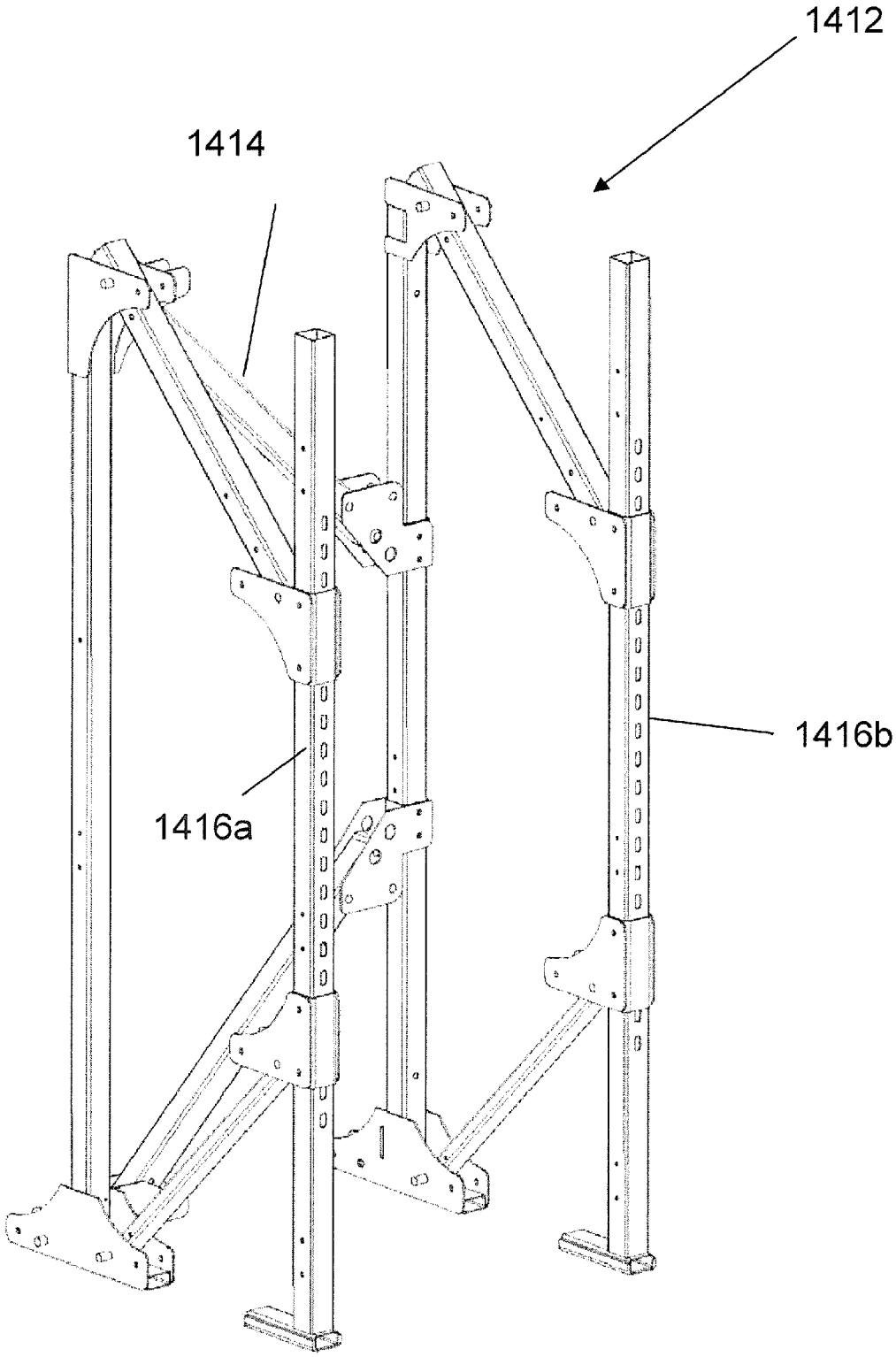
FIG. 47 shows a system in which the lateral members of both the side frame members and the rear frame member are configured to translate for reconfiguring the system between compact and expanded positions.

FIG. 44 shows a frame system 1212 with translating lateral members of the rear frame member 1214, which allow the side frame members 1216*a*, 1216*b* to translate towards each other to reposition the frame system in the compact position shown in FIG. 45. FIG. 46 shows a frame system 1312, having a rear frame member 1314, with translating lateral members of the side frame members 1316*a*, 1316*b*. FIG. 47 shows a frame system 1412 with translating lateral members in both the rear frame member 1414 and the side frame members 1416*a*, 1416*b*. The translating members may simply slide, or they may be fitted with small rollers that roll while the members are moved relative to each other.

In some implementations, e.g., as best shown in FIG. 5B, each pivoting side frame member has a locking pin or member (e.g., the left locking pin 43*a*) that is positioned closer to the end of the side frame member (e.g., the left side frame member 16*a*) than the pivot pin or member (e.g., the left pivot pin 41*a*). In other implementations, the pivot pin is positioned closer to the end of the side frame member than the locking pin.

For example, referring to FIG. 33, the left pivot pin 941*a* is positioned closer to the end of the left side frame members 916*a* than the left locking pin 943*a*. The right side is configured in a similar manner.

Figure 5C:
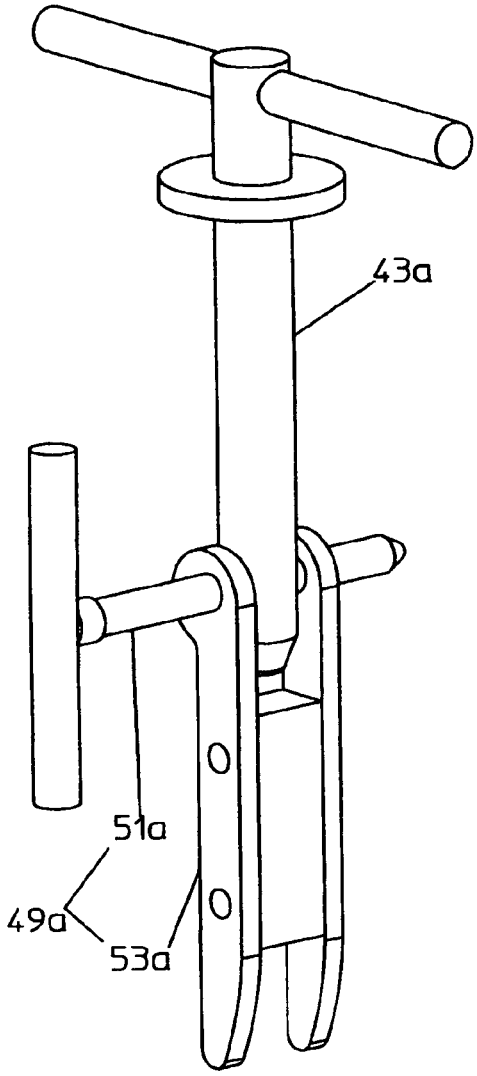
FIGS. 5C and 5D are perspective enlarged views of a locking pivot for the side frame members, which is shown in disengaged and engaged positions, respectively.
Figure 5D:
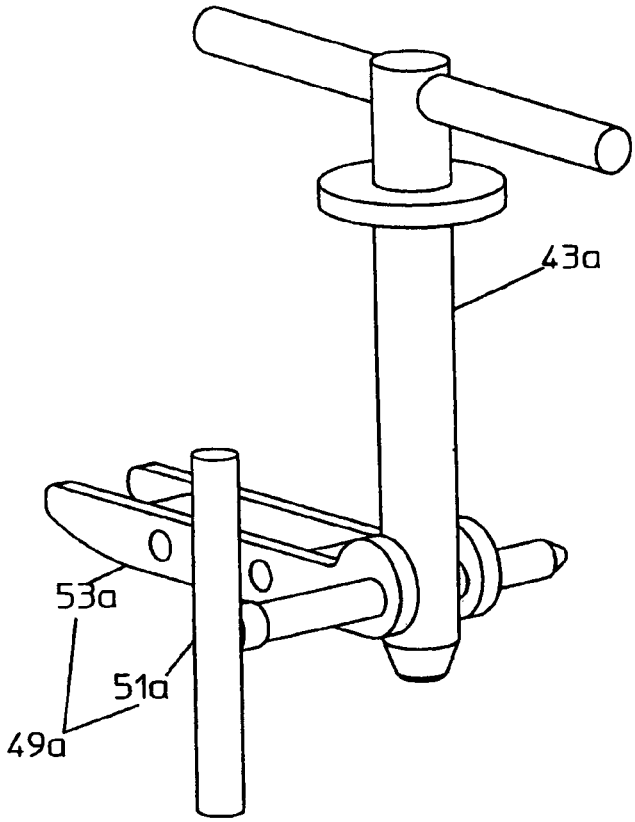
Figure 48:
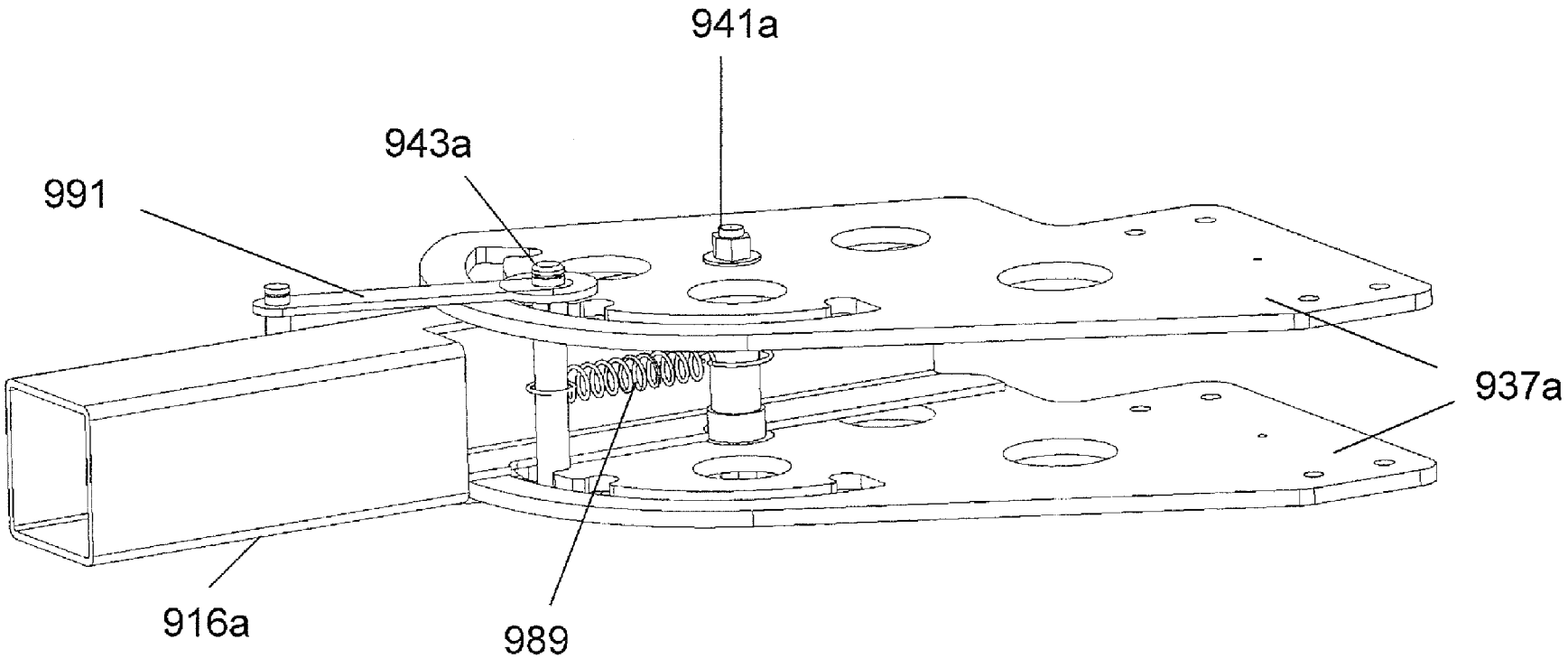
FIGS. 48 and 49 show alternative pivot pin and locking pin arrangements for allowing the side frame members to be pivoted to and retained in desired positions relative to the rear frame member.
Figure 49:
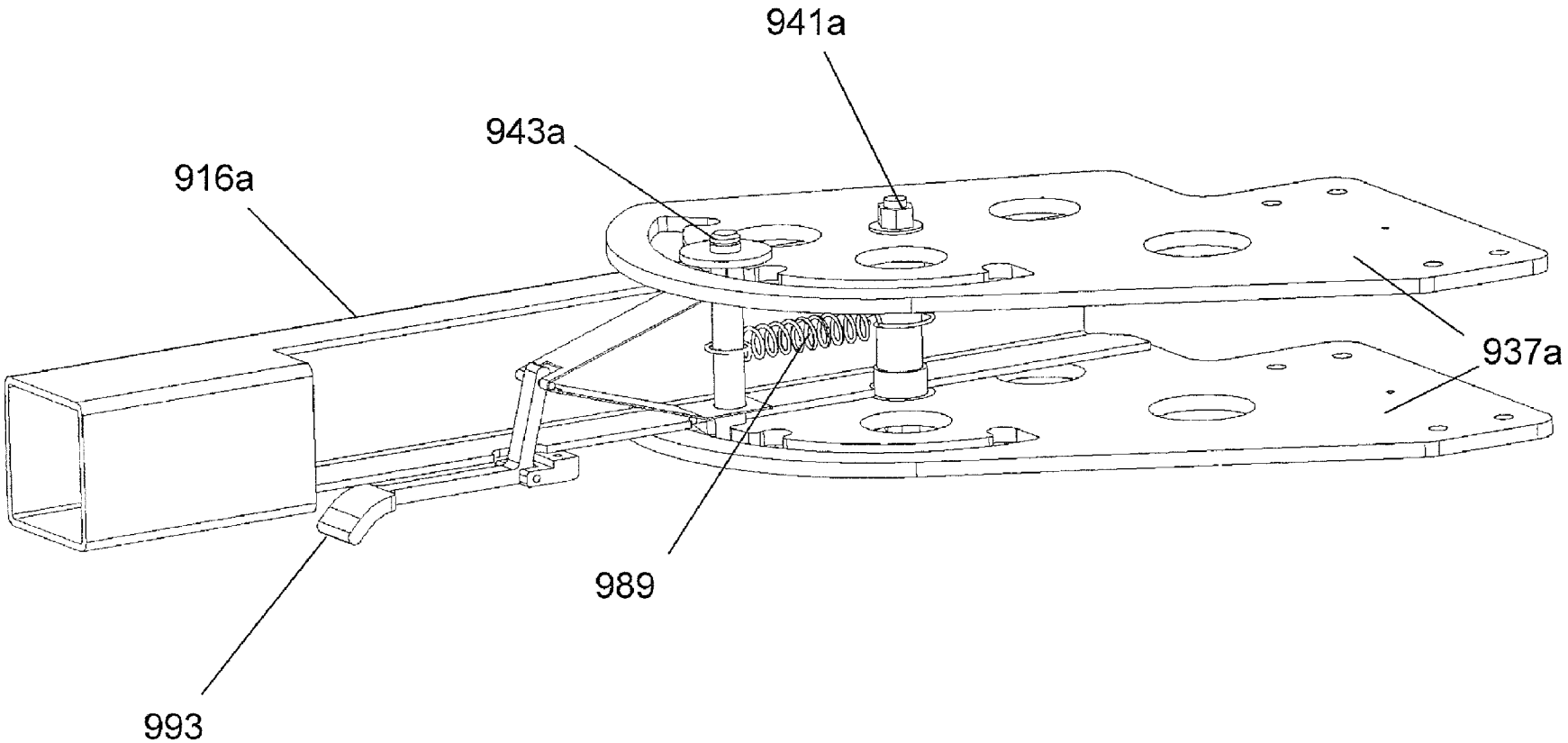

In addition to the locking pin 43*a* shown in FIGS. 5C and 5D, which is vertically or axially inserted into and removed from aligned openings in the side frame member 16*a* and the plate 37*a*, other types of locking members can be used. For example, as shown in FIG. 48, the locking pin 943*a* is moved generally horizontally into and out of engagement with openings in the frame member 916*a* and plate 937*a*. The locking pin 943*a* can be biased to retain it in its locked position, e.g., such as by a spring 989 connected between the pivot pin 941*a* and the locking pin 943*a*, as shown in FIGS. 48 and 49.

The locking pins may be actuated, i.e., pulled against the bias of the spring and out of engagement with the slot or slots in the plate(s) to allow the frame members to be pivoted about the pivot pins, in any suitable way. For example, the locking pin 943*a* may have an attached handle 991 (as shown, e.g., in FIGS. 35 and 48) or an attached lever 993 (FIG. 49).

Smith Machine with Dynamic Lifting Axis

In the embodiments described above, the implementation of Smith machine functionality is described for systems with a generally static lifting axis (or matched pair of lifting axes). The lifting axis is defined as the direction along which the load is constrained to move during a lift. A static lifting axis remains substantially stationary during lifting. As one example, referring to FIG. 8, the static lifting axis as defined by the rods 182*a*, 182*b* is substantially vertical. Although not shown, it is also possible to have the static lifting axis positioned at a slight angle (e.g., up to about 15 degrees from vertical).

Providing a system with Smith machine functionality in which the lifting axis is dynamic rather than fixed widens the range of available exercises and allows the system to accommodate users over greater ranges in size, strength and flexibility. One example of a system with Smith machine functionality and having a dynamic lifting axis is U.S. Pat. No. 5,215,510. This patent shows vertical guiding members (defining a primary vertical lifting axis) that are free to translate at their ends along horizontal guiding members (defining a secondary horizontal lifting axis). During a lift, the axis is dynamic, i.e., the guiding member that defines the axis is allowed to move and is not constrained to be stationary. Although this configuration provides some of the advantages of a dynamic lifting axis, the lifting axes are strictly vertical and strictly horizontal, both ends of the vertical guiding members are constrained, and the system cannot be reconfigured for compact storage.

According to the new approaches described herein, Smith machine functionality with dynamic lifting axes is achieved using upright guide members having one end that is free to translate and an opposite end that is fixed from translating. These upright guide members can be used when the frame system is positioned with its side frame members extending perpendicular to the rear frame member, or with the side frame members extending at angles other than 90 degrees. Also, the frame system can be reconfigured to a compact position.

The end of each guide member that is fixed from translating may be pivotable in one, two or three directions. For example, as shown in the side views of a frame system 5000 illustrated in FIGS. 50A, 50B and 50C, the lower ends of the guide members may be pivotably connected to the frame system, thus allowing the free upper ends to translate. Although not shown, it would also be possible to have the upper ends of the guide members pivotably connected and to leave the lower ends free to translate.

Figure 50C:
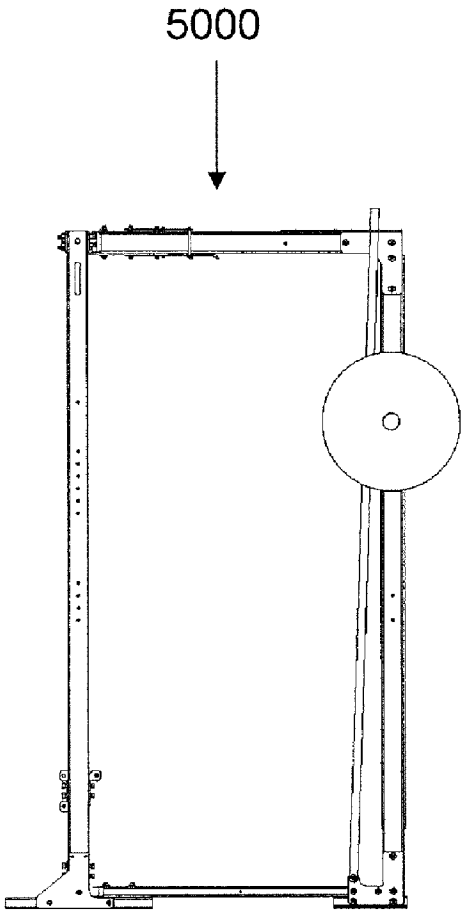
FIGS. 50A, 50B and 50C are side elevational views of a frame system in which the upright barbell guiding members are movable during lifting thereby defining dynamic lifting axes.
Figure 50B:
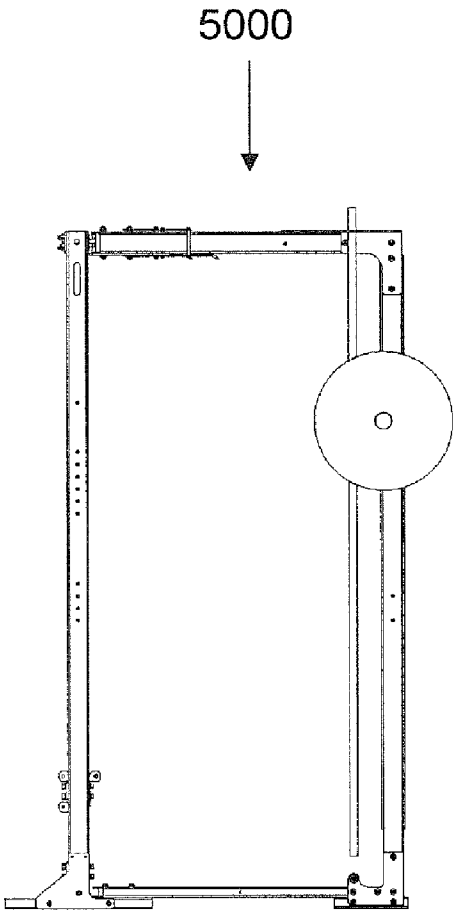
Figure 50A:
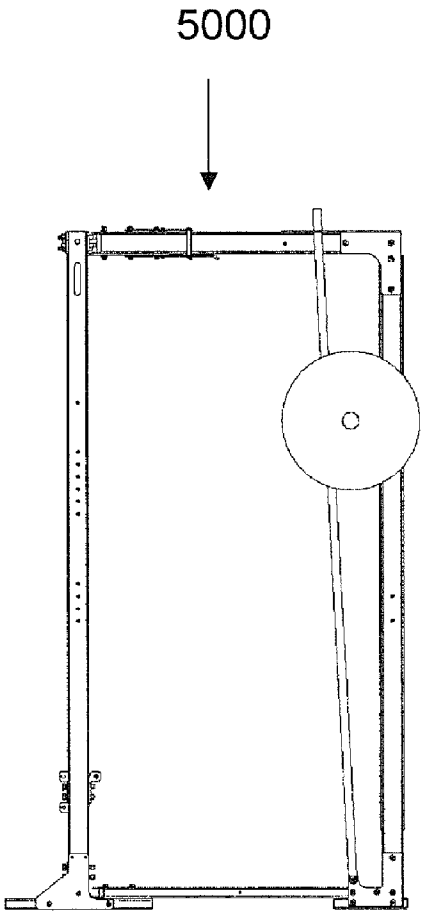

FIG. 50A shows the guide member pivoted rearwardly, FIG. 50B shows the guide member in a generally vertical position, and FIG. 50C shows the guide member pivoted rearwardly. The range over which the upper ends of the guide members may translate can be limited as desired, e.g., by using stops or openings through which the guide members project, as is described below in more detail.

As indicated, the lower ends of the guide members can be fixed from translating, but can be pivotable in more than one direction, i.e., pivotable about multiple mutually perpendicular axes. During lifting, this additional freedom of motion may require use of secondary muscles to stabilize the movement that otherwise may not be challenged in use of a typical Smith machine, yet the guide members still provide the safety of guided movement of the barbell. It bears noting that this overall additional freedom of motion is produced even when each of the various axes of rotation provides only slight freedom of rotation.

In the embodiment of FIGS. 50A, 50B and 50C, each guide member is restricted to pivoting in a single plane, i.e., pivoting in a vertical plane parallel to the respective side frame members. In the embodiment of FIGS. 51-58, however, the lower ends of the guide members are coupled to the frame by a "multiply pivotable connection," i.e., a connection that allows pivoting about at least two mutually perpendicular axes.

Figure 51:
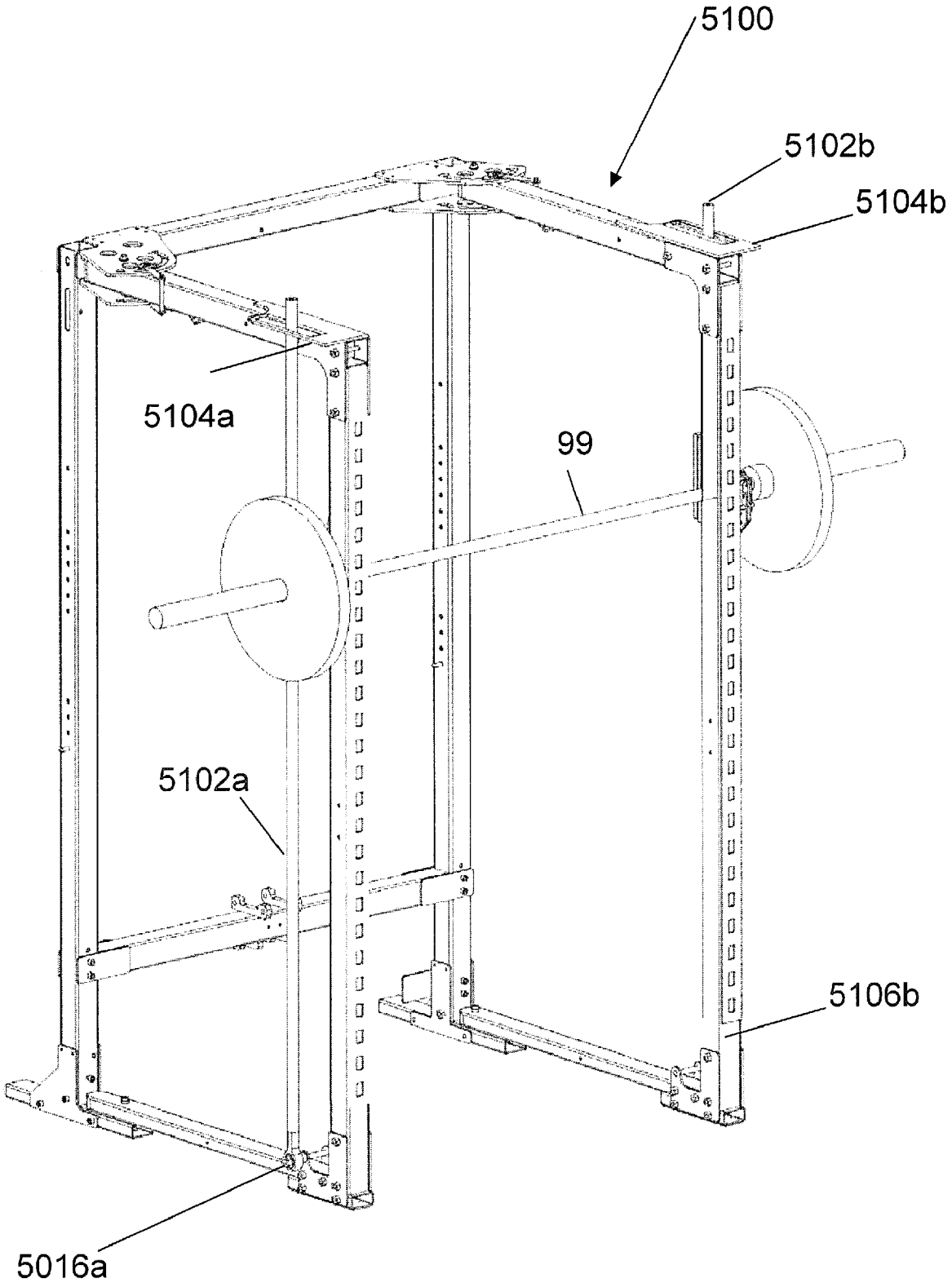
FIG. 51 is a perspective view of a frame system with movable upright barbell guiding members that have three-axis multiply pivotable connections at their lower ends.

FIG. 51 is a perspective view of a frame system 5100 showing guide members 5102*a*, 5102*b* in a substantially vertical position with their upper ends protruding through guide openings 5104*a*, 5104*b* and their lower ends 5106*a*, 5106*b* coupled at multiply pivotable connections.

Figure 52:
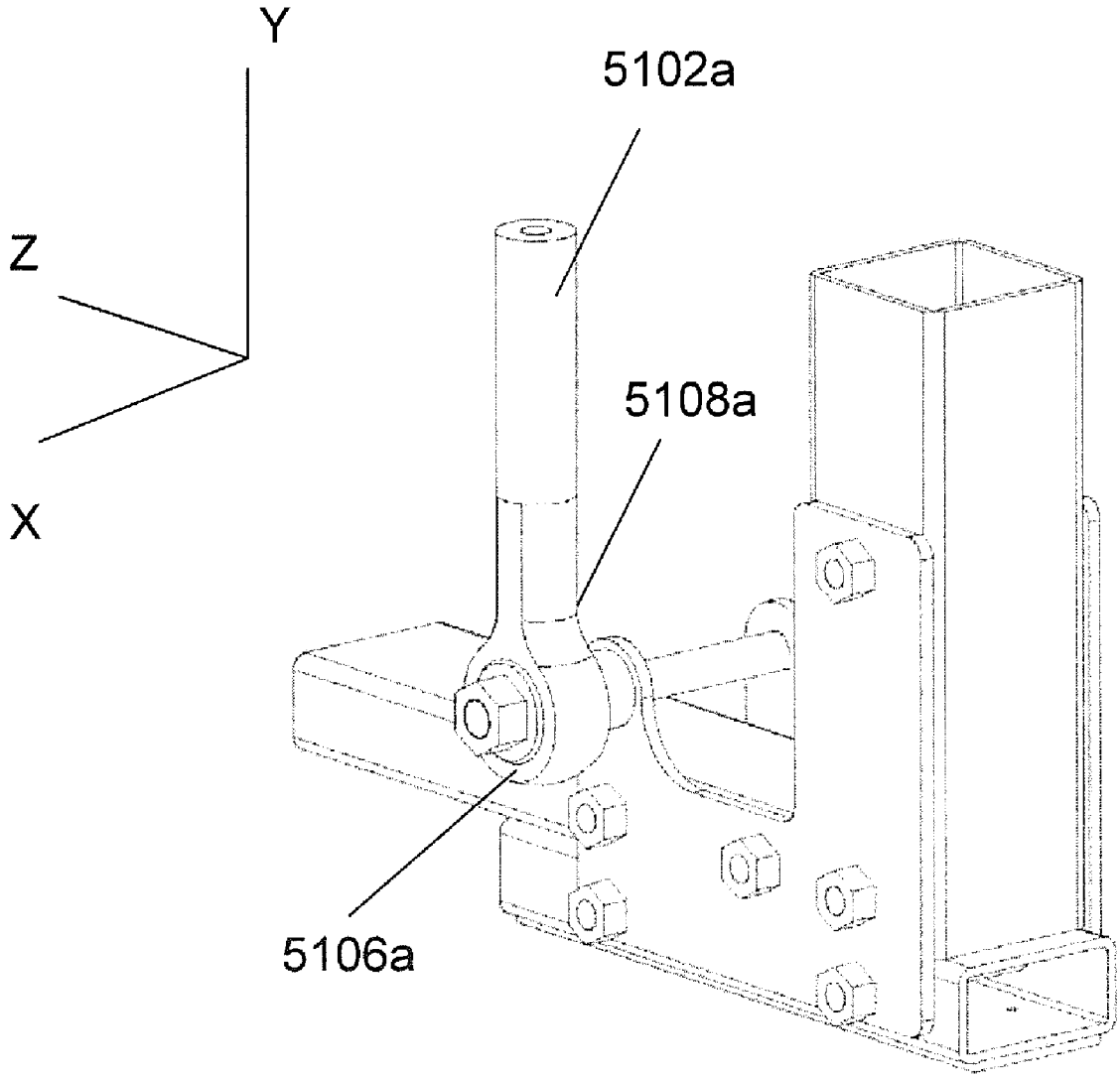
FIG. 52 is a magnified view of a lower left corner portion of the frame system shown in FIG. 51.

FIG. 52 is a detailed view of an exemplary multiply pivotable connection 5108*a* at the lower left side of the frame system. In this specific example, the multiply pivotable connection 5108*a* provides for rotation about three mutually perpendicular axes, i.e. the X, Y and Z axes as shown. The range of available rotation, e.g., before mechanical interference occurs, may be limited, but even a small range of a few degrees is sufficient to cause the user to experience forces in multiple directions simultaneously.

Figure 53:
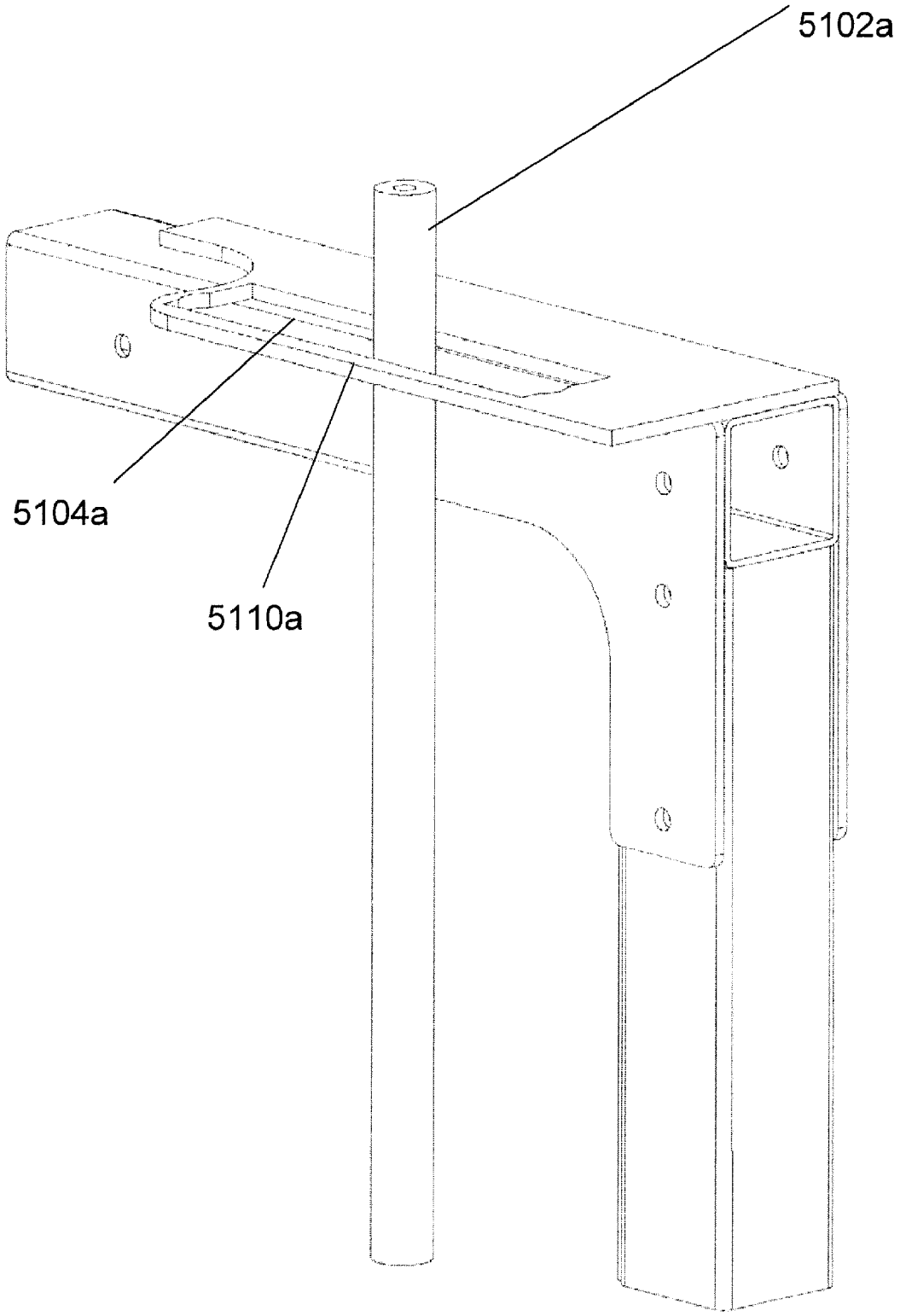
FIG. 53 is a magnified view of an upper left corner portion of the frame system shown in FIG. 51.

FIG. 53 is a detailed view of the upper left side of the frame system showing the guide member 5102*a* protruding through the guide opening 5104*a* in a guide plate 5110*a*. As can be seen in FIG. 53, the guide opening 5104*a* can be dimensioned in the forward and rearward and in the side to side directions to allow as much movement of the guide member 5102*a* as is desired. As illustrated, the size of the guide openings has been exaggerated for clarity. In practice, sufficient translation of the upper ends of the guide members may be achieved with guide openings that are only minimally larger than the guide members.

Figure 54:
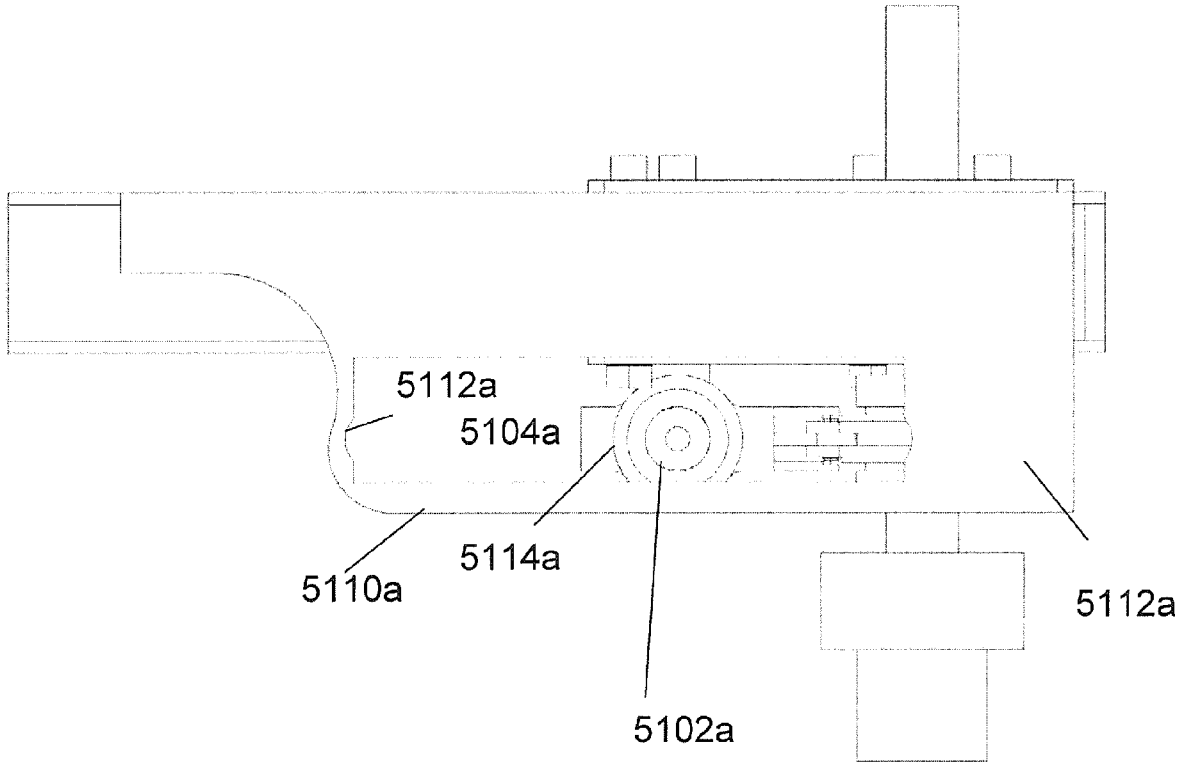
FIG. 54 is a top plan view of the upper left corner portion shown in FIG. 53.

FIG. 54 is a top view of the upper right corner of the frame system. As shown in FIG. 54, the guide plate 5110*a* can also be shaped with cutouts 5112*a* at either end that tend to keep the guide member in a vertical orientation when it is positioned at either end.

With a multiply pivotable connection at one end of each guide member, the resulting linkage comprised of the left guide member linked to the barbell via a standard holder, and the other end of the barbell linked to the right guide member via a standard holder, causes one degree of freedom to be lost or at least reduced because the standard holders are restricted to translation along the guide members and rotation about the guide members. The resulting configuration may still be advantageous for some situations. In other situations, however, it is desirable to maintain the additional freedom of rotation provided by the multiply pivotable connection by modifying the barbell holders.

Figure 55:
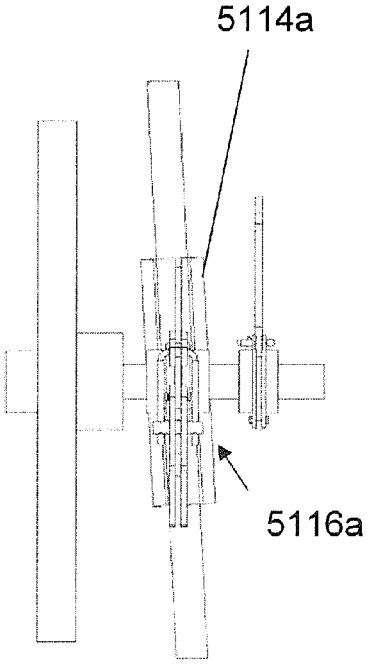
FIGS. 55, 56 and 57 are front side elevational views showing a left side portion of a barbell secured in a holder mounted on a guiding member, the holder having a pivot connection providing additional freedom of movement to allow the barbell to be lifted vertically if the guide members are angled to one side or the other.
Figure 56:
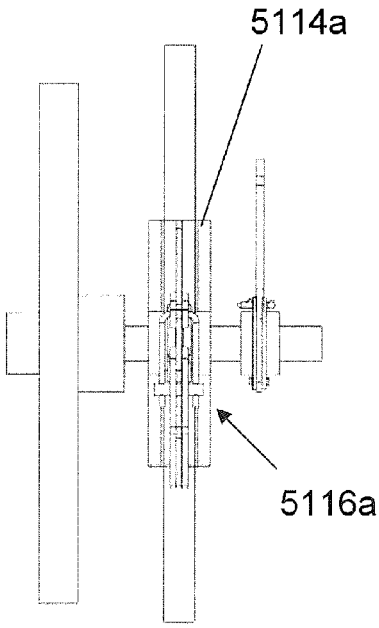
Figure 57:
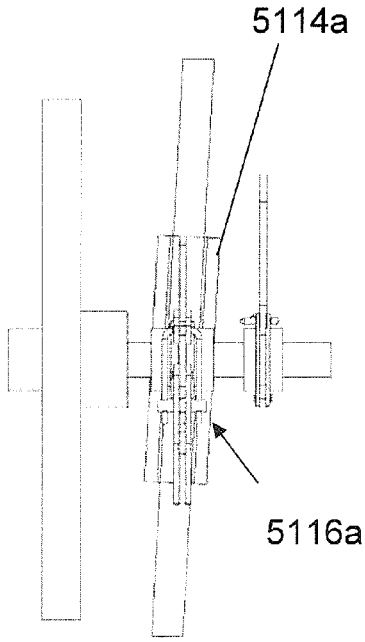
Figure 60:
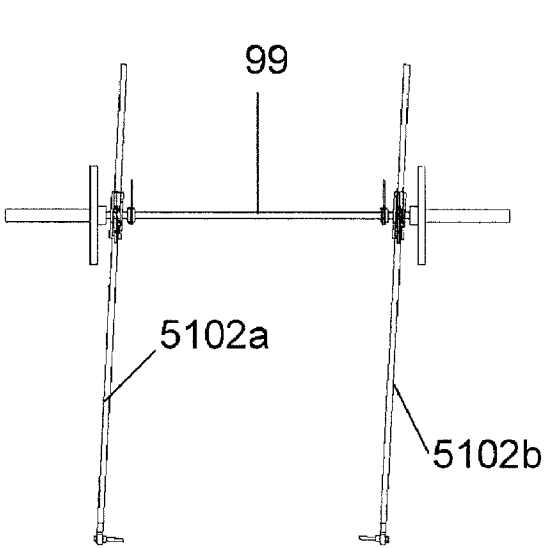
FIGS. 58, 59 and 60 are diagrammatic views showing the side to side movement in the guide members, which has been exaggerated for clarity, as provided by the multiply pivotable connections at their lower ends.
Figure 59:
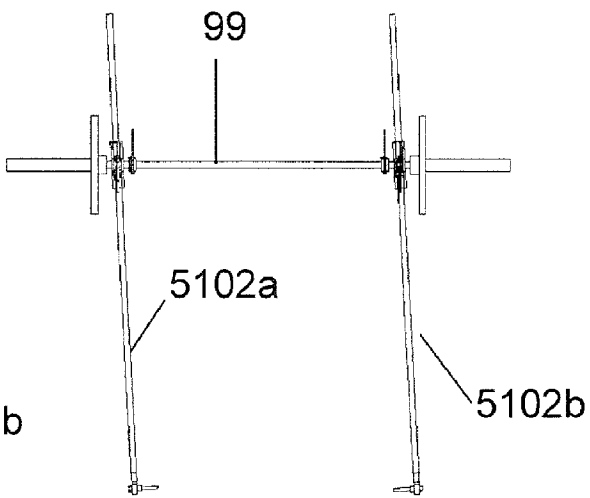
Figure 58:
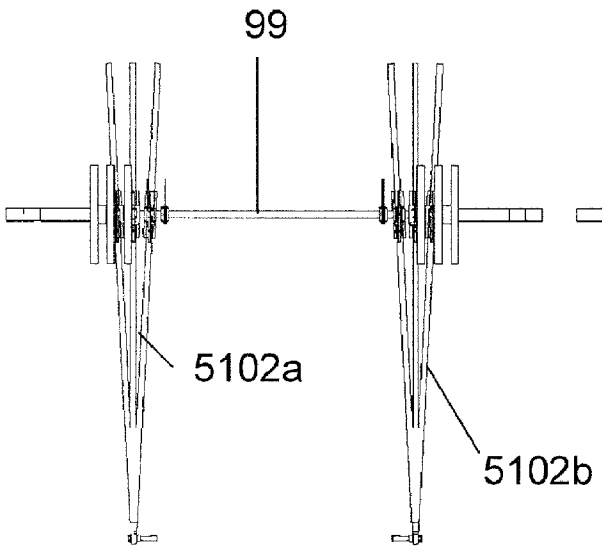

According to one approach, the holders can be modified to provide additional freedom of movement as shown in FIGS. 58-60, which show the barbell 99 being kept level while the guide members 5102*a*, 5102*b* are angled to the left, kept vertical or angled to the right. As one example, holders 5114*a*, 5114*b* as best shown in FIGS. 55-57 can have respective pivoting joints 5116*a*, 5116*b*. The pivoting joints 5116*a*, 5116*b* allow portions of the holder to pivot relative to each other about an axis normal to the guide member so that the user must strive to keep the barbell 99 level during the lift even as the guide members 5102*a*, 5102*b* are free to move in the side to side and forward to rearward directions.

Overall, the resulting linkage still serves to assist the user in guiding the barbell during lifting. With the appropriate modifications, such as the use of range limiting structures and adjustments to the fit between the components of the linkage, the degree of guiding assistance provided to the user can be varied between slightly less assistance than a standard Smith machine to slightly greater assistance than a free lift.

Figure 61:
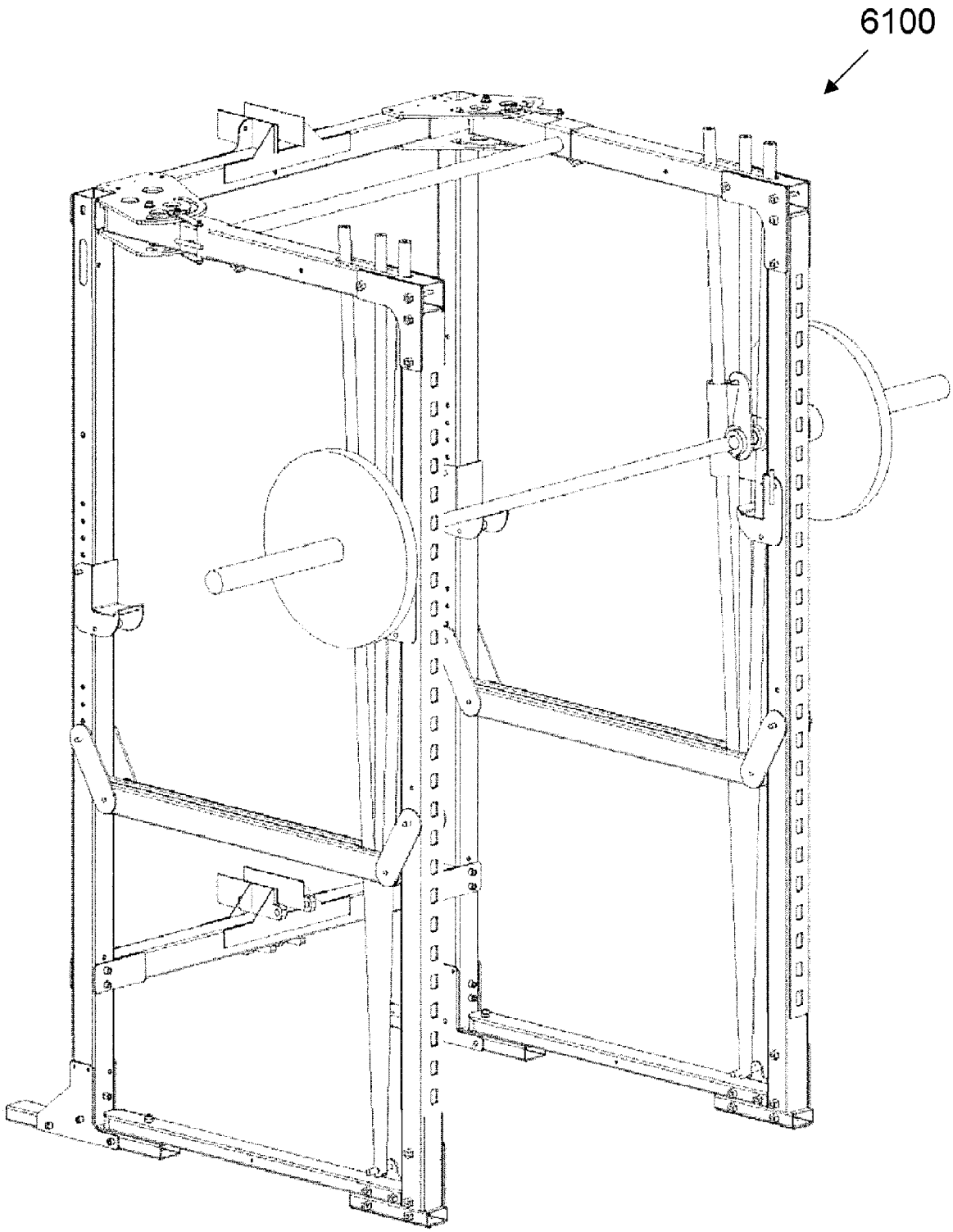
FIG. 61 is a perspective view of another frame system in which the upright guide members are free to move within openings defined in the upper lateral members and the safety bars.

Although the guide plates 5110*a*, 5110*b* are shown extending to the outside of the frame member (see, e.g., FIG. 51), they can of course be mounted to extend to the inside (not shown). Also, it is possible to have the guide members 5102*a*, 5102*b* extend in generally the same plane of the side frame members, with appropriate openings in the safety bars, as is shown for a frame system 6100 illustrated in FIG. 61.

Multi-Position Carriage System

Figure 28A:
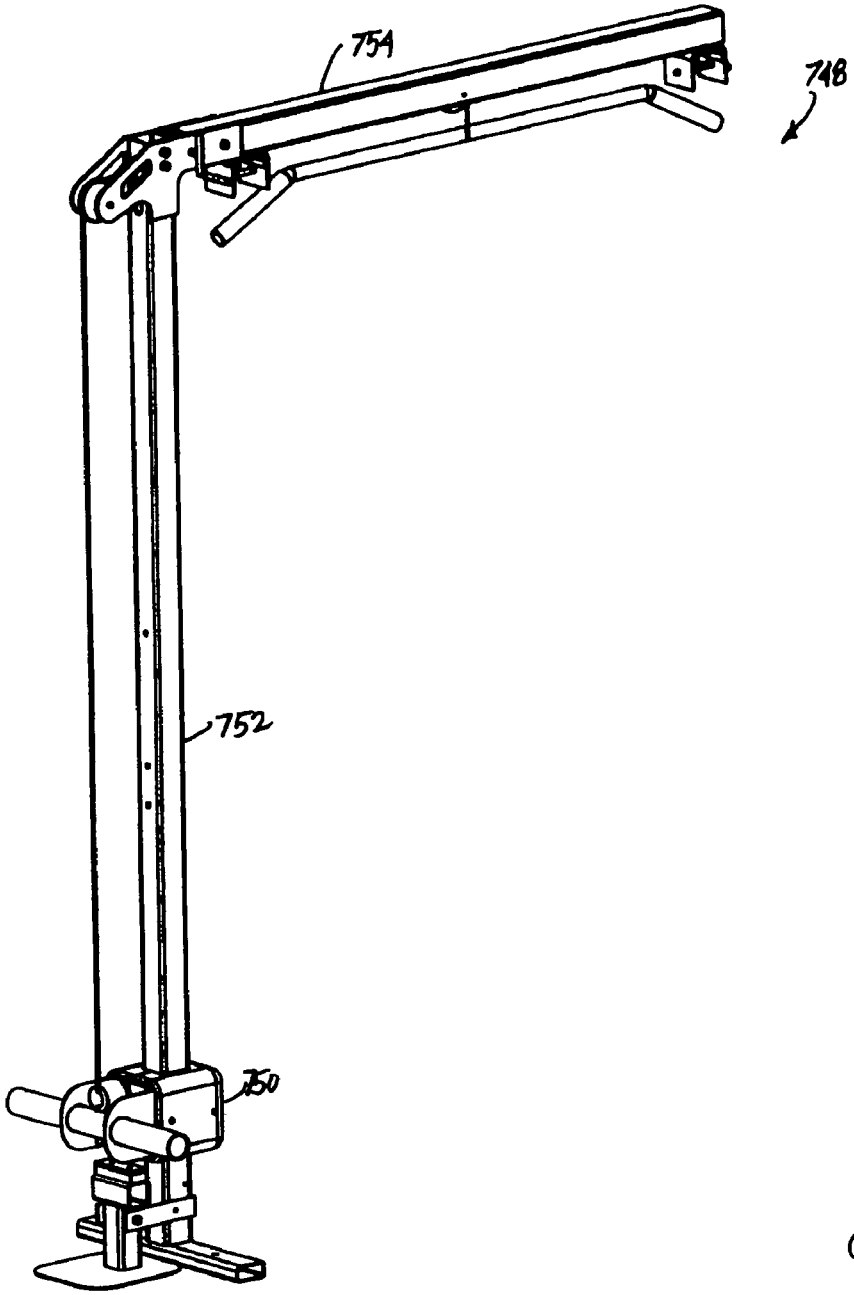
FIGS. 28A and 28B are perspective views, in open and compact states, respectively, of a multi-position vertical carriage attachment suitable for use with the safety cage system.
Figure 28B:
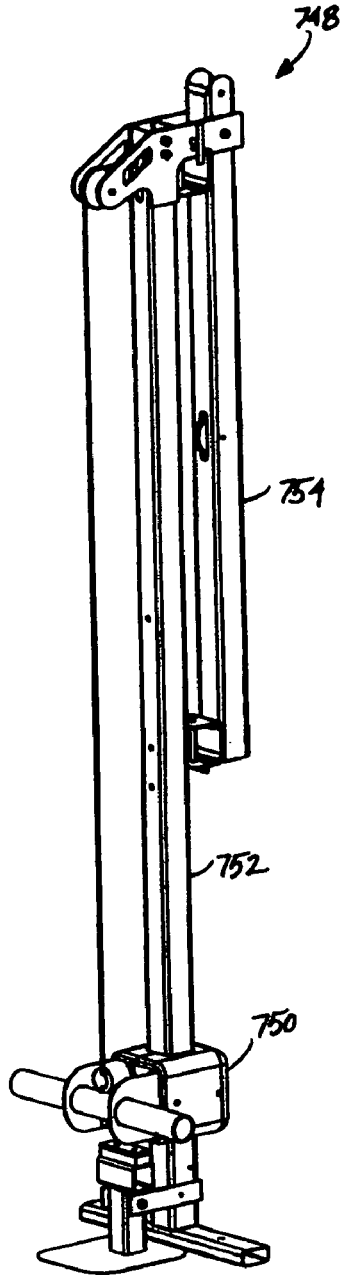
Figure 29:
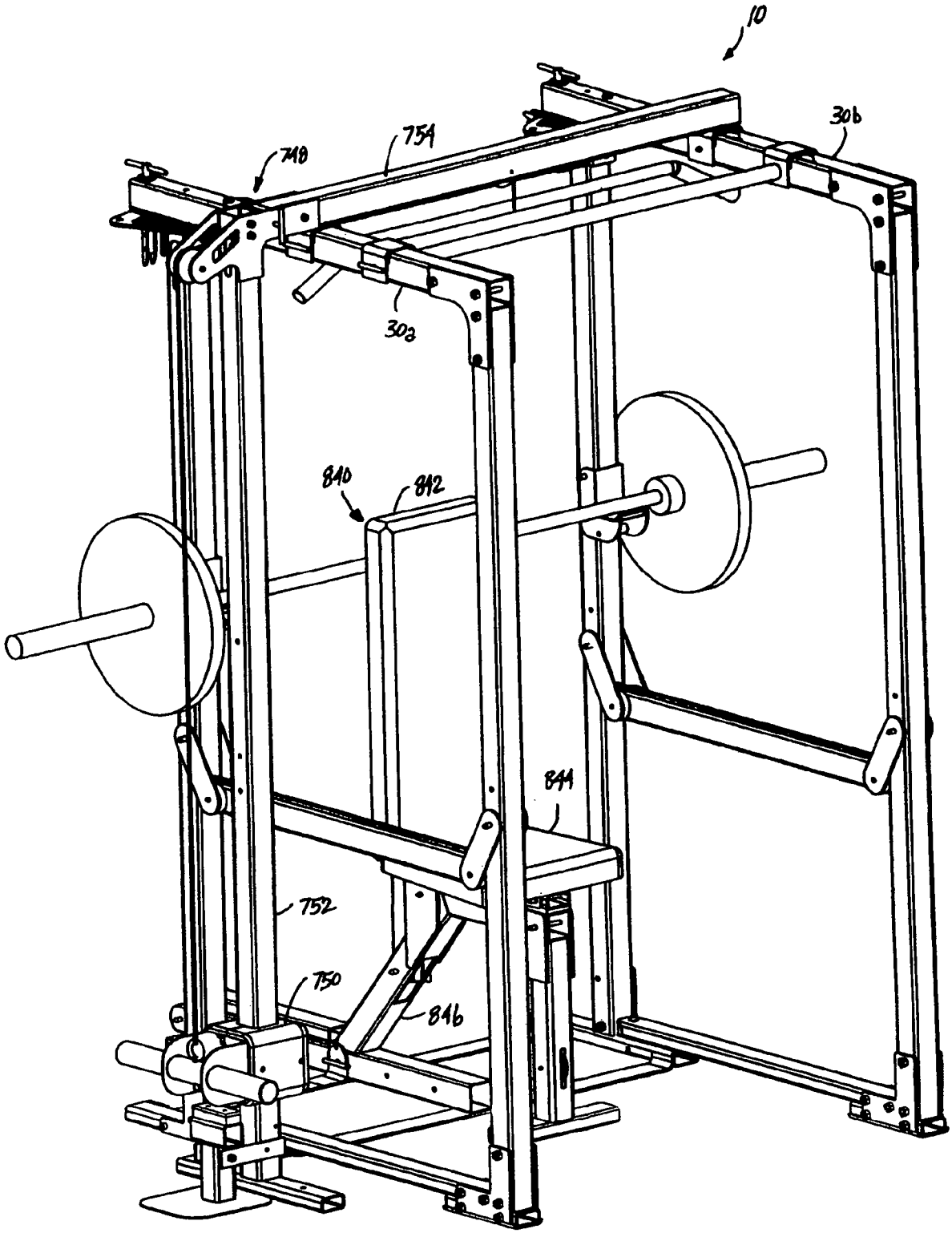
FIG. 29 is a perspective view similar to FIG. 1, except that the modified bench is shown in a rearward position with the rear portion in an upright position and a multi-position vertical carriage is shown secured in place to the safety cage.

The multi-position carriage system 748 shown in FIGS. 28A-29 is another cable supported rolling weight arrangement similar to the carriage 50 described above in connection with FIG. 1. With the system 748, the position of the carriage 750 can be selectively set along the length of the upper lateral members 30*a*, 30*b*. As a result, the point at which the cable extends downwardly can be moved to a position that is more centrally located within the safety cage 12.

As shown in FIGS. 28A-29, the carriage system 748 includes the carriage 750, the upright member 752 over which the carriage travels, and a lateral member 754 pivotably attached to the upper end of the upright, together with the associated cable and hardware. In operation, the lateral member 754 is extended as shown in FIG. 28A, and the system 748 is secured in place (e.g., with pins), such as in the position shown in FIG. 29. The carriage 750 can then be loaded with weights and used similar to the carriage 50.

The system 748 is removable, e.g., when not in use or for storage, and the lateral member 754 can be pivoted against the upright member, as shown in FIG. 28B.

The carriage system 748 may be available as an optional accessory for a safety cage that is not fitted with the carriage 50.

Optional Accessories

As shown, e.g., in FIG. 1, any of the various systems described above may include an optional overhead bar 48 that is coupled at its ends to the upper lateral members 30*a* and 30*b*, respectively. The overhead bar 48 may be used, e.g., to perform chin-up and/or pull-up exercises.

Figure 6B:
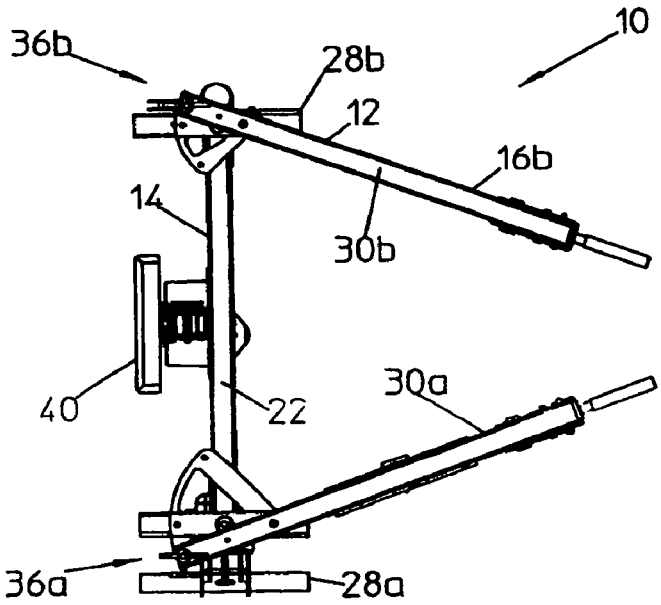
FIG. 6B is a plan view of the compact weight lifting system of FIG. 6A, except showing the dip handles positioned to extend outward from the rear frame member.

As shown in FIGS. 6A and 6B, the described systems may include optional dip handles 71*a*, 71*b* removably attached to the front uprights 34*a*, 34*b*, respectively. These handles may be grasped by the user to perform, e.g., dip exercises. The handles 71*a*, 71*b* may be attached to extend toward the inside of the safety cage 12 (FIG. 6A) or toward the outside of the safety cage (FIG. 6B).

Referring to FIG. 1, a pair of barbell holders 73*a*, 73*b* can be removably attached to the rear uprights 20*a*, 20*b*, respectively, to face the interior of the safety cage, or attached to the front uprights 34*a*, 34*b* to face the interior of the cage or away from the interior (FIG. 2).

A pair of foot loops 98 can be attached to the safety cage to assist a user in performing, e.g., sit-up exercises. As shown in FIG. 1, the foot loops can be attached to the lower lateral member 32*a*.

As shown in FIG. 4, the system 10 may include one or more lanyards 151 suited for securing the folded safety cage 12 to a nearby structure, e.g., a wall, to prevent it from tipping over if jarred.

Figure 10:
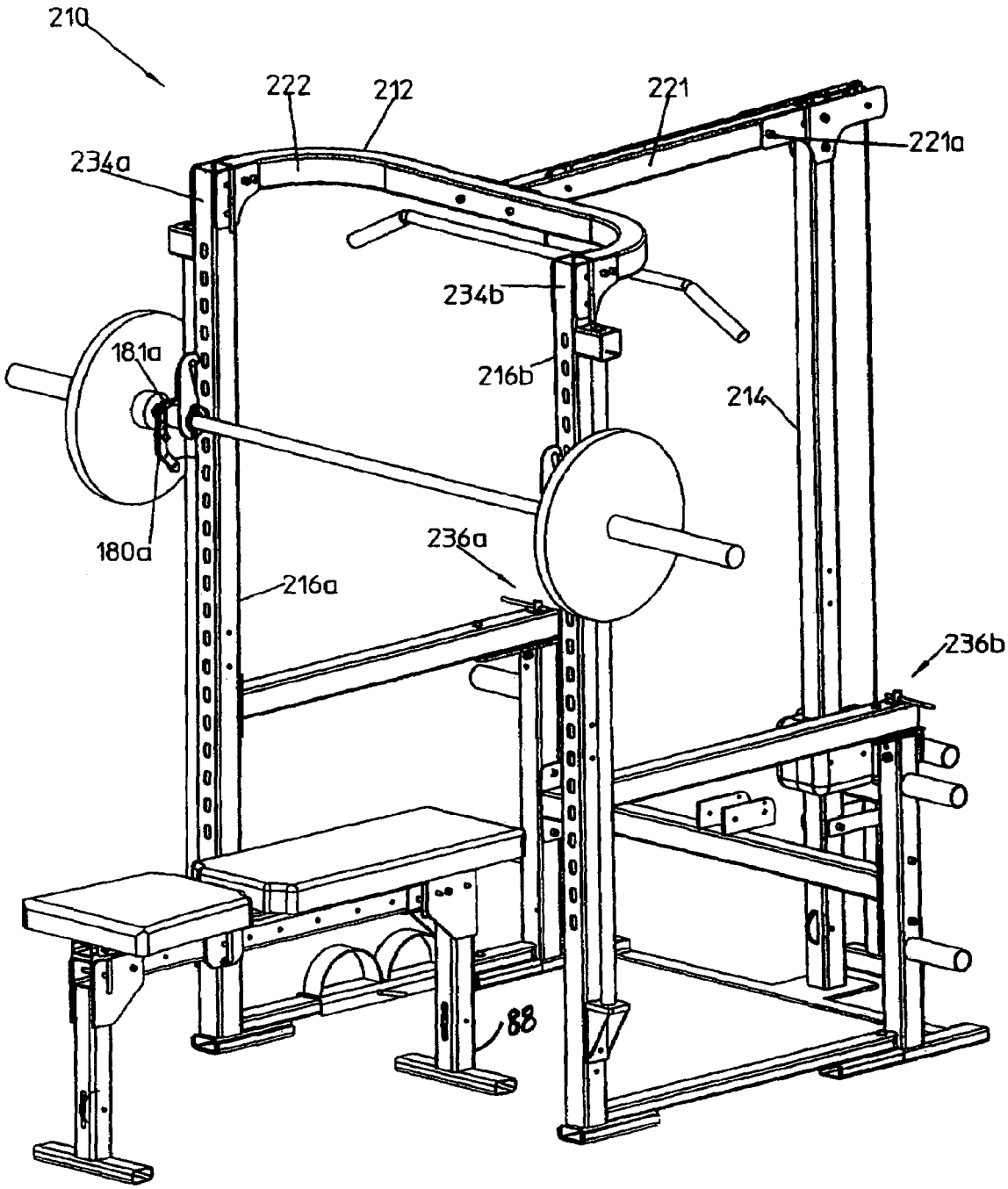
FIG. 10 is a perspective view of another system with a safety cage having a single upright rear frame member similar to the second embodiment and pivoting side frame members similar to the first embodiment.
Figure 11B:
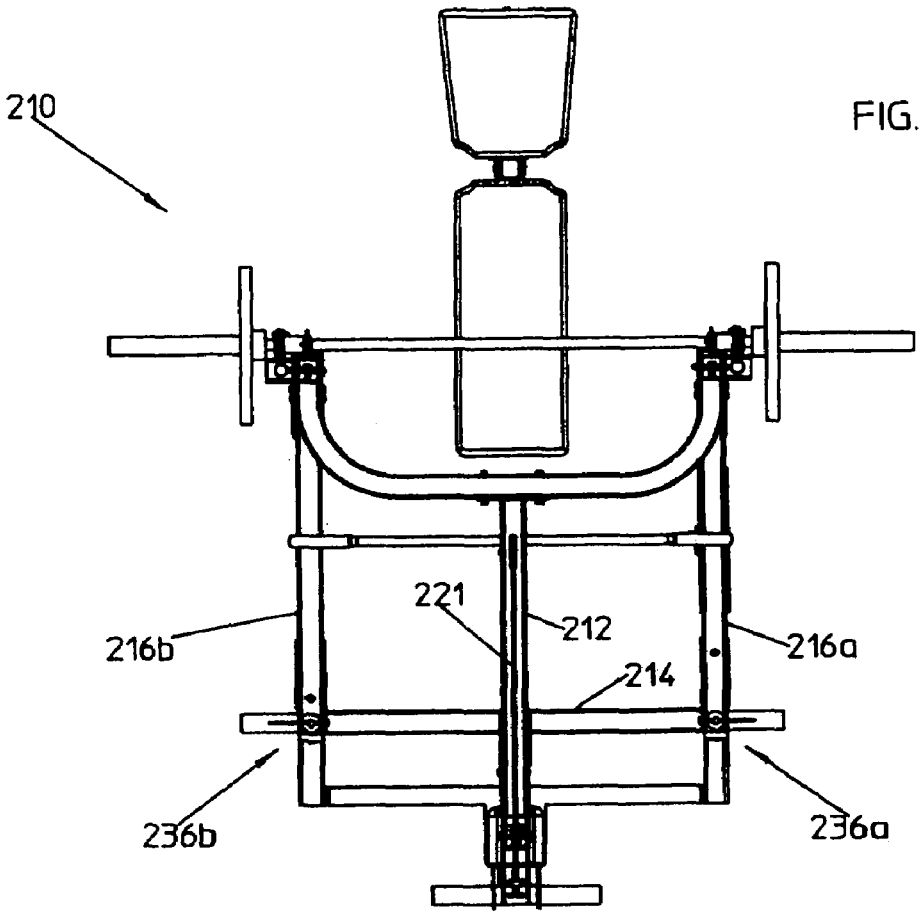
FIGS. 11A and 11B are right side and plan views of the system of FIG. 10.
Figure 11A:
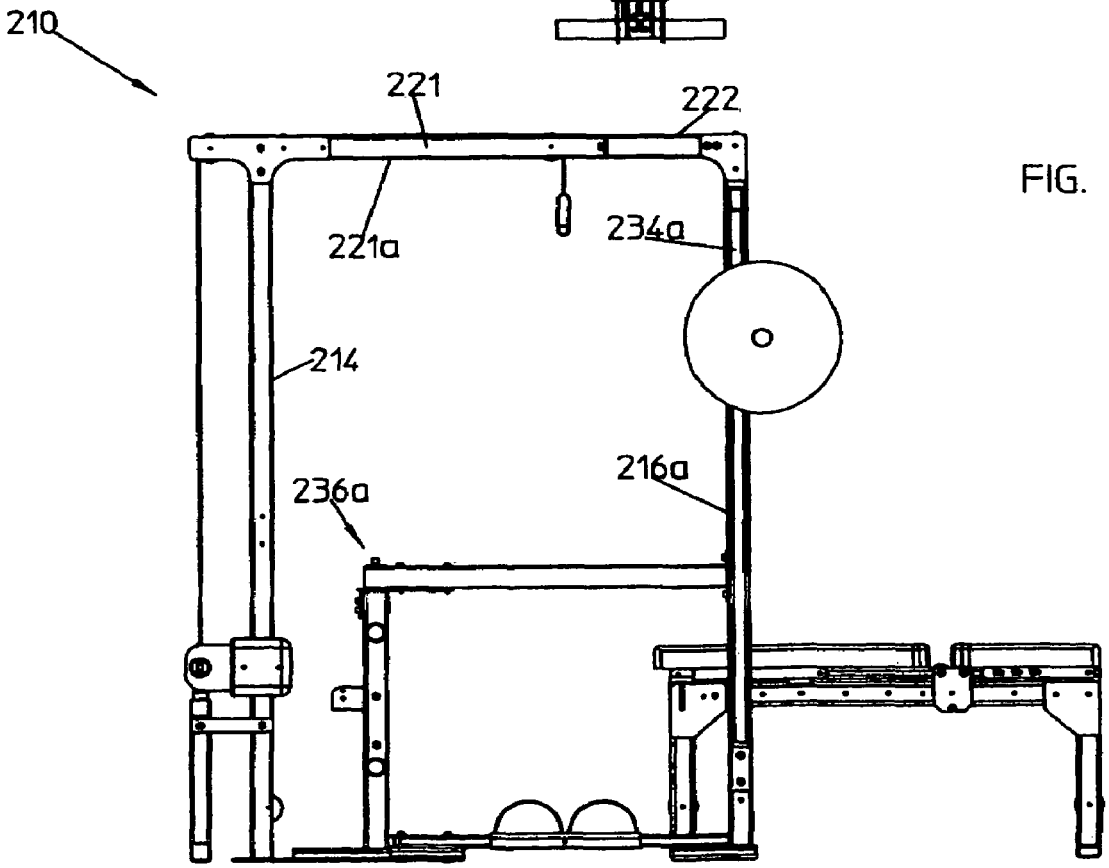

As shown in FIG. 10, the bench 40 may be fitted with an optional rear foot 88 instead of being pivotably attached to the rear frame member 14. Together with the front foot 87, the rear foot 88 allows the bench 40 to be used independent of the safety cage 12, e.g., for exercises that a user prefers to perform outside of the safety cage 12, while retaining the ability to pivot the rear portion 42 relative to horizontal.

As shown in FIG. 5B, the opposing edges of the rear back portion 42 and the front seat portion 44 may have respective shaped sections 90 and 91. The sections 90 and 91 are shaped as shown to provide openings within which a user can position his legs while standing to secure his stance while performing certain exercises, e.g., military press, bicep curls, etc.

Figure 26A:
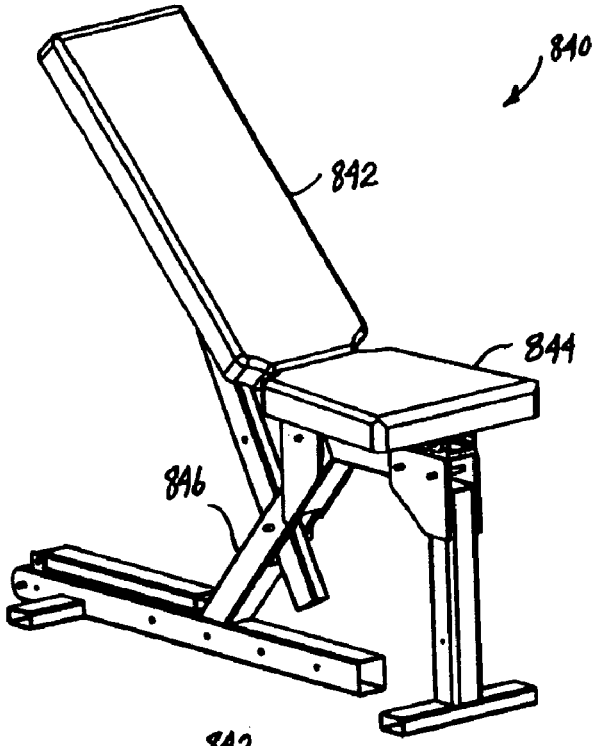
FIGS. 26A, 26B, 26C are perspective views, respectively, of a modified bench, shown in inclined, flat, and declined positions, respectively, suitable for use with the safety cage system.
Figure 26B:
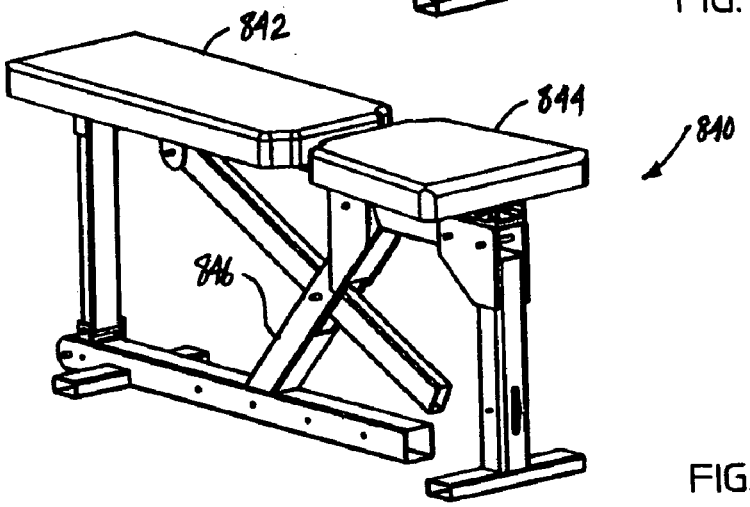
Figure 26C:
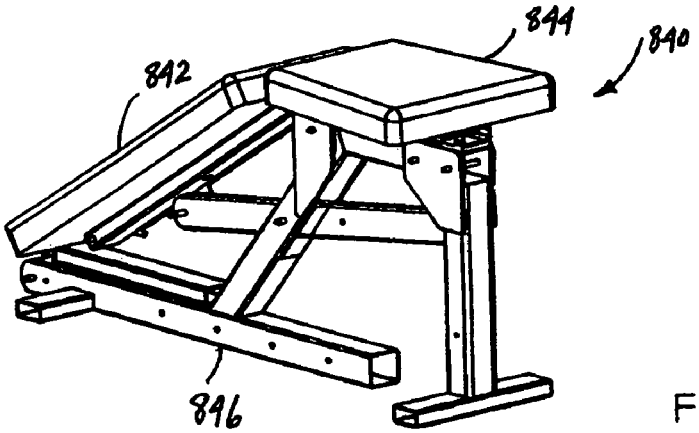

As shown in FIGS. 26A, 26B and 26C, a modified bench 840 can be used in place of the bench 40. The modified bench 840 has a pivoting rear portion 842, a front portion 844 and a supporting frame 846. The rear portion 842 can be pivoted upwardly (FIG. 26A), positioned horizontally (FIG. 26B) or pivoted downwardly (FIG. 26C). The bench 840 can be used as a stand-alone (FIGS. 26A, 26B and 26C) or as an integrated component of any of the safety cage systems.

FIG. 29 shows the modified bench 840 attached to a rear lateral member of the system 10 with the rear portion 842 pivoted to a nearly vertical position. FIG. 30 is similar to FIG. 29, except the modified bench has been pivoted rearwardly to free space within the safety cage 12 and the rear portion 842 is positioned in approximately the same plane as the front portion 844.

Figure 27A:
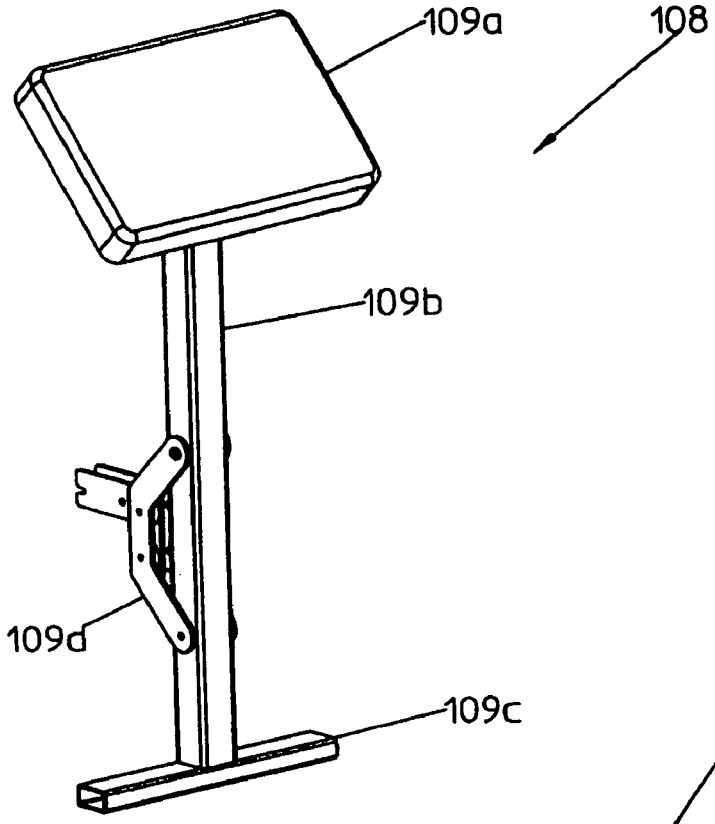
FIGS. 27A, 27B and 27C are perspective, right side and front side views, respectively of a preacher curl support suitable for use with the safety cage system.
Figure 27C:
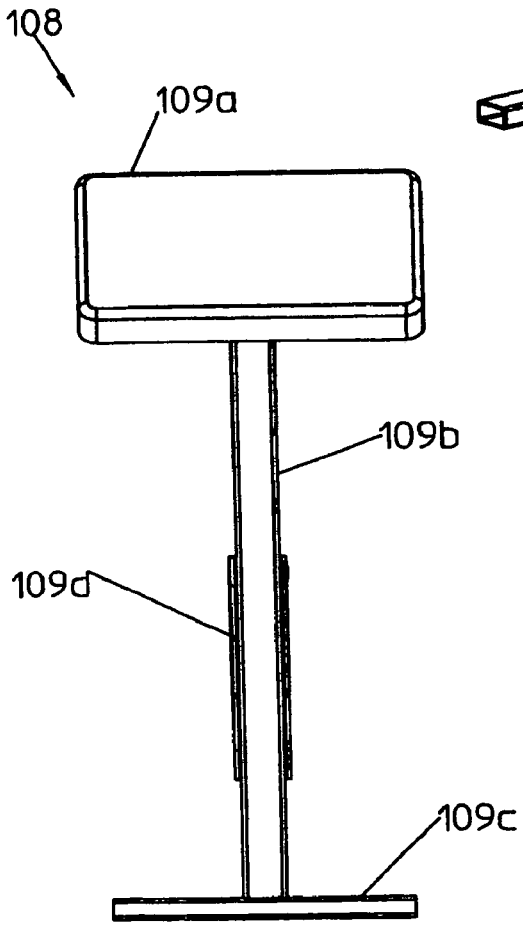
Figure 27B:
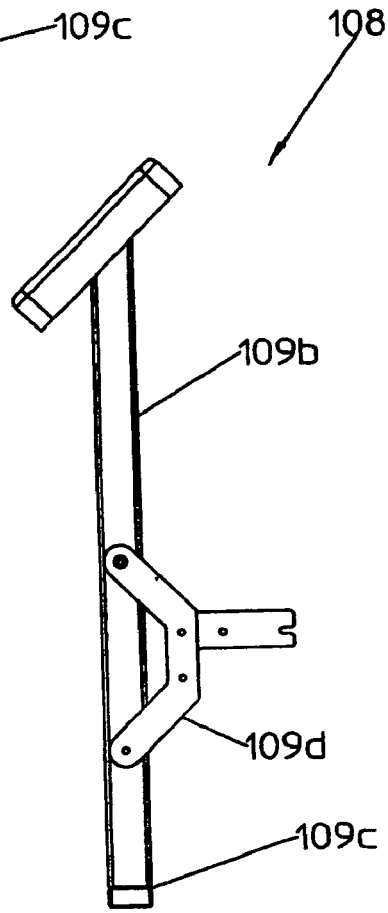

As shown in FIGS. 27A, 27B and 27C, the systems may include an arm rest 108 used, e.g., in performing arm exercises, such as curls. The arm rest 108 has a pad 109*a* mounted to an upright 109*b* that is supported by a foot 109*c*. A mounting portion 109*d* is attached to the upright 109*b*. The mounting portion 109*d* can be connected to the bench by inserting it into the open end of the frame member of the bench and securing it with a pin.

Referring to FIG. 1, the weight lifting system described above can be fitted with an integrated audio and/or visual system 101 (e.g., a stereo, TV and/or a computer) with a main unit 103 and loud speakers 105. The system 101 can be used to provide entertainment while exercising (e.g., by radio, TV, CD, DVD, etc.). If the system 101 includes a computer, it may include a dedicated application, e.g., to record exercise date (e.g., user, date, time, exercise, repetitions, sets, etc.), calculate certain parameters (e.g., total weight lifted, duration of workout, % of maximum lift, etc.) and/or allow the user to view data from past workouts.

Referring again to FIG. 1, the systems described above can also have an integrated beverage dispenser or beverage holder 107 for providing a source of liquid to the user during exercise. The holder 107 can be mounted to the safety cage 12 at any convenient location, such as an outer side of the right rear upright 20*b* as shown.

General Construction

In preferred embodiments, the various components of the system are made of steel or other suitable materials. As can be seen in the drawings, the system components can be made from square, rectangular and round tubing (e.g., the upright, rear lateral and bench frame members), as well as solid bar stock (e.g., the lateral members and safety sides of the side frame members), as appropriate. The edges of square and rectangular pieces may be rounded for convenience, safety and improved aesthetics.

As also seen in the drawings, many of the joints between the various rigidly connected members are formed with a pair of overlying gusset plates and through bolts (see, e.g., gusset plates 108 and bolts 109 in FIG. 1). Thus, the system can be at least partially disassembled, for shipping, transport, etc. As known to those of ordinary skill in the art, welding or other forms of attachment may also be used.

Having illustrated and described the principles of my invention with reference to several preferred embodiments, it should be apparent to those of ordinary skill in the art that the invention may be modified in arrangement and detail without departing from such principles. I claim all such modifications which fall within the scope and spirit of the following claims.

What is claimed is:

1. A weight lifting frame system, comprising:

a rear frame member;

first and second side frame members movably coupled to opposite ends, respectively, of the rear frame member wherein the first and second side frame members are movable relative to each other and the rear frame member between at least a first compact position in which the side frame members are adjacent the rear frame member, and a second position in which the side frame members are spaced from each other and from the rear frame member to define an exercise space therein capable of accommodating an exerciser; and a barbell holding and guiding assembly capable of releasably securing a barbell for selectively guided movement of the barbell relative to the side frame members, the assembly including first and second guide members coupleable to the first and second side frame members, respectively, and first and second movable holders coupleable to the first and second guide members, respectively, and configured to receive and releasably retain the barbell therein;

wherein the first and second guide members have lower ends coupled to the first and second frame members, respectively, with multiply pivotable connections, the multiply pivotable connections providing for rotation about at least two mutually perpendicular axes, and wherein the first and second guide members have upper ends that are free to translate within a predetermined two-dimensional range.

2. The frame system of claim 1, wherein the multiply pivotable connections provide for rotation about at least three mutually perpendicular axes.

* * * * *